US012434117B2

(12) United States Patent
Parsons et al.

(10) Patent No.: US 12,434,117 B2
(45) Date of Patent: Oct. 7, 2025

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Matthew T. Andrews, Scottsdale, AZ (US); Bradley D. Schweigert, Cave Creek, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 18/660,411

(22) Filed: May 10, 2024

(65) Prior Publication Data

US 2024/0293707 A1 Sep. 5, 2024

Related U.S. Application Data

(63) Continuation of application No. 18/385,952, filed on Nov. 1, 2023, now Pat. No. 12,011,644, which is a continuation of application No. 18/219,215, filed on Jul. 7, 2023, now Pat. No. 11,839,801, which is a continuation-in-part of application No. 18/102,534, (Continued)

(51) Int. Cl.

| | |
|---|---|
| ***A63B 53/04*** | (2015.01) |
| ***A63B 53/06*** | (2015.01) |
| ***A63B 60/02*** | (2015.01) |

(52) U.S. Cl.

CPC ..... *A63B 53/0487* (2013.01); *A63B 53/065* (2013.01); *A63B 60/02* (2015.10); *A63B 53/0408* (2020.08); *A63B 53/0437* (2020.08); *A63B 53/0441* (2020.08); *A63B 53/0466* (2013.01); *A63B 53/047* (2013.01); *A63B 2053/0491* (2013.01)

(58) Field of Classification Search

CPC ..... A63B 53/0487; A63B 53/0408; A63B 53/0433; A63B 53/0441; A63B 53/0445; A63B 60/54; A63B 2053/0491

See application file for complete search history.

(56) References Cited

U.S. PATENT DOCUMENTS 807,224 A 12/1905 Vaile
922,444 A 5/1909 Youds (Continued)

FOREIGN PATENT DOCUMENTS

FR 2834647 A1 7/2003
JP H09271542 A 10/1997

(Continued)

*Primary Examiner* — Michael D Dennis

(57) ABSTRACT

Embodiments of golf club heads and methods to manufacture golf club heads are generally described herein. In one example, a golf club head may include a body portion having a face portion for striking a golf ball and an enclosed interior cavity. A filler material may be inside the interior cavity and may reinforce the face portion. The filler material may include a low density polymer material to enable discretionary mass placement to other areas of the golf club head to improve certain mass properties of the golf club head. Other examples and embodiments may be described and claimed.

20 Claims, 47 Drawing Sheets

Related U.S. Application Data filed on Jan. 27, 2023, now Pat. No. 12,138,512, and a continuation-in-part of application No. 18/099,461, filed on Jan. 20, 2023, now Pat. No. 12,036,455, and a continuation-in-part of application No. 17/978,877, filed on Nov. 1, 2022, and a continuation-in-part of application No. 17/972,710, filed on Oct. 25, 2022, and a continuation-in-part of application No. 17/824,074, filed on May 25, 2022, now Pat. No. 11,951,366, and a continuation-in-part of application No. 17/709,746, filed on Mar. 31, 2022, and a continuation-in-part of application No. 17/706,782, filed on Mar. 29, 2022, now Pat. No. 11,745,068, and a continuation-in-part of application No. 17/472,321, filed on Sep. 10, 2021, now Pat. No. 11,759,684, said application No. 18/099,461 is a continuation of application No. 17/378,252, filed on Jul. 16, 2021, now Pat. No. 11,583,738, said application No. 17/972,710 is a continuation of application No. 17/344,705, filed on Jun. 10, 2021, now Pat. No. 11,511,169, said application No. 17/378,252 is a continuation of application No. 17/232,401, filed on Apr. 16, 2021, now Pat. No. 11,090,535, said application No. 17/978,877 is a continuation of application No. 17/133,260, filed on Dec. 23, 2020, now Pat. No. 11,517,798, said application No. 17/824,074 is a continuation of application No. 17/123,325, filed on Dec. 16, 2020, now Pat. No. 11,369,849, said application No. 17/472,321 is a continuation of application No. 16/940,806, filed on Jul. 28, 2020, now Pat. No. 11,141,635, said application No. 17/344,705 is a continuation of application No. 16/751,500, filed on Jan. 24, 2020, now Pat. No. 11,045,698, said application No. 17/706,782 is a continuation of application No. 16/674,332, filed on Nov. 5, 2019, now Pat. No. 11,311,781, said application No. 17/232,401 is a continuation of application No. 16/567,937, filed on Sep. 11, 2019, now Pat. No. 10,981,038, said application No. 16/674,332 is a continuation of application No. 16/275,883, filed on Feb. 14, 2019, now Pat. No. 10,493,331, said application No. 16/751,500 is a continuation-in-part of application No. 16/035,271, filed on Jul. 13, 2018, now Pat. No. 10,576,339, said application No. 16/940,806 is a continuation of application No. 16/006,055, filed on Jun. 12, 2018, now Pat. No. 10,737,153.

(60) Provisional application No. 63/524,452, filed on Jun. 30, 2023, provisional application No. 63/470,711, filed on Jun. 2, 2023, provisional application No. 63/402,587, filed on Aug. 31, 2022, provisional application No. 63/390,206, filed on Jul. 18, 2022, provisional application No. 63/244,283, filed on Sep. 15, 2021, provisional application No. 63/008,654, filed on Apr. 10, 2020, provisional application No. 62/949,064, filed on Dec. 17, 2019, provisional application No. 62/798,277, filed on Jan. 29, 2019, provisional application No. 62/755,241, filed on Nov. 2, 2018, provisional application No. 62/745,194, filed on Oct. 12, 2018, provisional application No. 62/659,060, filed on Apr. 17, 2018, provisional application No. 62/644,233, filed on Mar. 16, 2018, provisional application No. 62/533,481, filed on Jul. 17, 2017.

(56) References Cited

U.S. PATENT DOCUMENTS

| | | | | | |
|---|---|---|---|---|---|
| RE19,178 | E | | 5/1934 | Spiker | |
| 3,497,220 | A | | 2/1970 | Scott | |
| 3,749,408 | A | | 7/1973 | Mills | |
| 4,043,562 | A | | 8/1977 | Shillington | |
| 4,163,554 | A | | 8/1979 | Bernhardt | |
| 4,265,451 | A | | 5/1981 | Bernhardt | |
| 4,340,230 | A | | 7/1982 | Churchward | |
| 4,553,755 | A | * | 11/1985 | Yamada | A63B 53/04 473/346 |
| 4,754,977 | A | | 7/1988 | Sahm | |
| 4,869,507 | A | | 9/1989 | Sahm | |
| 4,927,144 | A | | 5/1990 | Stormon | |
| 5,116,047 | A | | 5/1992 | Phelan et al. | |
| 5,127,653 | A | | 7/1992 | Nelson | |
| 5,137,275 | A | | 8/1992 | Nelson | |
| 5,193,806 | A | | 3/1993 | Burkly | |
| D335,317 | S | | 5/1993 | Shearer | |
| D335,692 | S | | 5/1993 | Antonious | |
| D336,757 | S | | 6/1993 | Antonious | |
| 5,228,332 | A | | 7/1993 | Bernhardt | |
| 5,244,205 | A | | 9/1993 | Melanson et al. | |
| 5,275,412 | A | | 1/1994 | Innes | |
| D350,582 | S | | 9/1994 | Miansian et al. | |
| 5,388,827 | A | | 2/1995 | Reynolds | |
| 5,390,918 | A | | 2/1995 | Meyers et al. | |
| 5,429,366 | A | | 7/1995 | McCabe | |
| D363,101 | S | | 10/1995 | Sturm | |
| 5,454,563 | A | | 10/1995 | Nagamoto et al. | |
| 5,470,063 | A | | 11/1995 | Fisher | |
| D365,864 | S | | 1/1996 | Sturm | |
| 5,489,097 | A | | 2/1996 | Simmons | |
| D368,751 | S | | 4/1996 | Rife | |
| D369,393 | S | | 4/1996 | Takahashi et al. | |
| 5,518,235 | A | | 5/1996 | Mendenhall | |
| 5,569,098 | A | | 10/1996 | Klein | |
| 5,571,053 | A | | 11/1996 | Lane | |
| D378,688 | S | | 4/1997 | Cameron | |
| 5,647,807 | A | | 7/1997 | Nagamoto | |
| D385,609 | S | | 10/1997 | Cameron | |
| 5,683,307 | A | | 11/1997 | Rife | |
| 5,688,190 | A | | 11/1997 | Rowland et al. | |
| D388,143 | S | | 12/1997 | Huan-Chiang | |
| D389,207 | S | | 1/1998 | Cameron | |
| 5,711,719 | A | | 1/1998 | Fireman | |
| 5,720,671 | A | | 2/1998 | Cheng | |
| 5,749,793 | A | | 5/1998 | Lucetti | |
| D398,685 | S | | 9/1998 | Masuda | |
| 5,803,824 | A | | 9/1998 | Rollingson | |
| D399,290 | S | | 10/1998 | Sizemore, Jr. | |
| D399,911 | S | | 10/1998 | Nicolette et al. | |
| 5,839,974 | A | | 11/1998 | McAllister | |
| 5,842,935 | A | | 12/1998 | Nelson | |
| D405,836 | S | | 2/1999 | Nicolette et al. | |
| 5,890,969 | A | | 4/1999 | Bechler | |
| D409,701 | S | | 5/1999 | Ashcraft et al. | |
| 5,924,938 | A | | 7/1999 | Hines | |
| 5,941,781 | A | | 8/1999 | Sessions | |
| 6,007,434 | A | | 12/1999 | Baker et al. | |
| 6,039,656 | A | | 3/2000 | Fireman | |
| D422,655 | S | | 4/2000 | Hicks | |
| 6,050,903 | A | | 4/2000 | Lake | |
| D426,276 | S | | 6/2000 | Besnard et al. | |
| 6,083,113 | A | | 7/2000 | Bernhardt | |
| D431,854 | S | | 10/2000 | Cameron | |
| D432,192 | S | | 10/2000 | Hicks | |
| 6,146,571 | A | * | 11/2000 | Vincent | B29C 45/4457 425/176 |
| D436,151 | S | | 1/2001 | Nicolette et al. | |
| D437,374 | S | | 2/2001 | Cameron | |
| 6,217,460 | B1 | | 4/2001 | Broadbridge et al. | |
| D441,820 | S | | 5/2001 | Nicolette et al. | |
| 6,234,915 | B1 | | 5/2001 | Wu | |
| D443,668 | S | | 6/2001 | Nicolette et al. | |
| D443,905 | S | | 6/2001 | Nicolette et al. | |
| D444,833 | S | | 7/2001 | Wells et al. | |

(56) References Cited

U.S. PATENT DOCUMENTS

| | | | |
|---|---|---|---|
| 6,264,571 | B1 | 7/2001 | Lekavich |
| 6,277,033 | B1 | 8/2001 | Krumme et al. |
| D449,664 | S | 10/2001 | Beebe et al. |
| D449,865 | S | 10/2001 | Fife, Jr. et al. |
| D450,799 | S | 11/2001 | Nicolette et al. |
| D451,973 | S | 12/2001 | Wells et al. |
| 6,348,014 | B1 | 2/2002 | Chiu |
| 6,354,959 | B1 | 3/2002 | Nicolette et al. |
| 6,364,788 | B1 | 4/2002 | Helmstetter et al. |
| 6,394,910 | B1 | 5/2002 | McCarthy |
| 6,478,694 | B2 | 11/2002 | Anderson et al. |
| D472,949 | S | 4/2003 | Serrano |
| D474,821 | S | 5/2003 | Wells et al. |
| D474,949 | S | 5/2003 | Schaffeld et al. |
| 6,561,919 | B2 | 5/2003 | Edel |
| D483,086 | S | 12/2003 | Schweigert et al. |
| 6,659,883 | B2 | 12/2003 | Nelson et al. |
| D486,872 | S | 2/2004 | Schweigert et al. |
| D488,200 | S | 4/2004 | Olsavsky et al. |
| D498,276 | S | 11/2004 | Schweigert et al. |
| 6,902,496 | B2 | 6/2005 | Solheim et al. |
| 6,902,498 | B2 | 6/2005 | Sullivan et al. |
| D512,116 | S | 11/2005 | Miraflor et al. |
| 6,988,956 | B2 | 1/2006 | Cover et al. |
| 6,997,819 | B2 | 2/2006 | Naylor et al. |
| D520,088 | S | 5/2006 | Parr |
| 7,077,760 | B2 | 7/2006 | Gray |
| D531,242 | S | 10/2006 | Adams |
| D532,067 | S | 11/2006 | Soracco et al. |
| 7,153,220 | B2 | 12/2006 | Lo |
| D534,595 | S | 1/2007 | Hasebe |
| 7,156,752 | B1 | 1/2007 | Bennett |
| 7,163,465 | B2 | 1/2007 | Edel |
| D536,401 | S | 2/2007 | Kawami |
| D536,403 | S | 2/2007 | Kawami |
| D538,371 | S | 3/2007 | Kawami |
| 7,201,668 | B1 | 4/2007 | Pamias |
| 7,204,765 | B2 | 4/2007 | Cover et al. |
| D542,869 | S | 5/2007 | Adams |
| D543,598 | S | 5/2007 | Kuan et al. |
| D543,601 | S | 5/2007 | Kawami |
| 7,278,926 | B2 | 10/2007 | Frame |
| D555,219 | S | 11/2007 | Lin |
| D556,277 | S | 11/2007 | Broom |
| 7,309,297 | B1 | 12/2007 | Solari |
| D561,854 | S | 2/2008 | Morris |
| 7,331,876 | B2 | 2/2008 | Klein |
| 7,351,162 | B2 | 4/2008 | Soracco et al. |
| D569,461 | S | 5/2008 | Morris |
| D569,930 | S | 5/2008 | Nehrbas |
| 7,396,289 | B2 | 7/2008 | Soracco et al. |
| 7,407,445 | B2 | 8/2008 | Pedraza et al. |
| 7,416,494 | B2 | 8/2008 | Edel |
| D577,085 | S | 9/2008 | Nicolette et al. |
| D577,086 | S | 9/2008 | Nicolette et al. |
| D579,506 | S | 10/2008 | Nicolette et al. |
| D579,995 | S | 11/2008 | Nicolette et al. |
| D582,497 | S | 12/2008 | Rollinson |
| 7,473,189 | B2 | 1/2009 | Schweigert et al. |
| 7,491,131 | B2 | 2/2009 | Vinton |
| D595,793 | S | 7/2009 | Rollinson |
| D599,425 | S | 9/2009 | Laub |
| D600,763 | S | 9/2009 | Cameron |
| 7,722,476 | B2 | 5/2010 | Pedraza et al. |
| 7,744,485 | B2 | 6/2010 | Jones et al. |
| D620,993 | S | 8/2010 | Laub |
| D621,461 | S | 8/2010 | Serrano et al. |
| D623,709 | S | 9/2010 | Serrano et al. |
| 7,857,710 | B2 | 12/2010 | Pedraza |
| D631,925 | S | 2/2011 | Broom |
| 7,887,432 | B2 | 2/2011 | Jones et al. |
| 7,909,707 | B2 | 3/2011 | Klein |
| 7,918,745 | B2 | 4/2011 | Morris et al. |
| D638,891 | S | 5/2011 | Nicolette et al. |
| D642,643 | S | 8/2011 | Nicolette et al. |
| D643,485 | S | 8/2011 | Nicolette et al. |
| D645,104 | S | 9/2011 | Nicolette et al. |
| 8,016,693 | B2 | 9/2011 | Pedraza |
| 8,096,039 | B2 | 1/2012 | Soracco et al. |
| D653,718 | S | 2/2012 | Stokke et al. |
| 8,109,841 | B2 | 2/2012 | Miyamichi |
| D661,753 | S | 6/2012 | Cameron et al. |
| D666,260 | S | 8/2012 | Cynn |
| 8,371,958 | B2 | 2/2013 | Treadwell |
| 8,376,878 | B2 | 2/2013 | Bennett et al. |
| D688,339 | S | 8/2013 | Hilton et al. |
| D688,341 | S | 8/2013 | Rollinson |
| D691,226 | S | 10/2013 | Hilton et al. |
| 8,636,607 | B2 | 1/2014 | Renna |
| D699,308 | S | 2/2014 | Rollinson |
| 8,696,492 | B1 | 4/2014 | Hocknell et al. |
| D704,782 | S | 5/2014 | Rollinson |
| 8,721,472 | B2 | 5/2014 | Kuan et al. |
| 8,790,193 | B2 | 7/2014 | Serrano et al. |
| D711,483 | S | 8/2014 | Wong |
| D715,388 | S | 10/2014 | Serrano et al. |
| 8,870,674 | B1 | 10/2014 | Abbott |
| D722,350 | S | 2/2015 | Schweigert |
| D722,351 | S | 2/2015 | Parsons et al. |
| D722,352 | S | 2/2015 | Nicolette et al. |
| D723,120 | S | 2/2015 | Nicolette |
| D724,164 | S | 3/2015 | Schweigert et al. |
| D725,208 | S | 3/2015 | Schweigert |
| D726,265 | S | 4/2015 | Nicolette |
| D726,846 | S | 4/2015 | Schweigert |
| D730,462 | S | 5/2015 | Becktor et al. |
| D732,122 | S | 6/2015 | Becktor |
| D732,618 | S | 6/2015 | Becktor et al. |
| D733,234 | S | 6/2015 | Nicolette |
| 9,079,077 | B2 | 7/2015 | Wolf |
| 9,108,088 | B2 | 8/2015 | Serrano et al. |
| 9,108,092 | B1 | 8/2015 | Warner |
| D738,447 | S | 9/2015 | Schweigert |
| D738,449 | S | 9/2015 | Schweigert |
| D739,487 | S | 9/2015 | Schweigert |
| D741,426 | S | 10/2015 | Schweigert |
| D748,213 | S | 1/2016 | Parsons et al. |
| D748,215 | S | 1/2016 | Parsons et al. |
| 9,233,283 | B2 | 1/2016 | Schweigert |
| 9,272,193 | B1 | 3/2016 | Yim |
| D753,252 | S | 4/2016 | Schweigert |
| 9,375,615 | B2 | 6/2016 | Park |
| 9,387,375 | B2 | 7/2016 | Schweigert |
| 9,440,124 | B2 | 9/2016 | Parsons et al. |
| 9,545,544 | B2 | 1/2017 | Jones et al. |
| 9,604,108 | B1 | 3/2017 | Dunnell et al. |
| 9,649,540 | B2 | 5/2017 | Parsons et al. |
| 9,675,854 | B2 | 6/2017 | Wang et al. |
| 9,795,844 | B1 | 10/2017 | Dacey et al. |
| 9,808,680 | B1 | 11/2017 | Myers et al. |
| 9,895,585 | B2 | 2/2018 | Kroloff |
| 9,925,427 | B2 | 3/2018 | Bischmann et al. |
| 9,956,463 | B2 | 5/2018 | Franklin et al. |
| 9,987,530 | B2 | 6/2018 | Jertson et al. |
| 10,166,445 | B2 | 1/2019 | Brandt |
| 10,478,680 | B2 | 11/2019 | Schweigert et al. |
| 10,493,331 | B2 | 12/2019 | Kroloff et al. |
| 10,576,339 | B2 | 3/2020 | Schweigert et al. |
| 10,632,352 | B2 | 4/2020 | Lambeth et al. |
| 10,668,340 | B2 | 6/2020 | Lambeth et al. |
| 10,737,153 | B2 | 8/2020 | Schweigert et al. |
| 10,821,341 | B2 | 11/2020 | Schweigert et al. |
| 10,960,271 | B2 | 3/2021 | Kroloff et al. |
| 10,981,038 | B2 | 4/2021 | Schweigert et al. |
| 11,045,698 | B2 | 6/2021 | Schweigert et al. |
| 11,090,535 | B1 | 8/2021 | Schweigert et al. |
| 11,141,635 | B2 | 10/2021 | Schweigert et al. |
| 11,161,021 | B2 | 11/2021 | Becktor et al. |
| 11,298,597 | B2 | 4/2022 | Parsons et al. |
| 11,364,422 | B1 | 6/2022 | Parsons et al. |
| 11,369,849 | B2 | 6/2022 | Andrews et al. |
| 11,420,100 | B2 | 8/2022 | Wang et al. |
| 11,517,798 | B2 | 12/2022 | Kroloff et al. |
| 11,813,508 | B2 * | 11/2023 | Higdon ..... A63B 53/0437 |

(56) References Cited

U.S. PATENT DOCUMENTS

| | | | | |
|---|---|---|---|---|
| 11,998,810 | B1 * | 6/2024 | Day | A63B 53/0416 |
| 2002/0077193 | A1 | 6/2002 | Takeda | |
| 2002/0151376 | A1 | 10/2002 | Verne | |
| 2002/0193174 | A1 | 12/2002 | Edel | |
| 2003/0045372 | A1 | 3/2003 | Vrska et al. | |
| 2003/0199332 | A1 | 10/2003 | Lindsay | |
| 2004/0014532 | A1 | 1/2004 | Lee et al. | |
| 2004/0138003 | A1 | 7/2004 | Grace | |
| 2004/0180730 | A1 | 9/2004 | Franklin et al. | |
| 2006/0052178 | A1 | 3/2006 | Franklin et al. | |
| 2006/0094522 | A1 | 5/2006 | Tang et al. | |
| 2006/0223649 | A1 | 10/2006 | Rife | |
| 2007/0129163 | A1 | 6/2007 | Solari | |
| 2007/0135232 | A1 | 6/2007 | Billings | |
| 2007/0142122 | A1 | 6/2007 | Bonneau | |
| 2007/0178987 | A1 | 8/2007 | Wright | |
| 2007/0207875 | A1 | 9/2007 | Kuan et al. | |
| 2007/0238548 | A1 | 10/2007 | Johnson | |
| 2008/0139333 | A1 | 6/2008 | Klein | |
| 2008/0146372 | A1 | 6/2008 | John | |
| 2008/0176672 | A1 | 7/2008 | Roach et al. | |
| 2009/0029800 | A1 | 1/2009 | Jones et al. | |
| 2009/0156328 | A1 | 6/2009 | Reese | |
| 2009/0163287 | A1 | 6/2009 | Vald Via et al. | |
| 2009/0239678 | A1 | 9/2009 | De La et al. | |
| 2010/0035700 | A1 | 2/2010 | Yu et al. | |
| 2010/0255922 | A1 | 10/2010 | Lueders | |
| 2010/0317454 | A1 | 12/2010 | Sato et al. | |
| 2011/0165959 | A1 | 7/2011 | Klein | |
| 2011/0224014 | A1 * | 9/2011 | Tryner | A63B 53/0487 473/340 |
| 2013/0165256 | A1 | 6/2013 | Stevenson | |
| 2013/0210537 | A1 | 8/2013 | Ainscough et al. | |
| 2014/0100053 | A1 | 4/2014 | Stokke et al. | |
| 2015/0306477 | A1 | 10/2015 | Parsons et al. | |
| 2016/0016050 | A1 | 1/2016 | Rife et al. | |
| 2016/0136487 | A1 | 5/2016 | Clarke et al. | |
| 2016/0346649 | A1 | 12/2016 | Jertson et al. | |
| 2018/0001163 | A1 | 1/2018 | Becktor et al. | |
| 2018/0311545 | A1 | 11/2018 | Lambeth et al. | |
| 2018/0361206 | A1 | 12/2018 | Becktor et al. | |
| 2019/0091527 | A1 | 3/2019 | Serrano et al. | |
| 2019/0247726 | A1 * | 8/2019 | Parsons | A63B 53/047 |
| 2020/0171362 | A1 * | 6/2020 | Wang | A63B 60/52 |
| 2020/0282277 | A1 * | 9/2020 | Spackman | A63B 53/0475 |
| 2021/0146205 | A1 | 5/2021 | Parsons et al. | |
| 2021/0245019 | A1 | 8/2021 | Schweigert et al. | |
| 2022/0152464 | A1 | 5/2022 | Pedraza | |
| 2022/0176213 | A1 * | 6/2022 | Parsons | A63B 53/0466 |

FOREIGN PATENT DOCUMENTS

| | | | |
|---|---|---|---|
| JP | H11253590 | A | 9/1999 |
| JP | 2004223184 | A | 8/2004 |
| JP | 2005065796 | A | 3/2005 |
| JP | 2005160691 | A | 6/2005 |
| JP | 2013043091 | A | 3/2013 |
| KR | 200377377 | Y1 | 3/2005 |
| KR | 200403045 | Y1 | 12/2005 |
| KR | 20100065481 | A | 6/2010 |
| KR | 101773069 | B1 | 8/2017 |
| WO | 03020372 | A2 | 3/2003 |
| WO | 2006087846 | A1 | 8/2006 |
| WO | 2006113966 | A1 | 11/2006 |
| WO | 2008074093 | A1 | 6/2008 |
| WO | 2011043708 | A1 | 4/2011 |
| WO | 2012036991 | A1 | 3/2012 |
| WO | 2014145547 | A2 | 9/2014 |
| WO | 2015005593 | A1 | 1/2015 |

* cited by examiner

GOLF CLUB HEADS AND METHODS TO MANUFACTURE GOLF CLUB HEADS

CROSS REFERENCE

This application is a continuation of application Ser. No. 18/385,952, filed Nov. 1, 2023, which is a continuation of application Ser. No. 18/219,215, filed Jul. 7, 2023, now U.S. Pat. No. 11,839,801, which claims the benefit of U.S. Provisional Application No. 63/470,711, filed Jun. 2, 2023, and U.S. Provisional Application 63/524,452, filed Jun. 30, 2023.

U.S. application Ser. No. 18/219,215, filed Jul. 7, 2023, is a continuation-in-part of application Ser. No. 17/472,321, filed Sep. 10, 2021, now U.S. Pat. No. 11,759,684, which is a continuation of application Ser. No. 16/940,806, filed Jul. 28, 2020, now U.S. Pat. No. 11,141,635, which is a continuation of U.S. application Ser. No. 16/006,055, filed Jun. 12, 2018, now U.S. Pat. No. 10,737,153, which claims the benefit of U.S. Provisional Application No. 62/644,233, filed Mar. 16, 2018, and U.S. Provisional Application No. 62/659,060, filed Apr. 17, 2018.

U.S. application Ser. No. 18/219,215, filed Jul. 7, 2023, is a continuation-in-part of application Ser. No. 17/706,782, filed Mar. 29, 2022, now U.S. Pat. No. 11,745,068, which is a continuation of application Ser. No. 16/674,332, filed Nov. 5, 2019, now U.S. Pat. No. 11,311,781, which is a continuation of application Ser. No. 16/275,883, filed Feb. 14, 2019, now U.S. Pat. No. 10,493,331, which claims the benefit of U.S. Provisional Application No. 62/745,194, filed Oct. 12, 2018, and U.S. Provisional Application No. 62/755,241, filed Nov. 2, 2018.

U.S. application Ser. No. 18/219,215, filed Jul. 7, 2023, is a continuation-in-part of application Ser. No. 17/972,710, filed Oct. 25, 2022, which is a continuation of application Ser. No. 17/344,705, filed Jun. 10, 2021, now U.S. Pat. No. 11,511,169, which is a continuation of application Ser. No. 16/751,500, filed Jan. 24, 2020, now U.S. Pat. No. 11,045,698, which claims the benefit of U.S. Provisional Application No. 62/798,277, filed Jan. 29, 2019.

U.S. application Ser. No. 16/751,500 is a continuation-in-part of application Ser. No. 16/035,271, filed Jul. 13, 2018, now U.S. Pat. No. 10,576,339, which claims the benefit of U.S. Provisional Application No. 62/533,481, filed Jul. 17, 2017.

U.S. application Ser. No. 18/219,215, filed Jul. 7, 2023, is a continuation-in-part of application Ser. No. 18/099,461, filed Jan. 20, 2023, which is a continuation of application Ser. No. 17/378,252, filed Jul. 16, 2021, now U.S. Pat. No. 11,583,738, which is a continuation of application Ser. No. 17/232,401, filed Apr. 16, 2021, now U.S. Pat. No. 11,090,535, which is a continuation of application Ser. No. 16/567,937, filed Sep. 11, 2019, now U.S. Pat. No. 10,981,038.

U.S. application Ser. No. 18/219,215, filed Jul. 7, 2023, is a continuation-in-part of application Ser. No. 17/824,074, filed May 25, 2022, now U.S. Pat. No. 11,951,366, which is a continuation of application Ser. No. 17/123,325, filed Dec. 16, 2020, now U.S. Pat. No. 11,369,849, which claims the benefit of U.S. Provisional Application No. 62/949,064, filed Dec. 17, 2019.

U.S. application Ser. No. 18/219,215, filed Jul. 7, 2023, is a continuation-in-part of application Ser. No. 17/978,877, filed Nov. 1, 2022, which is a continuation of application Ser. No. 17/133,260, filed Dec. 23, 2020, now U.S. Pat. No. 11,517,798, which claims the benefit of U.S. Provisional Application No. 63/008,654, filed Apr. 10, 2020.

U.S. application Ser. No. 18/219,215, filed Jul. 7, 2023, is a continuation-in-part of application Ser. No. 17/709,746, filed Mar. 31, 2022, which claims the benefit of U.S. Provisional Application No. 63/244,283, filed Sep. 15, 2021.

U.S. application Ser. No. 18/219,215, filed Jul. 7, 2023, is a continuation-in-part of application Ser. No. 18/102,534, filed Jan. 27, 2023, which claims the benefit of U.S. Provisional Application No. 63/402,587, filed Aug. 31, 2022, and claims the benefit of U.S. Provisional Application No. 63/390,206, filed Jul. 18, 2022.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacture golf club heads.

BACKGROUND

Various materials may be used to manufacture golf club heads. By using multiple materials to manufacture golf club heads, certain mass properties of a golf club head may be optimized to improve performance.

Figure 1:
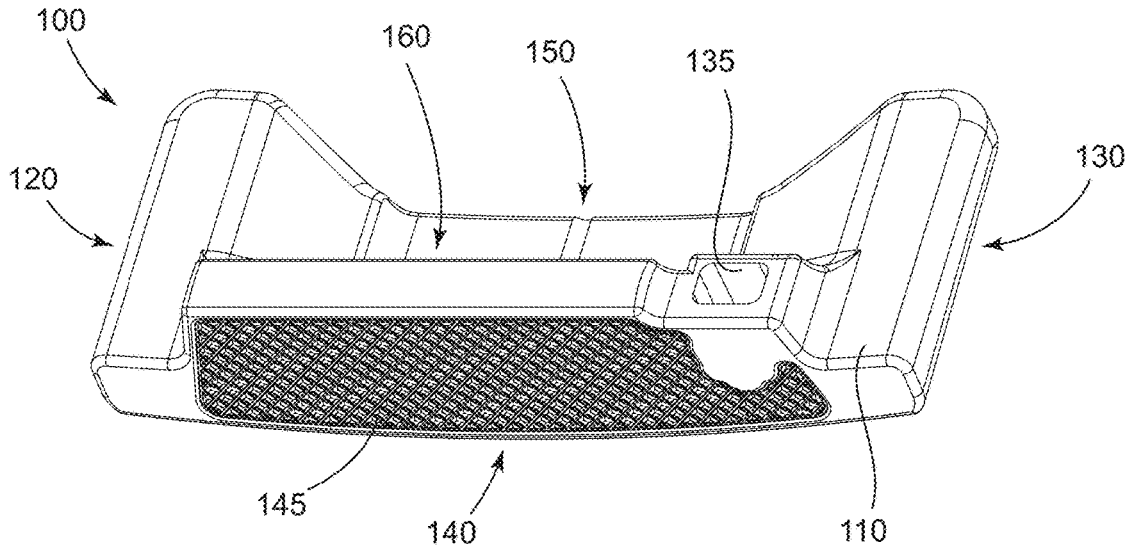
FIGS. 1, 2, 3, 4, 5, 6, 7, 8, and 9 depict a perspective front view, an exploded bottom perspective view, a front elevational view, a rear elevational view, an exploded rear perspective view, a perspective cross-sectional view (along line 6-6 of FIG. 4), a perspective cross-sectional view (along line 7-7 of FIG. 4), a perspective cross-sectional view (along line 8-8 of FIG. 4), and a perspective cross-sectional view (along line 9-9 of FIG. 4), respectively, of a golf club head according to an embodiment of the apparatus, methods, and articles of manufacture described herein.
Figure 2:
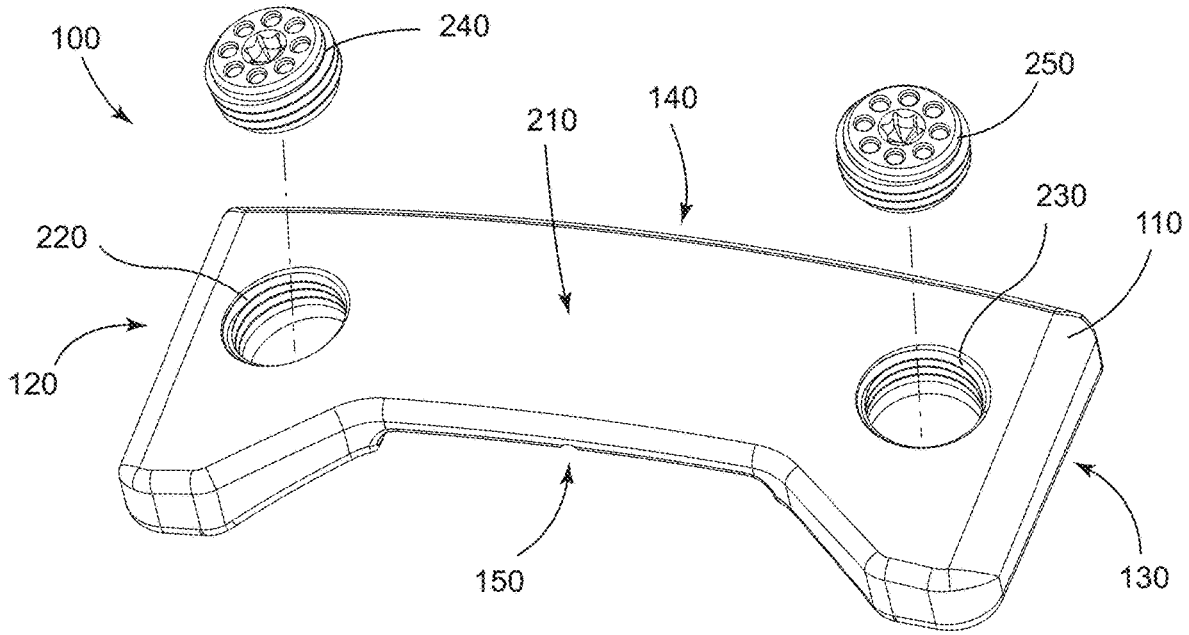
Figure 3:
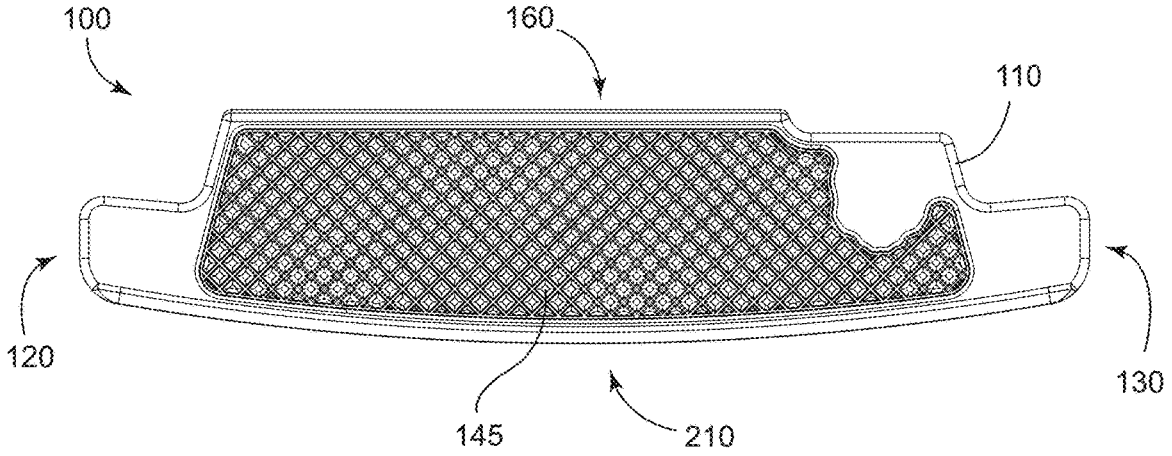
Figure 4:
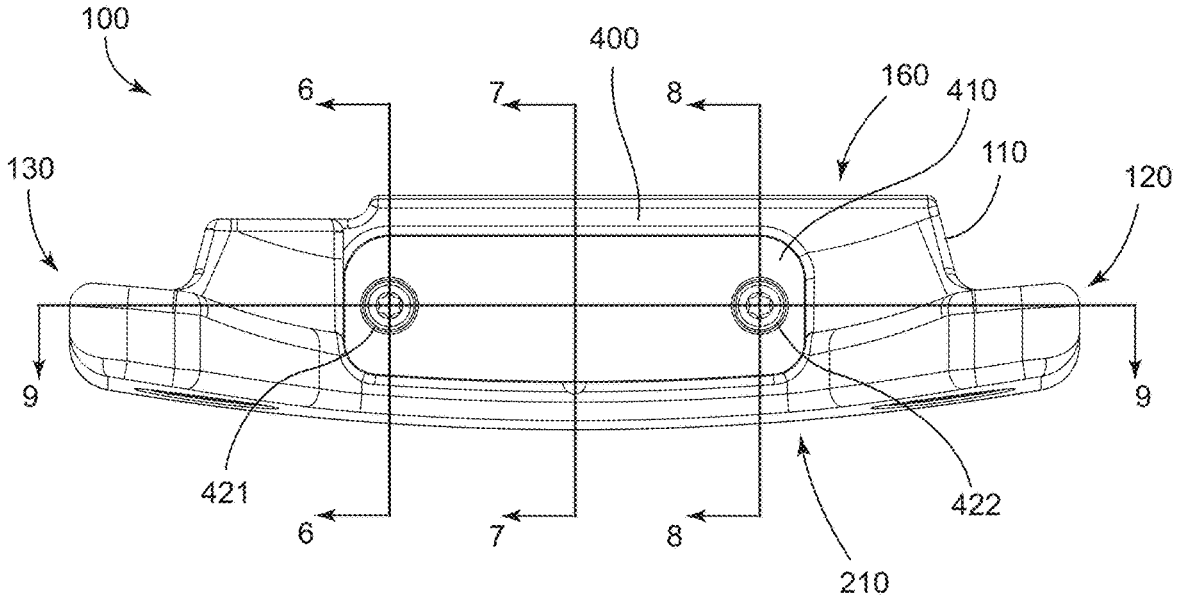
Figure 5:
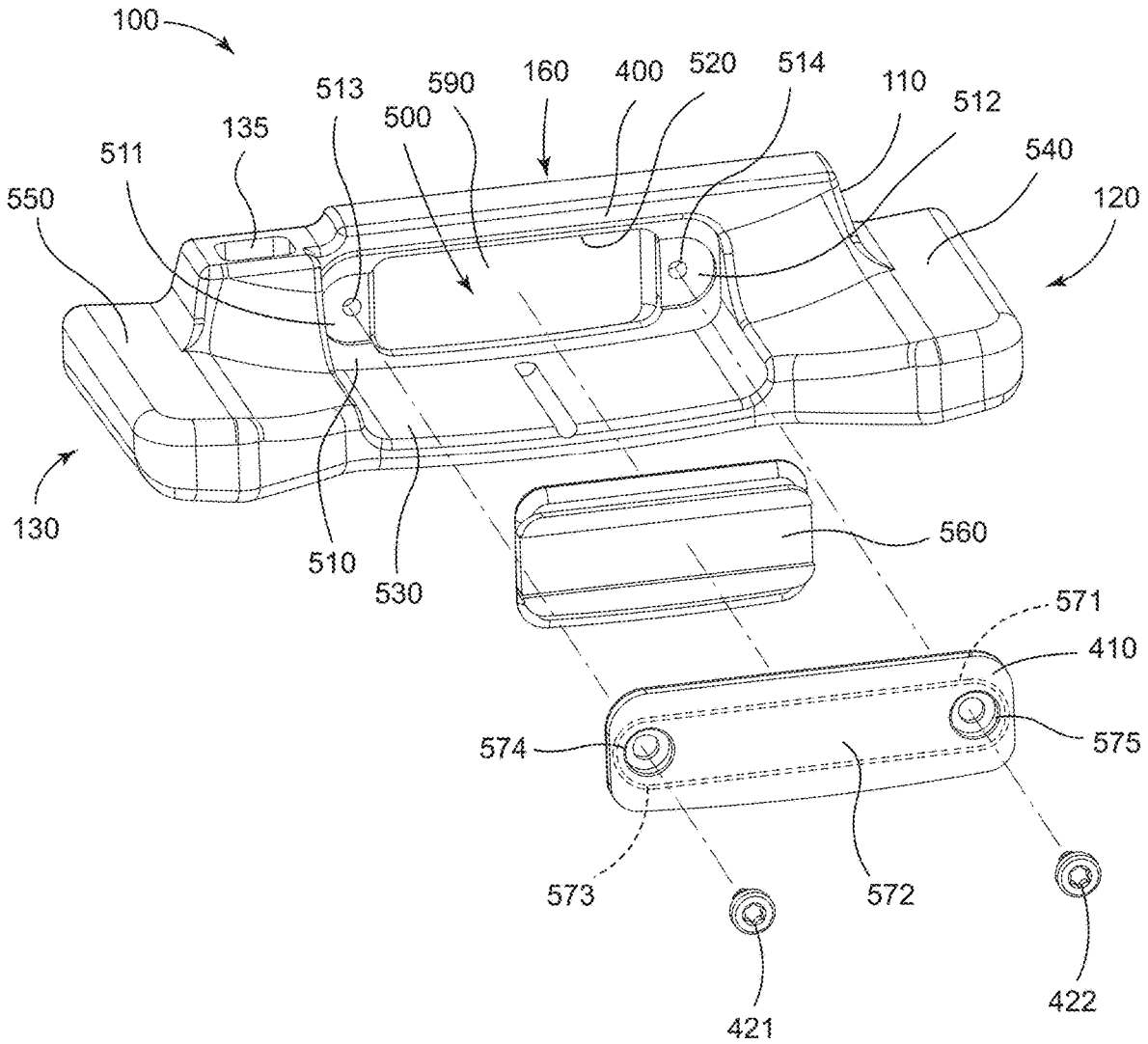
Figure 6:
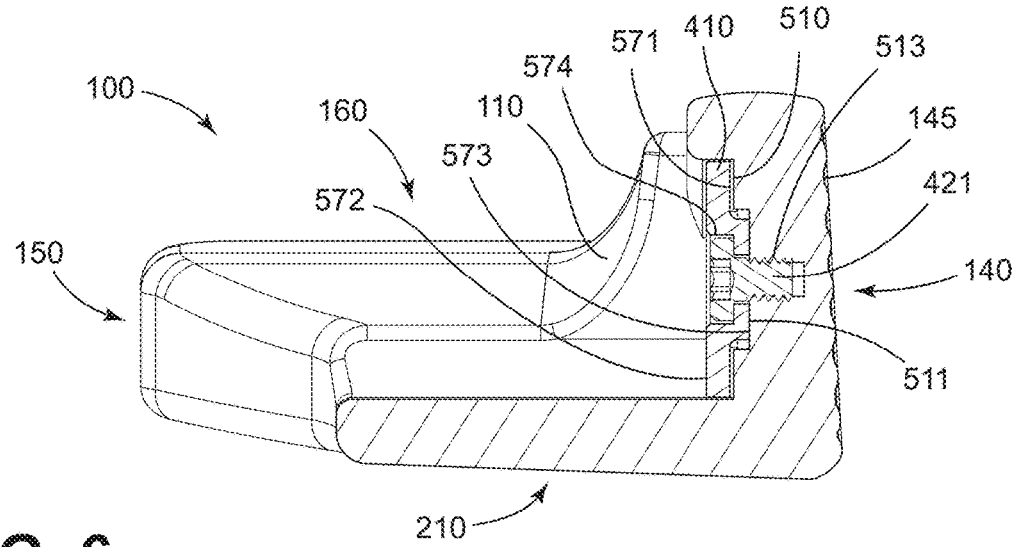

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. patents and patent applications, which are collectively referred to herein as "the incorporated by reference patent documents," are incorporated by reference herein in their entirety: U.S. Pat. Nos. 9,233,283; 9,387,375; 9,440,124; 9,649,540; 9,895,585; 10,478,680; 10,493,331; 10,576,339; 10,737,153; 10,821,341; 10,960,271; 10,981,038; 11,045,698; 11,298,597; 11,369,849; and 11,517,798; and U.S. Patent Publication Nos. 20180200589 and 20220219054.

In general, golf club heads and methods to manufacture golf club heads are described herein. The apparatus, methods, and articles of manufacture described herein are not limited in this regard.

In the example of FIGS. 1-9, a golf club head 100 is generally shown as a first type of blade putter. The golf club head 100 may include a body portion 110 made from any of the materials described herein or described in any of the incorporated by reference patent documents. The body portion 110 may have a toe portion 120, a heel portion 130 opposite the toe portion 120, a hosel bore 135 located at the heel portion 130, a front portion 140, a face portion 145 located at the front portion 140, a rear portion 150 opposite the front portion 140, a top portion 160, and a sole portion 210 opposite the top portion 160. The body portion 110 may be manufactured via various manufacturing methods and/or processes (e.g., a casting process, a forging process, a milling process, a cutting process, a grinding process, a welding process, a combination thereof, etc.). The body portion 110 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 110 may be partially or entirely made of a non-metal material (e.g., composite, plastic, etc.). The apparatus, methods, and articles of manufacture described herein are not limited in this regard.

The face portion 145 may define a front surface of the body portion 110 for striking a golf ball. The face portion 145 may be generally planar and may have a loft angle greater than or equal to two degrees and less than or equal to four degrees. The sole portion 210 may include a plurality of weight ports (e.g., shown as a toe-side weight port 220 and a heel-side weight port 230) each configured to receive a complementary weight portion (e.g., shown as weight portions 240 and 250). Weight portions 240 and 250 may be configured as interchangeable screws threadedly coupled to the toe-side weight port 220 and the heel-side weight port 230, respectively. Weight portions 240 and 250 may be made from any of the materials described herein and may have similar or different material compositions and/or physical properties (e.g., density, color, texture) with respect to each other and the body portion 110. The hosel bore 135 may be configured to receive a variety of hosel types to accommodate a variety of swing types. The configuration and/or properties of each of the weight ports and the weight portions may be similar in many respects to any of the weight ports and weight portions, respectively, described in any of the incorporated by reference patent documents. The apparatus, methods, and articles of manufacture described herein are not limited in this regard.

The golf club head 100 may include an interior cavity 500 within the body portion 110. The interior cavity 500 may be located between the face portion 145 and a back wall portion 400 disposed opposite the face portion 145. The back wall portion 400 may extend between the toe portion 120 and the heel portion 130 and may include a recessed portion 510 defining an opening 520 that interfaces with the interior cavity 500. The recessed portion 510 may be located adjacent a ledge portion 530 at or proximate the rear portion 150 and extending between a toe-side mass platform 540 and a heel-side mass platform 550. In the example of FIGS. 1-9, the ledge portion 530 may be recessed relative to the toe-side mass platform 540 and the heel-side mass platform 550. The interior cavity 500 may be partially or entirely filled with a filler material 560. The filler material 560 may be any type of polymer material described herein or described in any of the incorporated by reference patent documents. In one example, the filler material 560 may include a low-density polymer material. In another example, the filler material 560 may be a solid piece manufactured in the shape of the interior cavity 500 so as to be insertable into the interior cavity 500 through the opening 520. In yet another example, the filler material 560 may be an injectable liquid or fluid material provided to the interior cavity 500 via the opening 520 and later hardened at ambient conditions or during a curing process. The golf club head 100 may include a cover portion shown for example as back plate 410 that may be coupled to the body portion 110 to close the opening 520 and to enclose the interior cavity 500. The apparatus, methods, and articles of manufacture described herein are not limited in this regard.

The back plate 410 may have a complementary shape to the recessed portion 510. The back plate 410 may include a front surface 571, a rear surface 572, and a stiffening member 573. In one example, as illustrated in FIGS. 1-9, the stiffening member 573 may be configured as an elongated rib or protrusion extending longitudinally across the front surface 571 of the back plate 410. The back plate 410 may be joined to the body portion 110 such that the front surface 571 of the back plate 410 contacts the recessed portion 510 and the end portions of the stiffening member 573 are each received in a complementary indent (e.g., shown as indents 511 and 512) in the recessed portion 510. In the present example, the stiffening member 573 may extend across the opening 520 in a toe-to-heel direction of the golf club head 100. Indents 511 and 512 may each include a fastener port (e.g., shown as fastener ports 513 and 514) concentrically aligned with a complementary through-port (e.g., shown as through-ports 574 and 575) extending through the rear surface 572 and the stiffening member 573 of the back plate 410. The back plate 410 may be attached to the body portion 110 via a first mechanical fastener 421 inserted in through-port 574 and threadedly engaged to fastener port 513 and a second mechanical fastener 422 inserted in through-port 575 and threadedly engaged to fastener port 514. In another example, only an adhesive may be used to join the front surface 571 of the back plate 410 to the recessed portion 510. In yet another example, fasteners and one or more adhesives may be used to join the front surface 571 of the back plate 410 to the recessed portion 510. In operation, the stiffening member 573 may impart structural rigidity to the back plate 410 and may also compress the filler material 560 against a rear surface 590 of the face portion 145. The back plate 410 may be made from any of the materials described herein or described in any of the incorporated by reference patent documents. The apparatus, methods, and articles of manufacture described herein are not limited in this regard.

The filler material 560 may contact and reinforce the rear surface 590 of the face portion 145 to reduce face deformation and also dampen sound and vibration. The filler material 560 may also encase a portion of the stiffening member 573 extending across the opening 520 to help maintain the back plate 410 in place. The rear surface 590 of the face portion 145 may include a rear surface of a central strike portion 700 of the face portion 145. The central strike portion 700 may correspond to a portion of the face portion 145 bisected by a center longitudinal plane 900 of the golf club head 100 and may extend a length 910 between the toe portion 120 and the heel portion 130. In one example, the length 910 of the central strike portion 700 may be greater than or equal to 1.00 inch (25.4 mm). In another example, the length 910 of the central strike portion 700 may be greater than or equal to 1.20 inches (30.48 mm). In yet another example, the length 910 of the central strike portion 700 may be greater than or equal to 1.40 inches (35.56 mm). The apparatus, methods, and articles of manufacture described herein are not limited in this regard.

Figure 7:
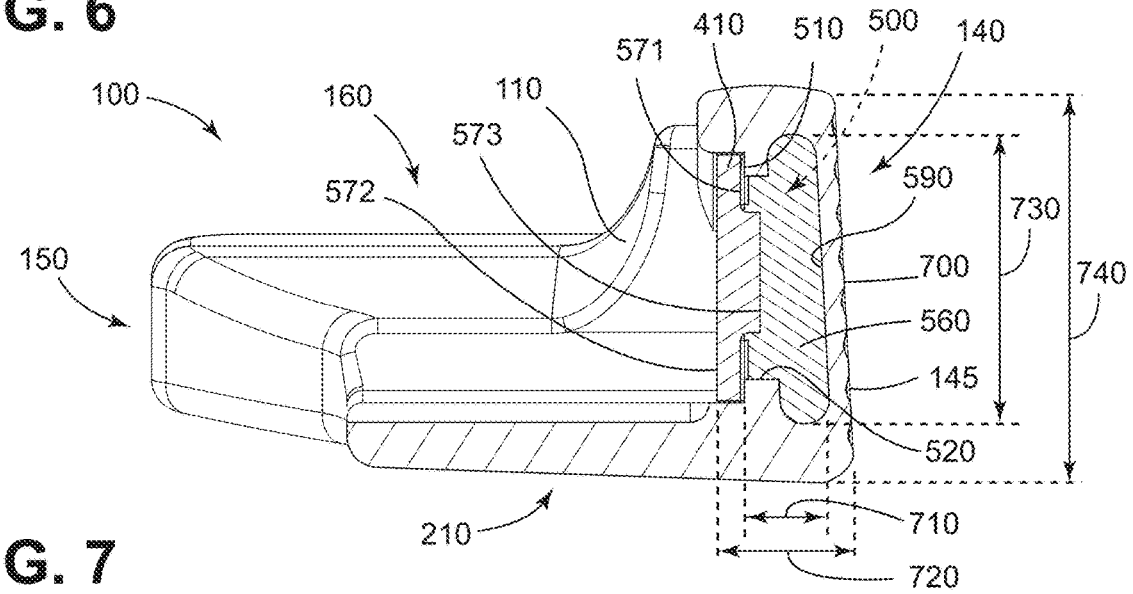
Figure 8:
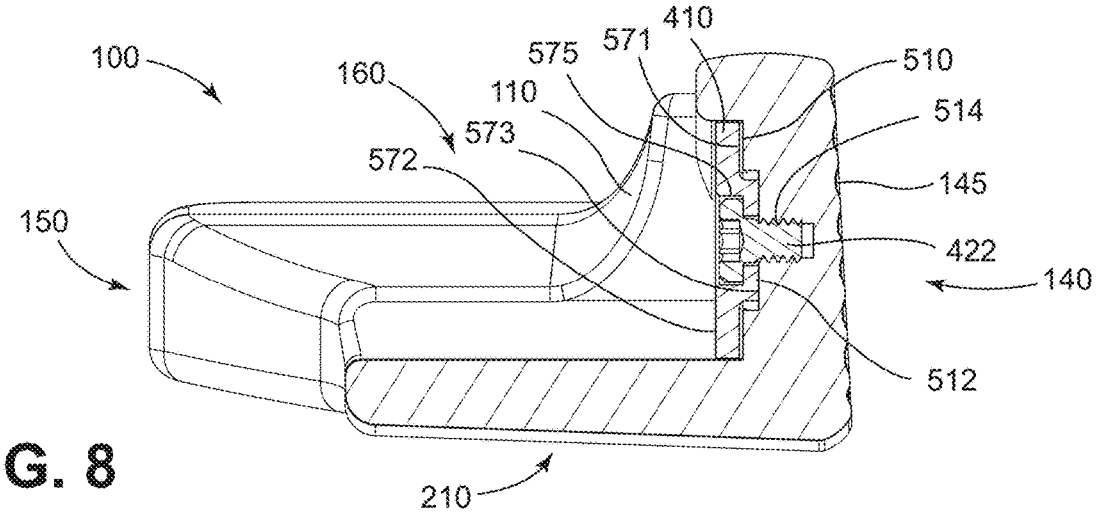
Figure 9:
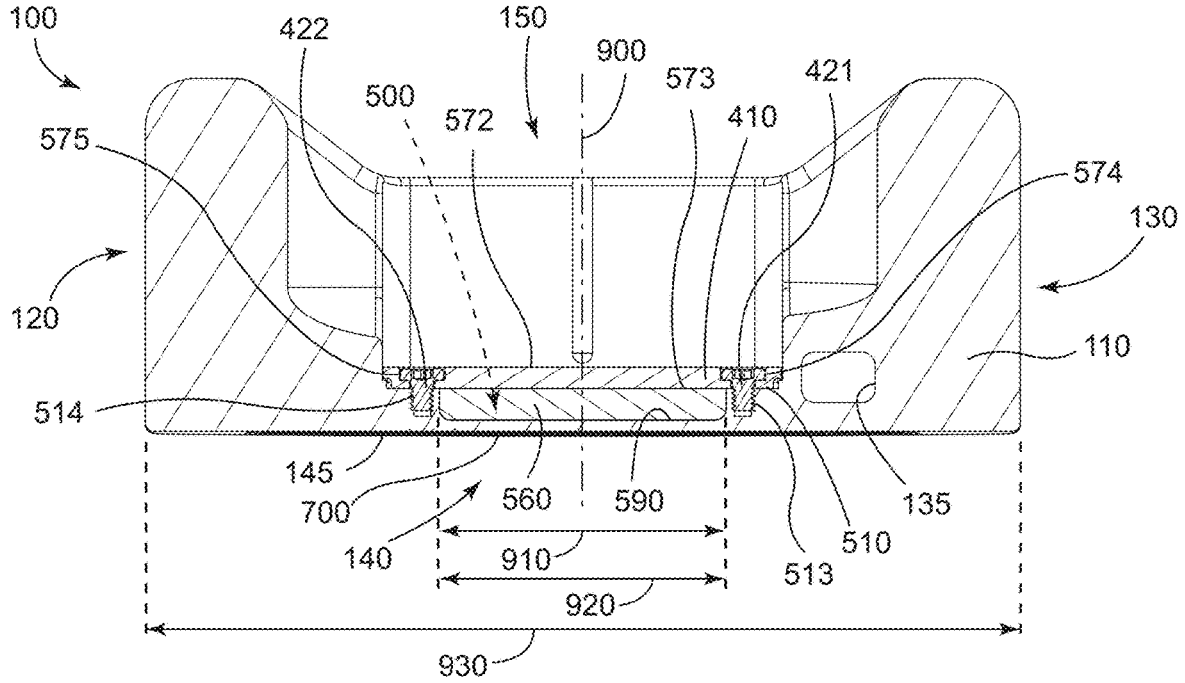

In one example, as illustrated in FIG. 7, the golf club head 100 may have at least one cross-section where the filler material 560 has a length 710 in a front-to-rear direction greater than or equal to 40% of a length 720 between the front surface of the face portion 145 and the rear surface 572 of the back plate 410. With continued reference to FIG. 7, the golf club head 100 may have at least one cross-section where the filler material 560 has a length 730 in a top-to-sole direction greater than or equal to 70% of a length 740 of the body portion 110 in the top-to-sole direction. With reference to FIG. 9, the golf club head 100 may have at least one cross-section where the filler material 560 has a length 920 in a toe-to-heel direction greater than or equal to the length 910 of the central strike portion 700 and/or greater than or equal to 30% of a length 930 of the body portion 110 in the toe-to-heel direction. The apparatus, methods, and articles of manufacture described herein are not limited in this regard.

The filler material 560 may have a density less than a density of the body portion 110 so that more discretionary mass may be allocated to other areas of the golf club head 100. With respect to the present example, the filler material 560 may have a fill volume ($V_f$) greater than or equal to 6% of a total volume ($V_t$) of the golf club head 100 and a fill mass ($M_f$) less than or equal to 1% of a total mass ($M_t$) of the golf club head 100. In one example, the total volume ($V_t$)

of the golf club head 100 may be greater than or equal to 2.50 $inch^3$ (40.968 $cm^3$) and less than or equal to 3.00 $inch^3$ (49.161 $cm^3$) and the total mass ($V_t$) of the golf club head 100 may be greater than or equal to 300 grams and less than or equal to 345 grams. Selecting the filler material 560 from a lightweight or low density material and increasing the fill volume ($V_f$) of the filler material 560 relative to the total volume ($V_t$) of the golf club head 100 may enable greater discretionary mass placement toward a periphery of the golf club head 100 to optimize certain mass properties of the golf club head 100 such as moment of inertia (MOI), center of gravity (CG) location, and mass balance while maintaining a suitable club head weight. With respect to any of the examples described herein, a periphery of a golf club head may include the perimeter portions of the toe portion, the heel portion, and the rear portion, respectively. As defined herein, a ratio between a percentage fill volume $$\left(\frac{Vf}{Vt} \times 100\right)$$

and a percentage fill $$\left(\frac{Mf}{\mathrm{Mt}} \times 100\right)$$

of a filler material may be indicative of the level of freedom in which discretionary mass may be distributed to other areas of a golf club head. Said differently, the ratio between a percentage fill volume and a percentage fill mass of a filler material may correspond to the percentage fill volume divided by the percentage fill mass and a larger ratio value may signify a greater degree of freedom in discretionary mass placement. In one example, the filler material 560 may have a ratio between a percentage fill volume and a percentage fill mass of a filler material that may be greater than or equal to 6 and the golf club head 100 may have a MOI greater than or equal to 4500 $g \cdot cm^2$. In another example, the golf club head 100 may have a MOI greater than or equal to 4700 $g \cdot cm^2$. In yet another example, the golf club head 100 may have a MOI greater than or equal to 5000 $g \cdot cm^2$. The apparatus, methods, and articles of manufacture described herein are not limited in this regard.

Figure 10:
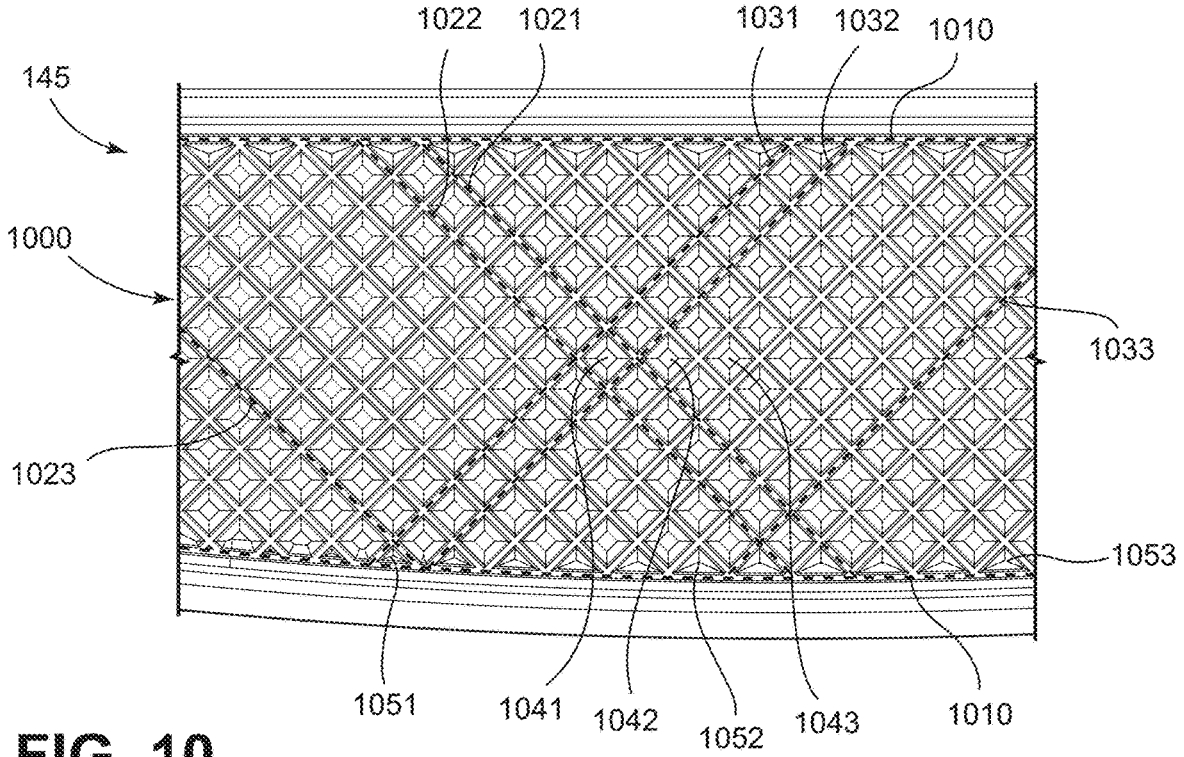
FIG. 10 depicts an enlarged schematic front view of a face portion of the golf club head of FIGS. 1-9 according to an embodiment of the apparatus, methods, and articles of manufacture described herein.

The golf club head 100 may have thin cavity walls to provide additional discretionary mass to be allocated to other areas of the golf club head 100 compared to conventional solid-body golf club heads. For example, one or more cavity walls may have a thickness (constant or average) less than or equal to 0.060 inch (1.524 mm). In particular, the face portion 145 may define a thin front cavity wall reinforced by the filler material 560. Accordingly, the structural support provided by the filler material 560 may allow for having relatively thinner face portion and cavity walls. With reference to FIG. 10, the face portion 145 may include a plurality of grooves 1000 defined by a perimeter groove 1010, a first plurality of grooves (e.g., shown as grooves 1021, 1022, and 1023), and a second plurality of grooves (e.g., shown as grooves 1031, 1032, and 1033). In the example of FIG. 10, dashed lines have been overlaid onto the perimeter groove 1010 and the example grooves for ease of reference and purposes of understanding. In the illustrated example, the perimeter groove 1010 may define a boundary enclosing the first plurality of grooves and the second plurality of grooves. The first plurality of grooves may be arranged in parallel with one another and may extend in a first diagonal direction across face portion 145 within the boundary set by the perimeter groove 1010. The second plurality of grooves may be arranged in parallel with one another and may extend in a second diagonal direction within the boundary set by the perimeter groove 1010. Each groove of the first plurality of grooves and the second plurality of grooves may terminate at the perimeter groove 1010. In other words, the first plurality of grooves and the second plurality of grooves may be joined to the perimeter groove 1010 at their terminal ends. In one example, the first plurality of grooves may be transverse to the second plurality of grooves. Accordingly, the first plurality of grooves may intersect with the second plurality of grooves at right angles. The apparatus, methods, and articles of manufacture described herein are not limited in this regard.

With continued reference to FIG. 10, the plurality of grooves 1000 may define a first plurality of projections (e.g., shown as projections 1041, 1042, and 1043) and a second plurality of projections (e.g., shown as projections 1051, 1052, and 1053). Each projection (e.g., projection 1041) of the first plurality of projections may be disposed inward of the perimeter groove 1010 and may correspond to a raised structure occupying an intersectional space between two adjacent grooves (e.g., grooves 1021 and 1022) of the first plurality of grooves and two adjacent grooves (e.g., grooves 1031 and 1032) of the second plurality of grooves. In other words, each projection of the first plurality of projections may be bounded by two adjacent grooves of the first plurality of grooves and two adjacent grooves of the second plurality of grooves intersecting the two adjacent grooves of the first plurality of grooves. In one example, each projection of the first plurality of projections may have a frusto-pyramidal shape with a flat peak surface for striking a golf ball. Each projection (e.g., projection 1051) of the second plurality of projections may be disposed adjacent the perimeter groove 1010 and may correspond to a raised structure occupying an intersectional space between the perimeter groove 1010, at least one groove (e.g., groove 1023) of the first plurality of grooves, and at least one groove (e.g., groove 1031) of the second plurality of grooves. In other words, each projection of the second plurality of projections may be bounded by the perimeter groove 1010, at least one groove of the first plurality of grooves, and at least one groove of the second plurality of grooves intersecting the at least one groove of the first plurality of grooves. Each projection of the second plurality of projections may have a variety of shapes based on the intersectional relationship between the perimeter groove 1010, the first plurality of grooves, and the second plurality of grooves. In one example, each projection of the second plurality of projections may correspond to a partial segment of a projection of the first plurality of projections. While the examples and figures described herein may describe and depict a face portion having particular projections, the apparatus, methods, and articles of manufacture described herein may include projections of other suitable shapes, size, position, etc. For example, the face portion 145 may include at two projections with different shape or size. Alternatively, the face portion 145 may not include a projection. In one example, the face portion 145 may include one or more horizontal grooves extending between the toe portion 120 and the heel portion 130. In another one example, the face portion 145 may include a smooth flat surface or a smooth contoured surface. The apparatus, methods, and articles of manufacture described herein are not limited in this regard.

Figure 11:
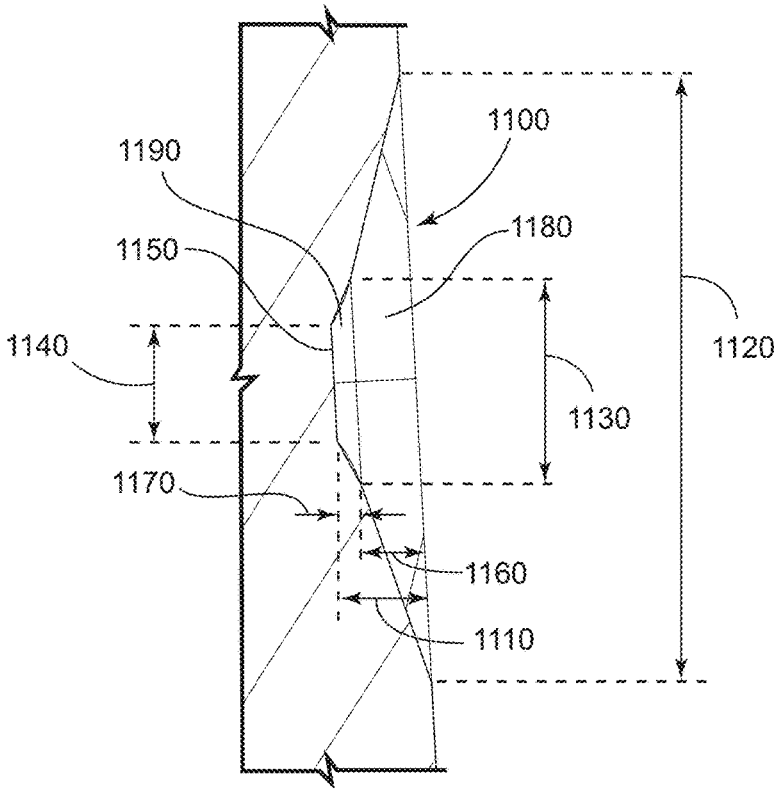
FIG. 11 depicts a schematic cross-sectional view of a representative groove of the face portion of FIG. 10 according to an embodiment of the apparatus, methods, and articles of manufacture described herein.

The first plurality of grooves and the second plurality of grooves may have similar groove properties (e.g., width and depth) and may be evenly spaced apart such that the first plurality of projections are the same size and shape. For purposes of understanding, an example groove 1100 is shown in FIG. 11 and may be representative of any groove of the first plurality of grooves and the second plurality of grooves. In the present example, the groove 1100 may have a depth 1110 greater than or equal to 0.010 inch (0.254 mm) and a variable width that decreases at a first rate from an upper width 1120 at the top of the groove 1100 to an intermediate width 1130 and decreases at a second rate from the intermediate width 1130 to a lower width 1140 at a base 1150 of the groove 1100. In one example, the upper width 1120 may be less than or equal to 0.060 inch (1.524 mm), the intermediate width 1130 may be less than or equal to 0.020 inch (0.508 mm), and the lower width may be less than or equal to 0.012 inch (0.3048 mm). Additionally, a rate of decrease from the upper width 1120 to the intermediate width 1130 may occur linearly over a depth 1160 greater than or equal to 0.007 inch (0.1778 mm) and a rate of decrease from the intermediate width 1130 to the lower width 1140 may occur non-linearly over a depth 1170 greater than or equal 0.003 inch (0.0762 mm). In the example of FIG. 11, the groove 1100 may be characterized as having an upper cross-section 1180 with an inverted frustoconical shape and a lower cross-section 1190 with an inverted truncated funnel shape. The apparatus, methods, and articles of manufacture described herein are not limited in this regard.

Figure 12:
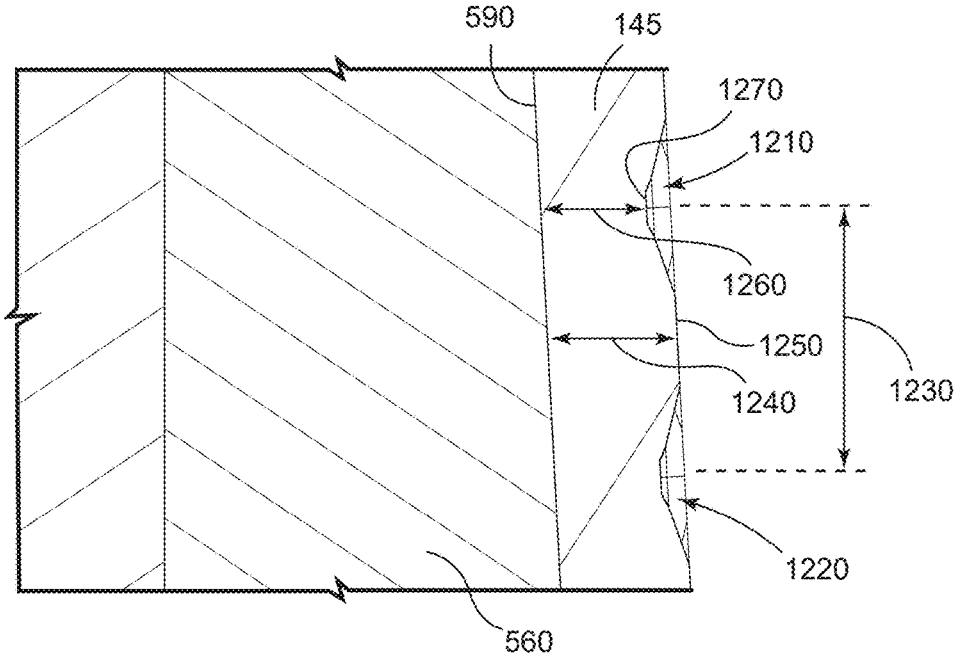
FIG. 12 depicts a schematic cross-sectional view of two representative grooves of the face portion of FIG. 10 according to an embodiment of the apparatus, methods, and articles of manufacture described herein.

Referring to FIG. 12, two adjacent grooves are shown as grooves 1210 and 1220 and may be representative of any two adjacent grooves of the first plurality of grooves or any two adjacent grooves of the second plurality of grooves. In the present example, a centerline spacing 1230 between grooves 1210 and 1220 may be greater than or equal to 0.060 inch (1.524 mm) and less than or equal to 0.100 inch (2.54 mm). In the present example, the face portion 145 may have a first face thickness 1240 less than or equal to 0.055 inch (1.397 mm). The first face thickness 1240 may correspond to a distance between the rear surface 590 of the face portion 145 and a strike surface 1250 of the face portion 145, which may include the flat peak surfaces of the first plurality of projections. In one example, the flat peak surfaces of the first plurality of projections may be coplanar. The face portion 145 may also have a second face thickness 1260 less than or equal to 0.045 inch (1.143 mm). The second face thickness 1260 may correspond to a distance between the rear surface 590 of the face portion 145 and a base (e.g., shown as base 1270) of a groove (e.g., groove 1210). In one example, the bases of the first plurality of grooves and the second plurality of grooves may be coplanar. The face portion 145 incorporating the plurality of grooves 1000 described herein may cooperate with the filler material 560 to provide enhanced performance properties such as consistent roll distance and improved feel and sound. The configurations and properties of the face portion and the plurality of grooves may be similar in many respects to the face portion and the plurality of the grooves described in U.S. Pat. Nos. 10,737,153 and 10,981,038, which are incorporated by reference herein. The apparatus, methods, and articles of manufacture described herein are not limited in this regard.

The mass properties of the golf club head 100 may be adjusted using a weighting system that may utilize a plurality of weight ports (e.g., toe-side weight port 220 and heel-side weight port 230) and corresponding interchangeable weight portions (e.g., weight portions 240 and 250). In one example, weight portions 240 and 250 may have the same mass and coupled the toe-side weight port 220 and the heel-side weight port 230, respectively, to provide balanced weighting to the golf club head 100. In another example, weight portion 240 may have a greater mass than weight portion 250, and weight portions 240 and 250 may be coupled the toe-side weight port 220 and the heel-side weight port 230, respectively, to counteract an individual's tendency to pull putts by restricting club head rotation and face closure during a putting stroke. In yet another example, weight portion 240 may have a lower mass than weight portion 250, and weight portions 240 and 250 may be coupled the toe-side weight port 220 and the heel-side weight port 230, respectively, to counteract an individual's tendency to push putts by promoting club head rotation and face closure during a putting stroke. The apparatus, methods, and articles of manufacture described herein are not limited in this regard.

Figure 13:
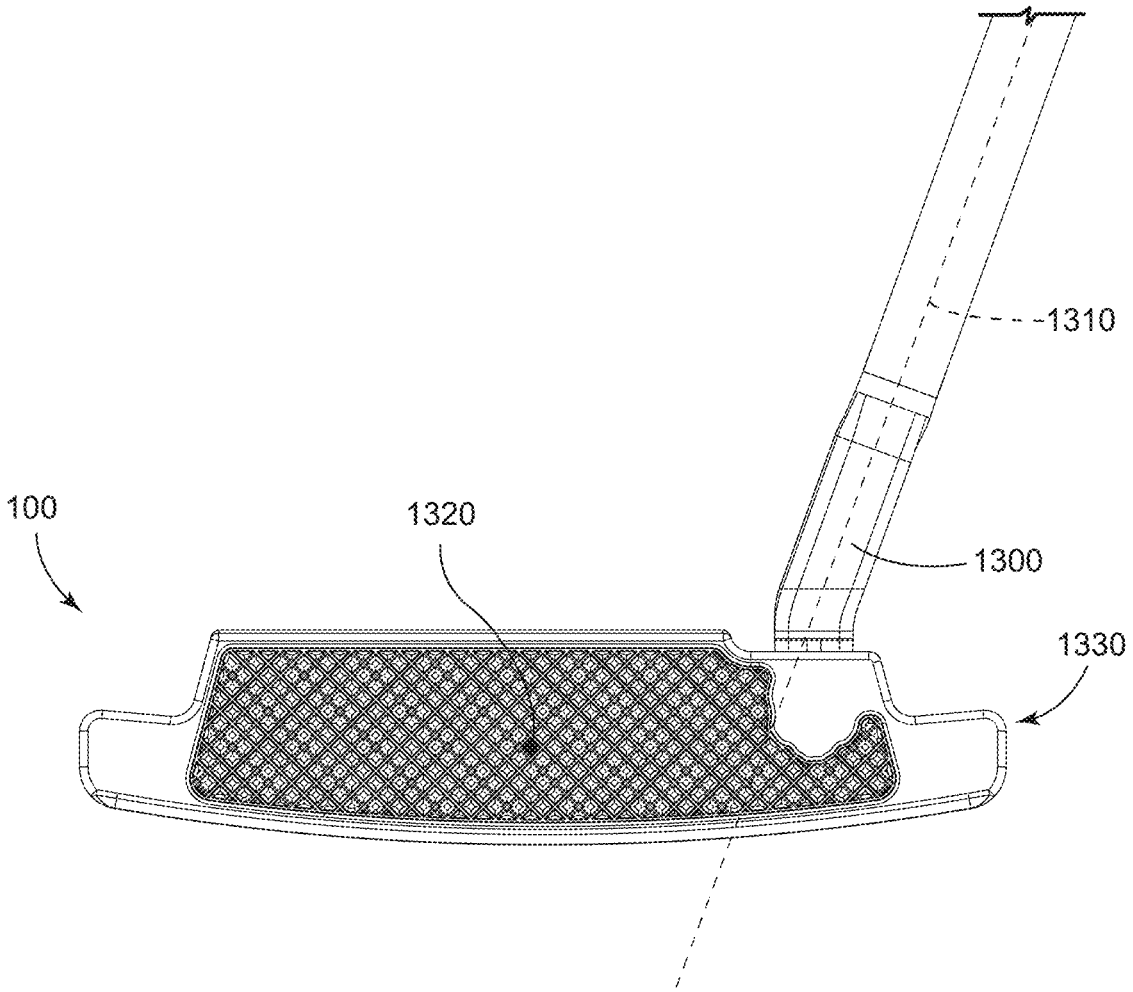
FIGS. 13, 14, and 15 depict a front elevational view of the golf club head of FIGS. 1-9 assembled to a heel-shafted hosel type, a double bend hosel type, and a plumber's neck hosel type, respectively, according to an embodiment of the apparatus, methods, and articles of manufacture described herein.
Figure 14:
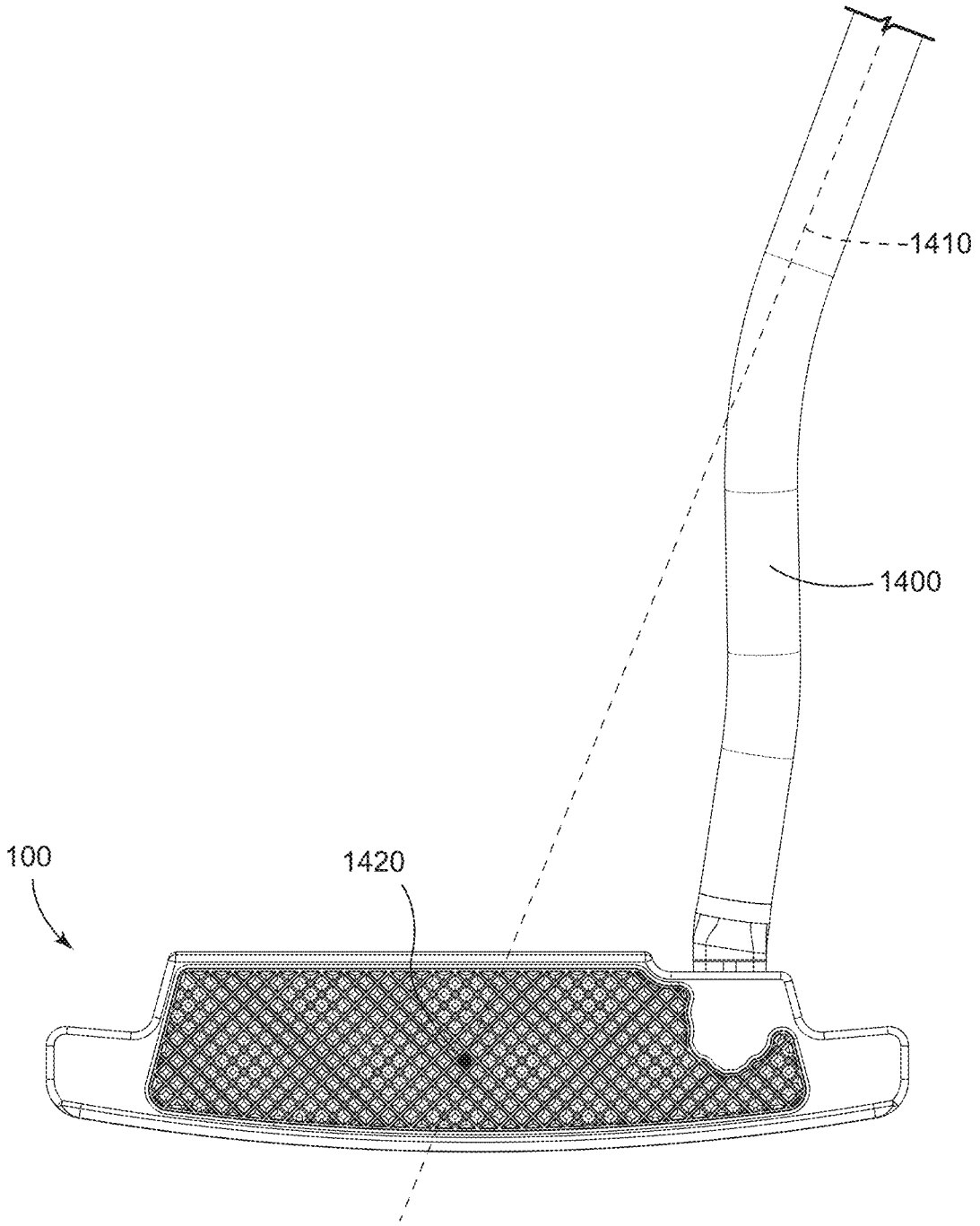
Figure 15:
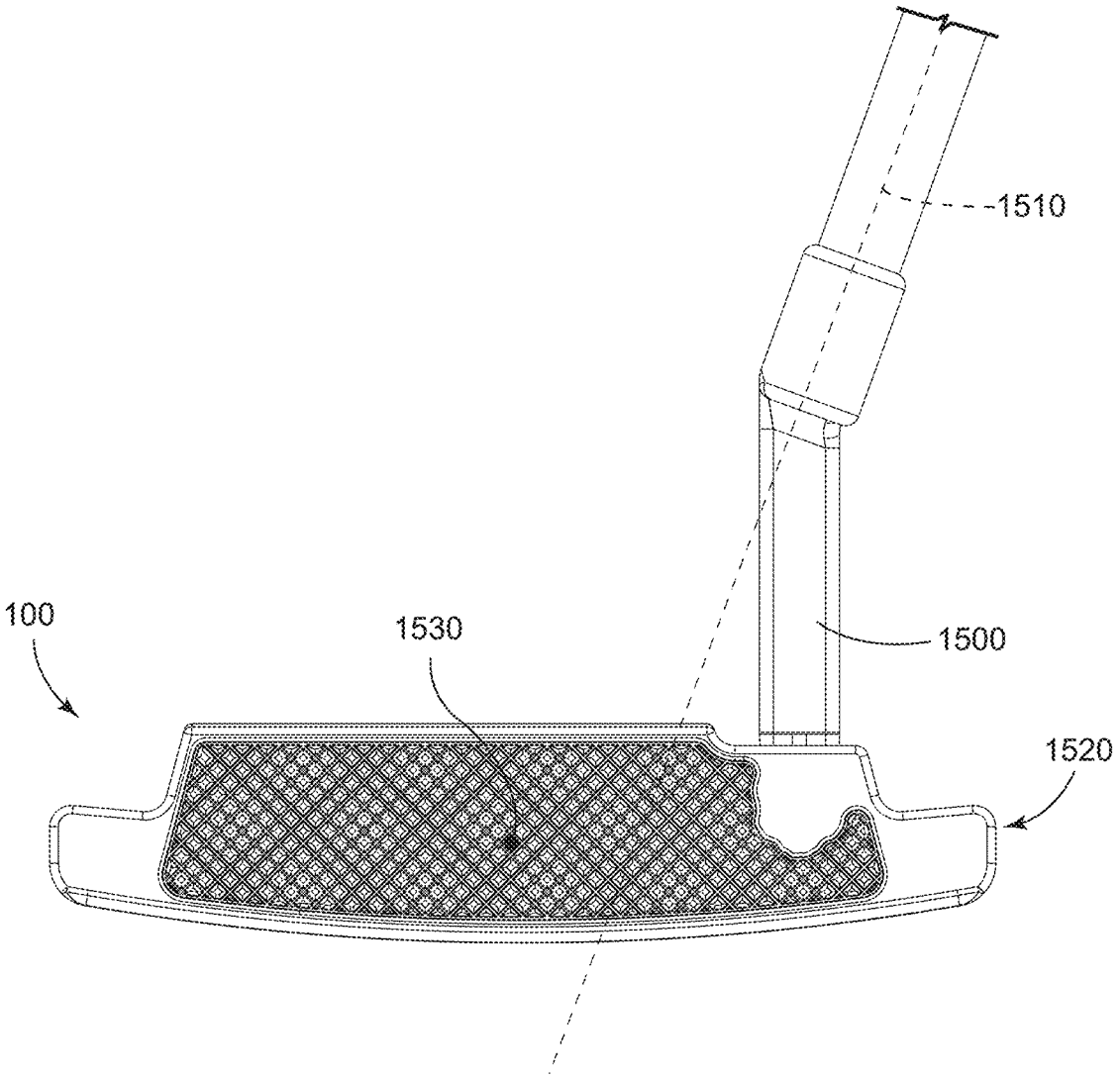
Figure 16:
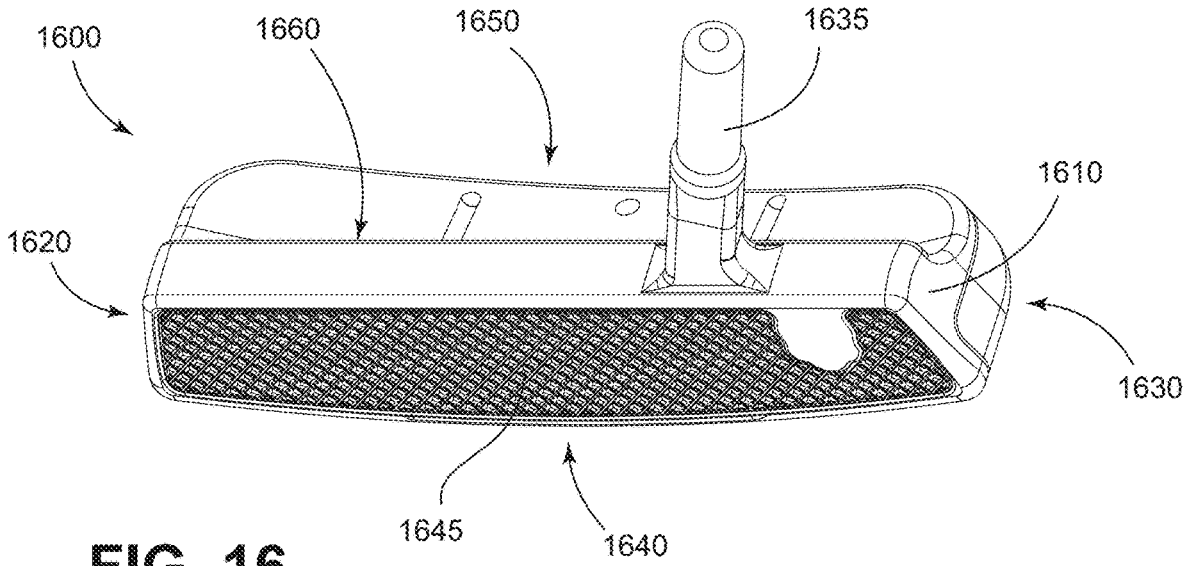
FIGS. 16, 17, 18, 19, 20, 21, 22, 23, and 24 depict a perspective front view, a perspective bottom view, a front elevational view, a rear elevational view, an exploded bottom perspective view, a perspective cross-sectional view (along line 21-21 of FIG. 19), a perspective cross-sectional view (along line 22-22 of FIG. 19), a perspective cross-sectional view (along line 23-23 of FIG. 19), and a perspective cross-sectional view (along line 24-24 of FIG. 19), respectively, of a golf club head according to an embodiment of the apparatus, methods, and articles of manufacture described herein.
Figure 17:
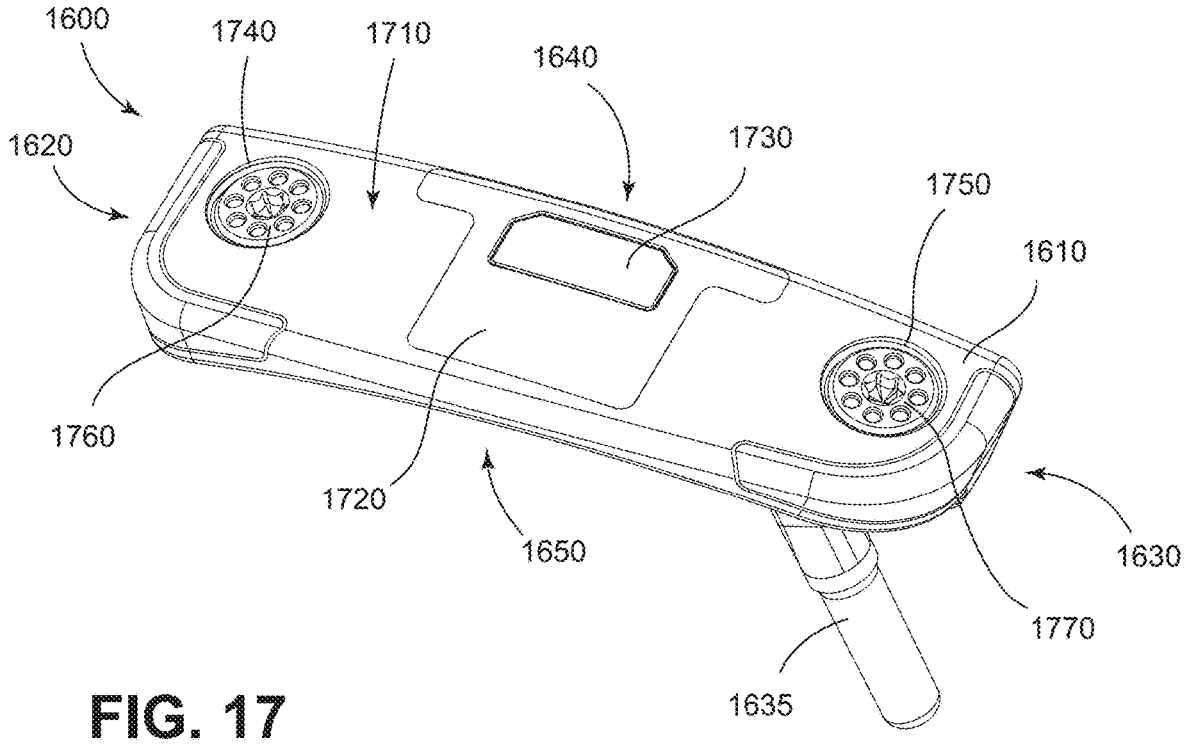
Figure 18:
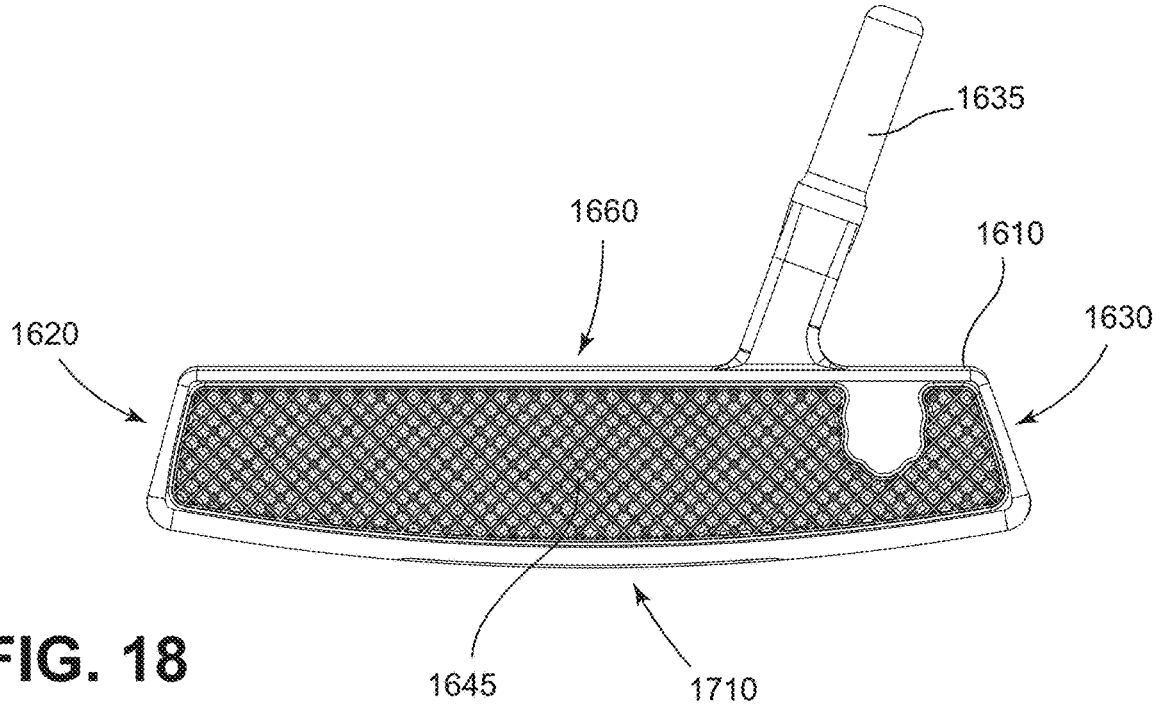
Figure 19:
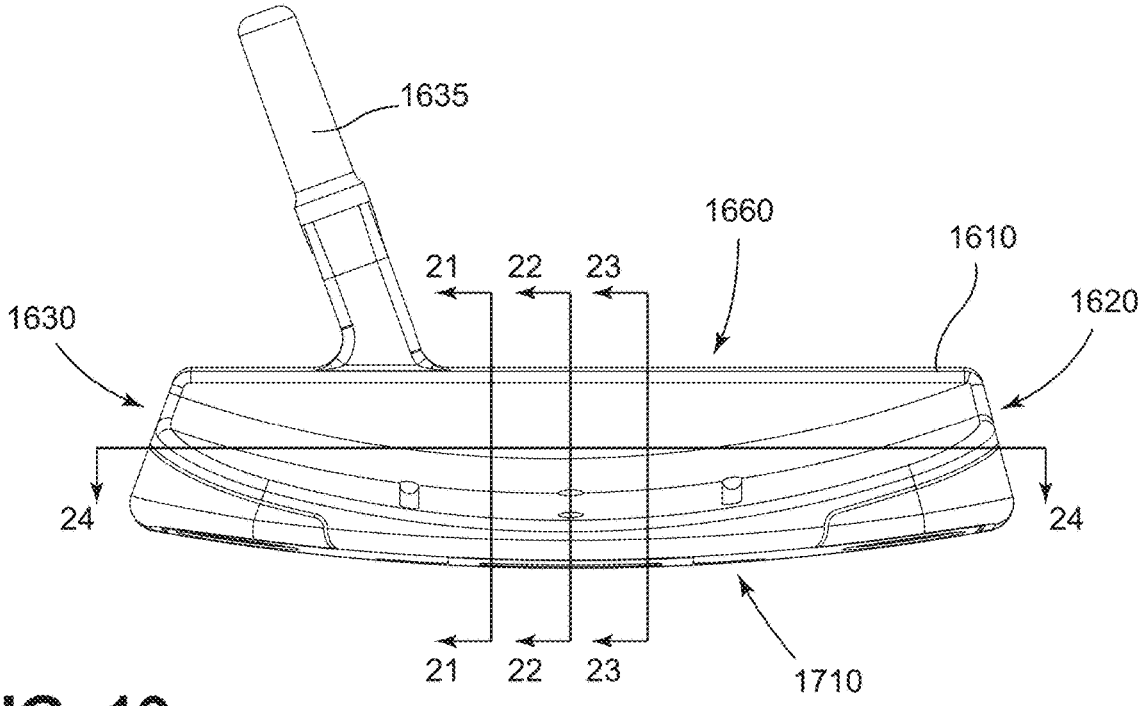
Figure 20:
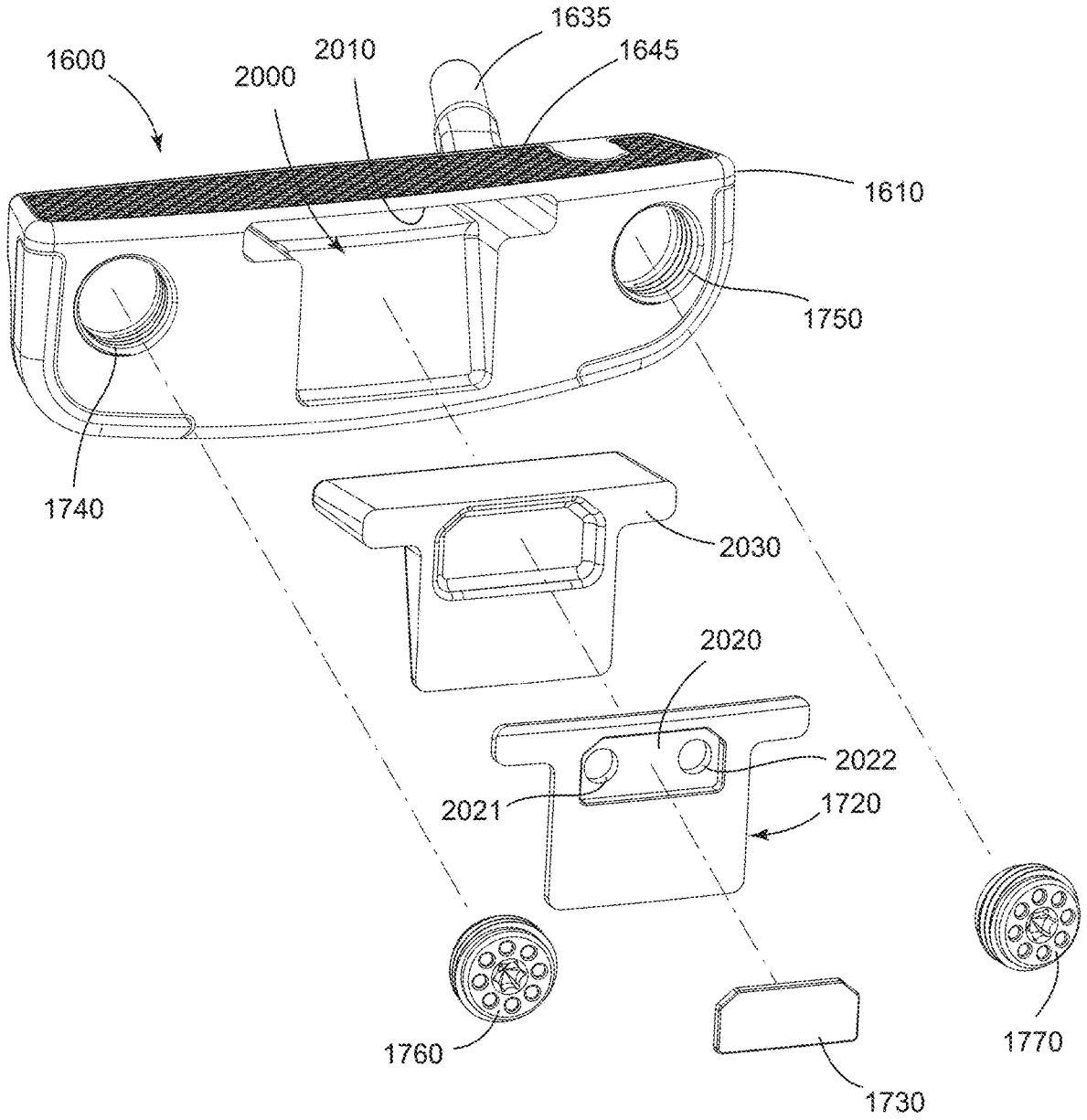
Figure 21:
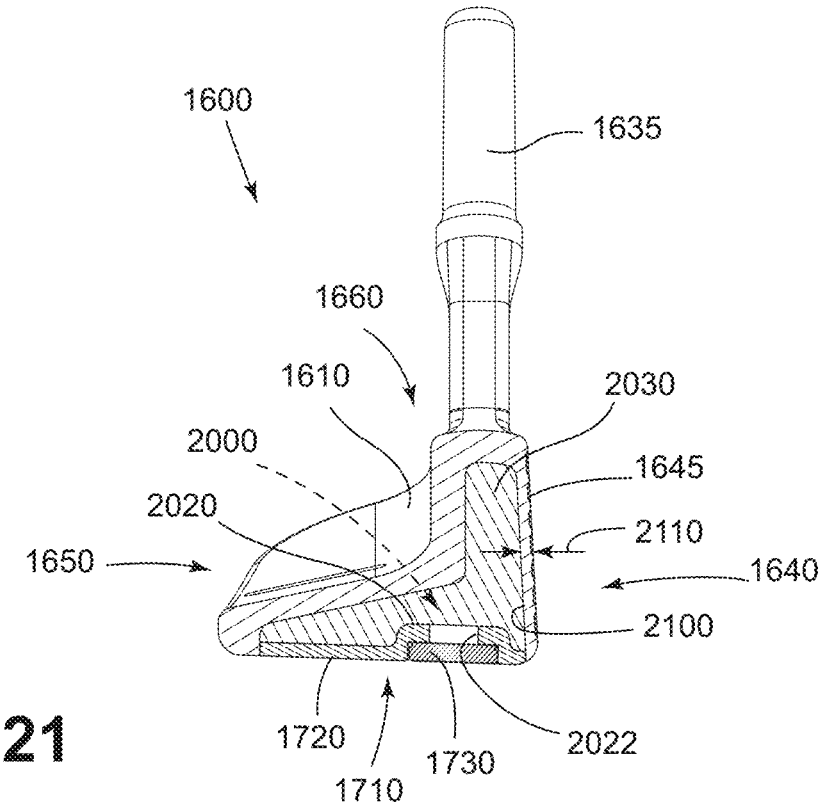

The mass properties of the golf club head 100 may be further adjusted with an interchangeable hosel system that may utilize a hosel bore instead of a fixed hosel (e.g., an integral portion of the body portion 110). Accordingly, the hosel bore 135 may be configured to receive a variety of hosel types to adjust the balance of the golf club head 100. In one example, as shown in FIG. 13, a hosel portion 1300 configured as a heel-shafted hosel type may be coupled to the hosel bore 135 to orient a shaft axis 1310 away from a CG location 1320 and more toward a heel portion 1330 of the golf club head 100 to increase the inertial force required to rotate the golf club head 100 during a putting stroke. A heel-shafted hosel may produce a large degree of toe hang (e.g., greater than 45 degrees) and may be preferred by individuals that tend to over-rotate the golf club head 100, thereby producing a closed face at impact. In another example, as shown in FIG. 14, a hosel portion 1400 configured as a double bend hosel type may be coupled to the hosel bore 135 to orient a shaft axis 1410 through a CG location 1420 to moderately reduce the inertial force required to rotate the golf club head 100 during a putting stroke. Alternatively, an armlock hosel type (not shown) may be used to accomplish the same. A double bend hosel type or armlock hosel type may promote face balancing and may be preferred by individuals that tend to under-rotate the golf club head 100 thereby producing an open face at impact. In yet another example, as shown in FIG. 15, a hosel portion 1500 configured as a plumber's neck hosel type may be coupled to the golf club head 100 to orient a shaft axis 1510 away from a heel portion 1520 and closer to a CG location 1530 of the golf club head 100 to significantly reduce the inertial force required to rotate the golf club head 100 during a putting stroke. A plumber's neck hosel type may produce a moderate degree of toe hang (e.g., less than or equal to 45 degrees) and may be preferred by individuals exhibiting mild levels of club head rotation. By employing one or both of the weighting system and the interchangeable hosel system described herein, the mass properties of the golf club head 100 may be adjusted to fit the needs of any individual regardless of putting style or swing tendencies while providing greater forgiveness due to the golf club head 100 benefitting from higher MOI compared to conventional solid-body golf club heads. While the examples and figures may describe and depict a hosel bore and a separate hosel portion, the apparatus, methods, and articles of manufacture described herein may include a hosel portion integral to the body portion. The apparatus, methods, and articles of manufacture described herein are not limited in this regard.

In the example of FIGS. 16-24, a golf club head 1600 is generally shown as a second type of blade putter. The golf club head 1600 may include a body portion 1610 having a toe portion 1620, a heel portion 1630 with an integrated hosel portion 1635, a front portion 1640, a face portion 1645 located at the front portion 1640, a rear portion 1650, a top portion 1660, and a sole portion 1710. The body portion 1610 may be made from any of the materials described herein or described in and of the incorporated by reference patent documents. The body portion 1610 may define an interior cavity 2000 that interfaces with an opening 2010 at the sole portion 1710. A sole plate 1720 may be coupled to the body portion 1610 to close the opening 2010. The sole plate 1720 may be made from a material similar to or different from a material of the body portion 1610. In one example, the sole plate 1720 may be made from a material having a density less than a density of the body portion 1610 to enable greater discretionary mass placement toward a periphery of the golf club head 1600. In one example, the sole plate 1720 may be welded to the body portion 1610. In another example, the sole plate 1720 may be attached to the body portion 1610 using adhesive and/or mechanical fasteners. The outer surface of the sole plate 1720 may include a central depression 2020, which on the inner surface of the sole plate 1720 may define a raised central portion that may extend into the interior cavity 2000. The central depression 2020 may include a pair of openings (e.g., shown as openings 2021 and 2022) that interface with the interior cavity 2000. The interior cavity 2000 may be partially or entirely filled with a filler material 2030 via one of openings 2021 and 2022 while the other one of openings 2021 and 2022 may expel air and any excess filler material 2030. The filler material 2030 may harden without any curing process or later undergo a curing process to harden. Openings 2021 and 2022 may be closed by a complementary cover portion 1730 received in the central depression 2020 to enclose the interior cavity 2000. In one example, the cover portion 1730 may be configured as a lightweight decorative badge and may be attached to the central depression 2020 using adhesive. The apparatus, methods, and articles of manufacture described herein are not limited in this regard.

The filler material 2030 may include any of the filler materials described herein or described in any of the incorporated by reference patent documents. The filler material 2030 may be disposed within the interior cavity 2000 to contact and reinforce a rear surface 2100 of the face portion 1645 to reduce face deformation and also dampen sound and vibration. Additionally, the filler material 2030 may at least partially encase the central depression 2020 of the sole plate 1720. The filler material 2030 may provide structural support to the cavity walls and/or the face portion 1645 of the golf club head 1600. Accordingly, the cavity walls may be relatively thin to accommodate a greater amount of the filler material 2030 in the interior cavity 2000 and to provide increased discretionary mass, and the face portion 1645 may be relatively thin to provide a greater flexibility or rebounding effect. For example, one or more cavity walls may have a thickness (constant or average) less than or equal to 0.060 inch (1.524 mm). Particularly, the face portion 1645 may have a face thickness 2110 in one or more areas less than or equal to 0.055 inch (1.397 mm) (e.g., first face thickness 1240) and less than or equal to 0.045 inch (1.143 mm) (e.g., second face thickness 1260) as described herein with reference to FIG. 12. The face portion 1645 may be similar in many respects to any face portion (e.g., face portion 145) described herein or described in any of the incorporated by reference documents. The apparatus, methods, and articles of manufacture described herein are not limited in this regard.

Figure 22:
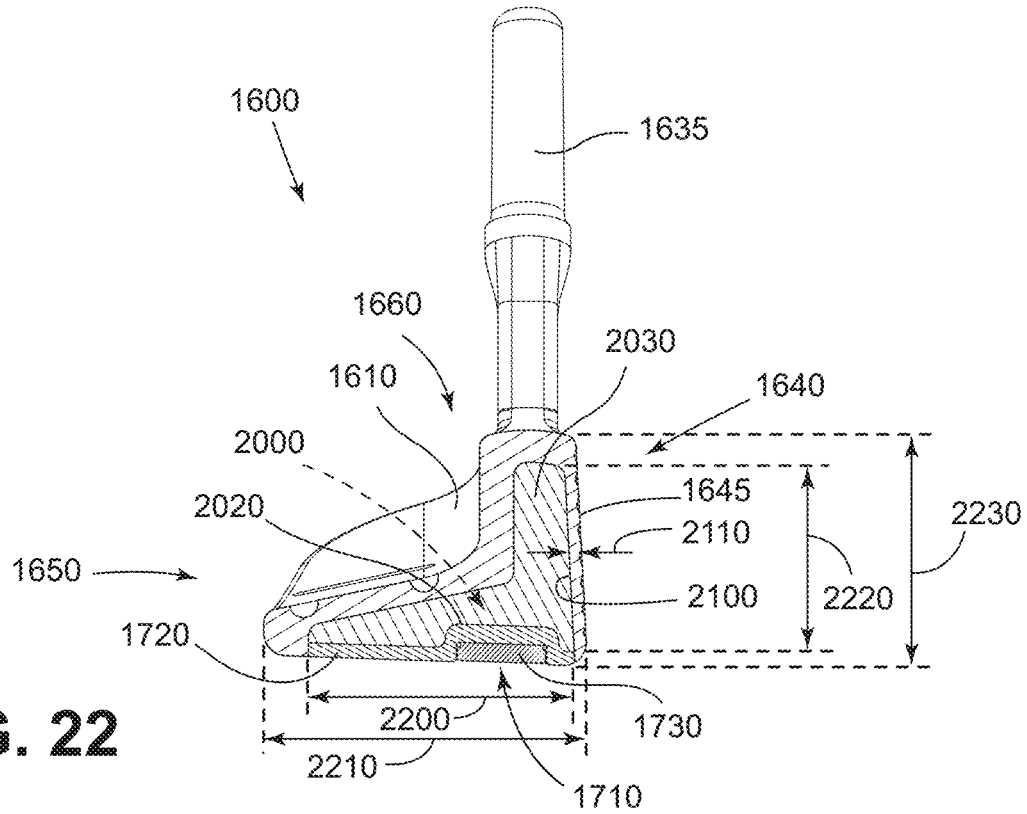
Figure 23:
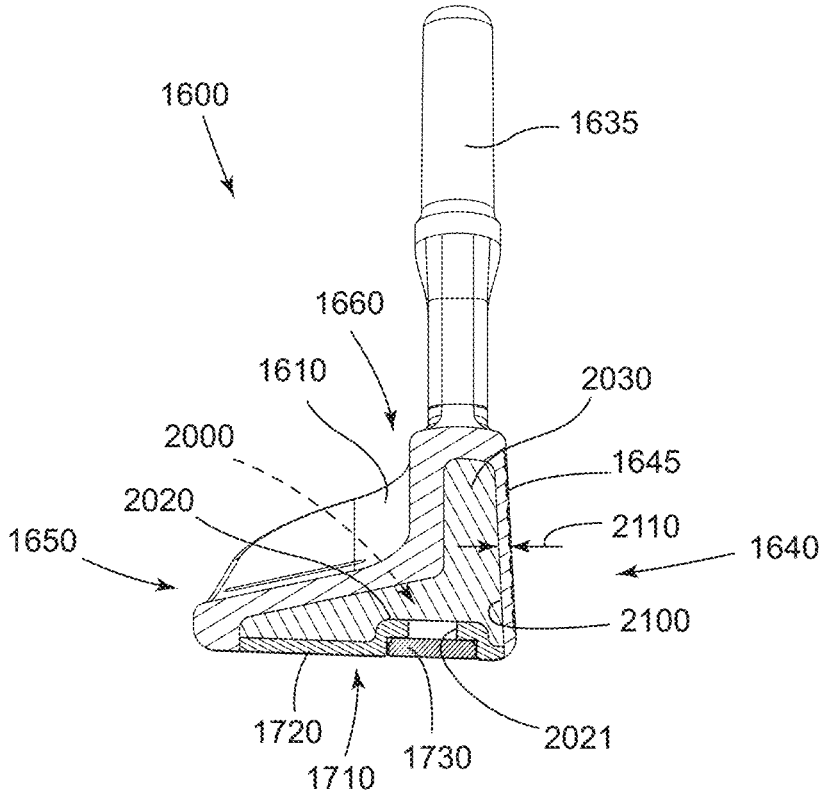
Figure 24:
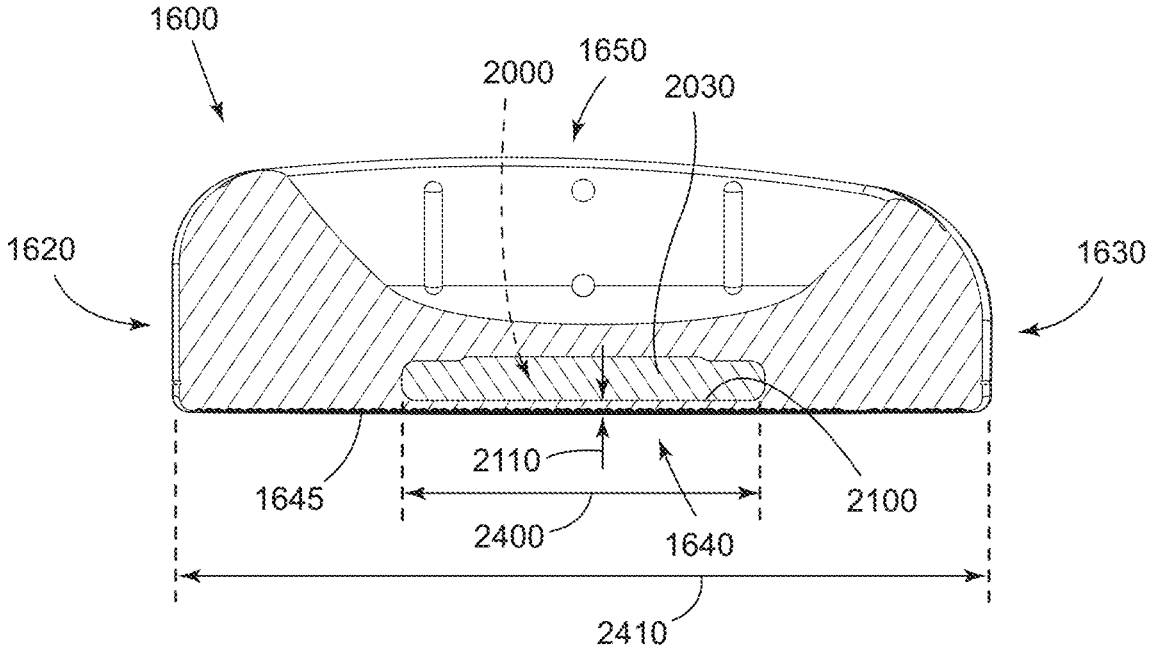
Figure 25:
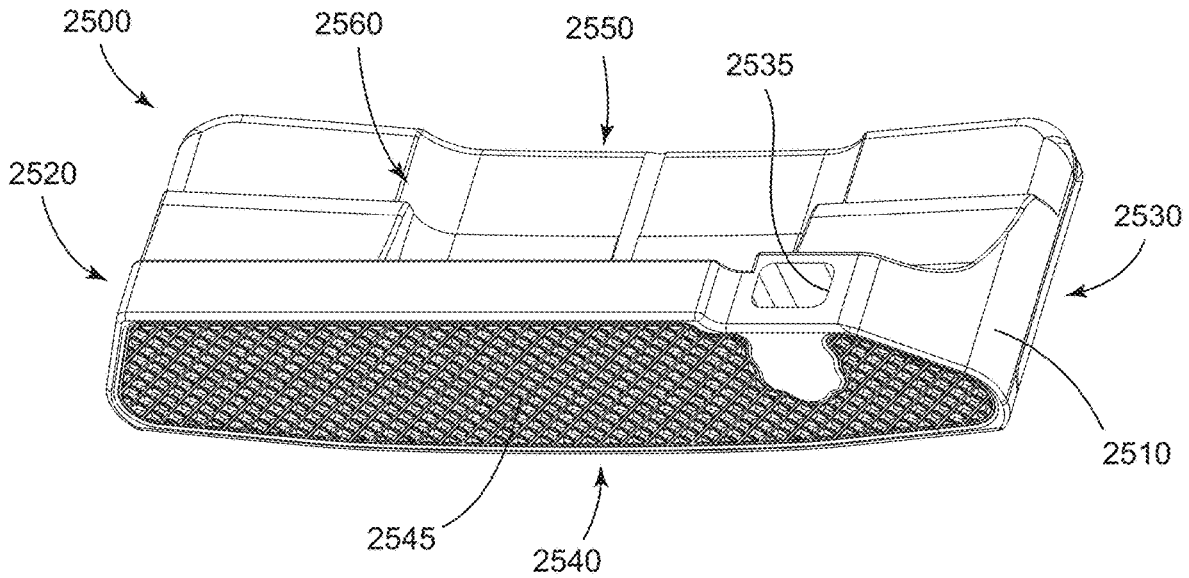
FIGS. 25, 26, 27, 28, 29, 30, 31, 32, and 33 depict a perspective front view, a perspective bottom view, a front elevational view, a rear elevational view, an exploded bottom perspective view, a perspective cross-sectional view (along line 30-30 of FIG. 28), a perspective cross-sectional view (along line 31-31 of FIG. 28), a perspective cross-sectional view (along line 32-32 of FIG. 28), and a perspective cross-sectional view (along line 33-33 of FIG. 28), respectively, of a golf club head according to an embodiment of the apparatus, methods, and articles of manufacture described herein.
Figure 26:
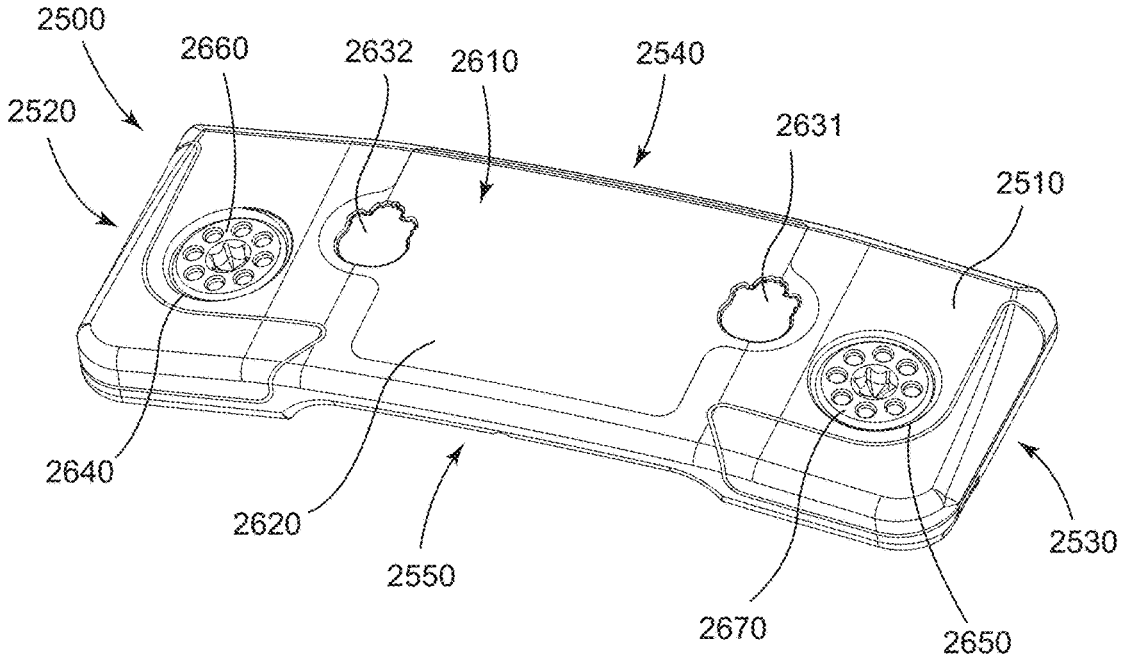
Figure 27:
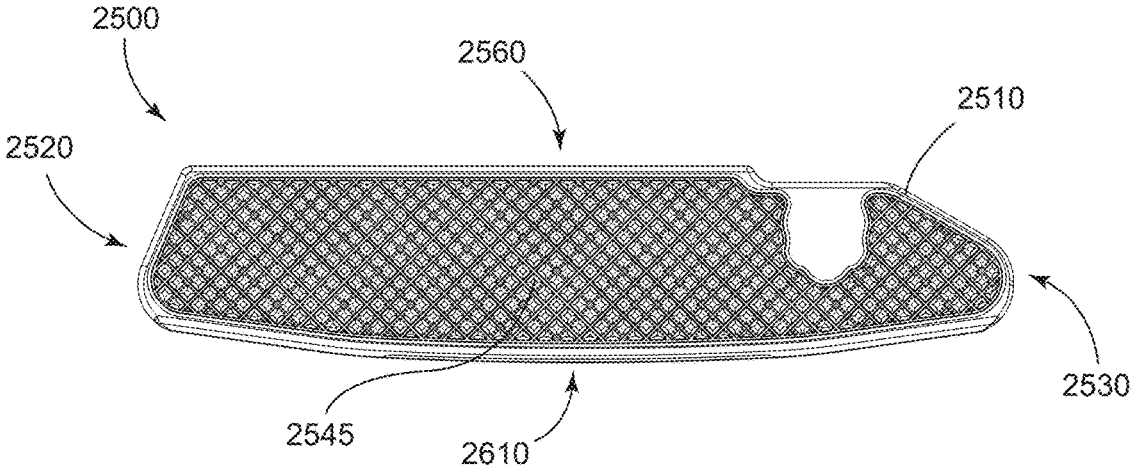
Figure 28:
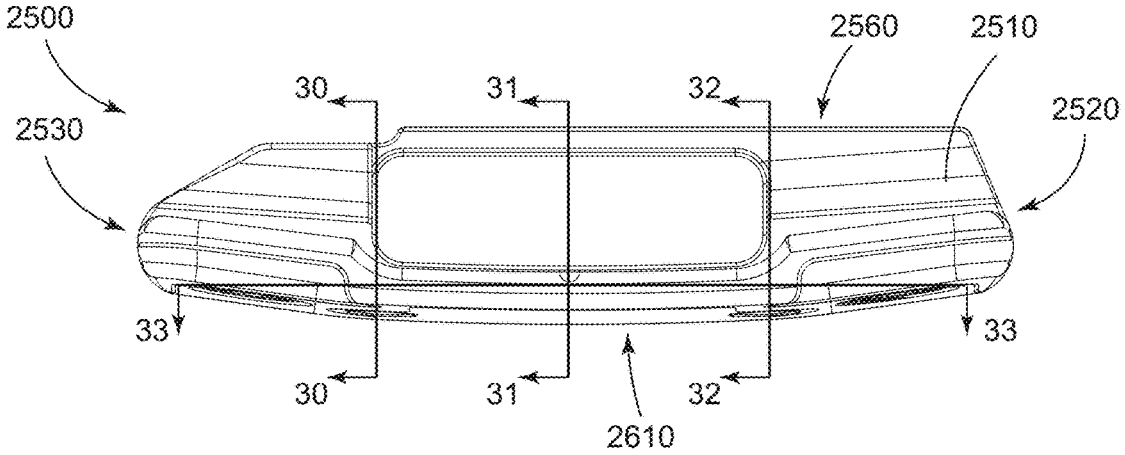
Figure 29:
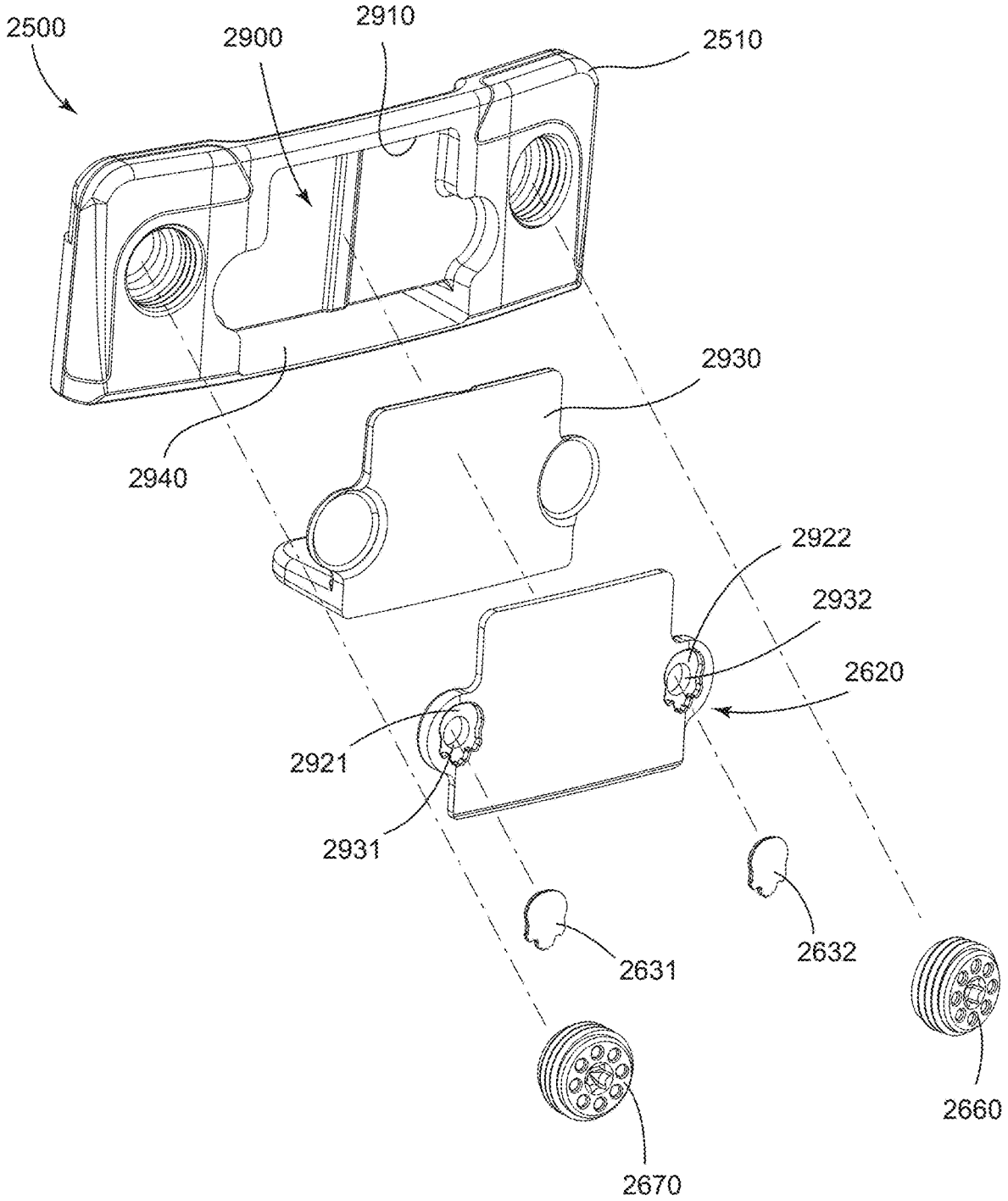
Figure 30:
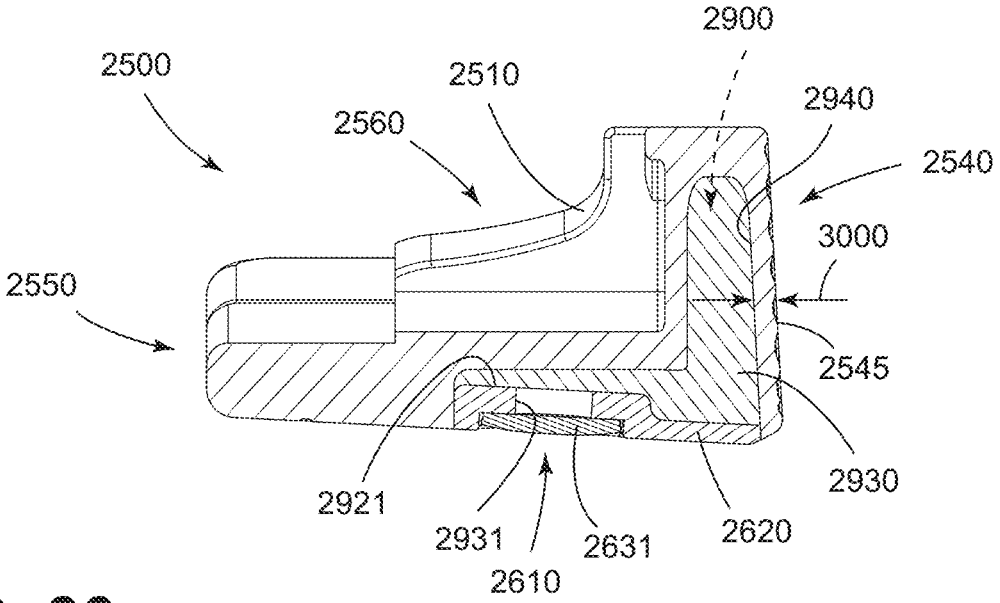

With reference to FIG. 22, the golf club head 1600 may have at least one cross-section where the filler material 2030 has a length 2200 in a front-to-rear direction greater than or equal to 80% of a length 2210 of the body portion 1610 in the front-to-rear direction. With continued reference to FIG. 22, the golf club head 1600 may have at least one cross-section where the filler material 2030 may have a length 2220 in a top-to-sole direction greater than or equal to 80% of a length 2230 of the body portion 1610 in the top-to-sole direction. With reference to FIG. 24, the golf club head 1600 may have at least one cross-section wherein the filler material 2030 has a length 2400 in a toe-to-heel direction greater than or equal to 40% of a length 2410 of the body portion 1610 in the toe-to-heel direction. The apparatus, methods, and articles of manufacture described herein are not limited in this regard.

The filler material 2030 may have a density less than a density of the body portion 1610 to allow for more discretionary mass to be allocated to other areas of the golf club head 100. With respect to the present example, the filler material 2030 may have a fill volume ($V_f$) greater than or equal to 16% of a total volume ($V_t$) of the golf club head 1600 and a fill mass ($M_f$) less than or equal to 3% of a total mass ($M_t$) of the golf club head 1600. In one example, the total volume ($V_t$) of the golf club head 1600 may be greater than or equal to 3.00 inch$^3$ (49.161 cm$^3$) and less than or equal to 3.50 inch$^3$ (57.355 cm$^3$) and the total mass ($M_t$) of the golf club head 1600 may be greater than or equal to 350 grams and less than or equal to 390 grams. As described herein, selecting the filler material 2030 from a lightweight or low density material and increasing the fill volume ($V_f$) of the filler material 2030 relative to the total volume ($V_t$) of the golf club head 1600 may enable greater discretionary mass placement toward a periphery of the golf club head 1600 to optimize certain mass properties of the golf club head 100 such as MOI, CG location, and mass balance while maintaining a suitable club head weight. In one example, a ratio between a percentage fill volume $$\left(\frac{Vf}{Vt} \times 100\right)$$

and a percentage fill mass $$\left(\frac{Mf}{Mt} \times 100\right)$$

of the filler material 2030 may be greater than or equal to 5.33 and the golf club head 1600 may have a MOI greater than or equal to 4000 g·cm$^2$. In another example, the golf club head 1600 may have a MOI greater than or equal to 4250 g·cm$^2$. In yet another example, the golf club head 1600 may have a MOI greater than or equal to 4500 g·cm$^2$. The apparatus, methods, and articles of manufacture described herein are not limited in this regard.

As described herein, the golf club head 1600 may include a weighting system that may utilize a plurality of weight ports (e.g., toe-side port 1740 and heel-side port 1750) and corresponding interchangeable weight portions (e.g., weight portions 1760 and 1770) to adjust certain mass properties of the golf club head 1600. While the golf club head 1600 is generally shown having integrated hosel portion 1635, the golf club head 1600 may alternatively include a hosel bore configured to receive any of the hosel types described herein to further adjust the mass properties of the golf club head 1600. The apparatus, methods, and articles of manufacture described herein are not limited in this regard.

In the example of FIGS. 25-33, a golf club head 2500 is generally shown as a third type of blade putter. The golf club head 2500 may include a body portion 2510 having a toe portion 2520, a heel portion 2530, a hosel bore 2535 at the heel portion 2530, a front portion 2540, a face portion 2545 located at the front portion 2540, a rear portion 2550, a top portion 2560, and a sole portion 2610. The body portion 2510 may be made from any of the body materials described herein or described in any of the incorporated by reference patent documents. The body portion 2510 may define an interior cavity 2900 that interfaces with an opening 2910 at the sole portion 2610. A sole plate 2620 may be coupled to the body portion 2510 to close the opening 2910. The sole plate 2620 may be made from a material similar to or different from a material of the body portion 2510. In one example, the sole plate 2620 may be made from a material having a density less than a density of the body portion 2510 to enable greater discretionary mass placement toward a periphery of the golf club head 2500. The sole plate 2620 may be welded to the body portion 2510 or otherwise attached thereto using adhesive and/or mechanical fasteners. The outer surface of the sole plate 2620 may include a pair of depressed tabs (e.g., shown as tabs 2921 and 2922) that may on the inner surface of the sole plate 2620 define corresponding pair of raised tabs that may extend into the interior cavity 2900. Tabs 2921 and 2922 may each include a corresponding opening (e.g., shown as openings 2931 and 2932) that interfaces with the interior cavity 2900. The interior cavity 2900 may be partially or entirely filled with a filler material 2930 that may be injectable into the interior cavity 2900 via one of openings 2931 and 2932 while the other one of openings 2931 and 2932 may expel air and any excess filler material 2930. The filler material 2930 may harden without a curing process or later undergo a curing process to harden. The filler material 2930 may be a solid piece manufactured in the shape of the interior cavity 2900 insertable into the interior cavity 2900 prior to attachment of the sole plate 2620 to the body portion 2510. Openings 2931 and 2932 may each be closed by a complementary cover portion (e.g., shown as cover portions 2631 and 2632) received in corresponding tabs 2921 and 2922. In one example, cover portions 2631 and 2632 may each be configured as a lightweight decorative badge and may be attached to corresponding tabs 2921 and 2922 using adhesive. The apparatus, methods, and articles of manufacture described herein are not limited in this regard.

The filler material 2930 may include any of the filler materials described herein or described in any of the incorporated by reference patent documents. The filler material 2930 may be disposed within the interior cavity 2900 to contact and reinforce a rear surface 2940 of the face portion 2545 to reduce face deformation and may also dampen sound and vibration. Additionally, the filler material 2930 may at least partially encase tabs 2921 and 2922. The filler material 2930 may structurally support the cavity walls and the face portion 2545 of the golf club head 2500. Accordingly, the cavity walls may be relatively thin to accommodate a greater amount of the filler material 2930 in the interior cavity 2900 and to provide increased discretionary mass, and the face portion 2545 may be relatively thin to provide a greater flexibility or rebounding effect. For example, one or more cavity walls may have a thickness (constant or average) less than or equal to 0.060 inch (1.524 mm). Particularly, the face portion 2545 may have a face thickness 3000 in one or more areas less than or equal to 0.055 inch (1.397 mm) (e.g., first face thickness 1240) and less than or equal to 0.045 inch (1.143 mm) (e.g., second face thickness 1260) as described herein with reference to FIG. 12. The face portion 2545 may be similar in many respects to any face portion (e.g., face portion 145) described herein or described in any of the incorporated by reference patent documents. The apparatus, methods, and articles of manufacture described herein are not limited in this regard.

Figure 31:
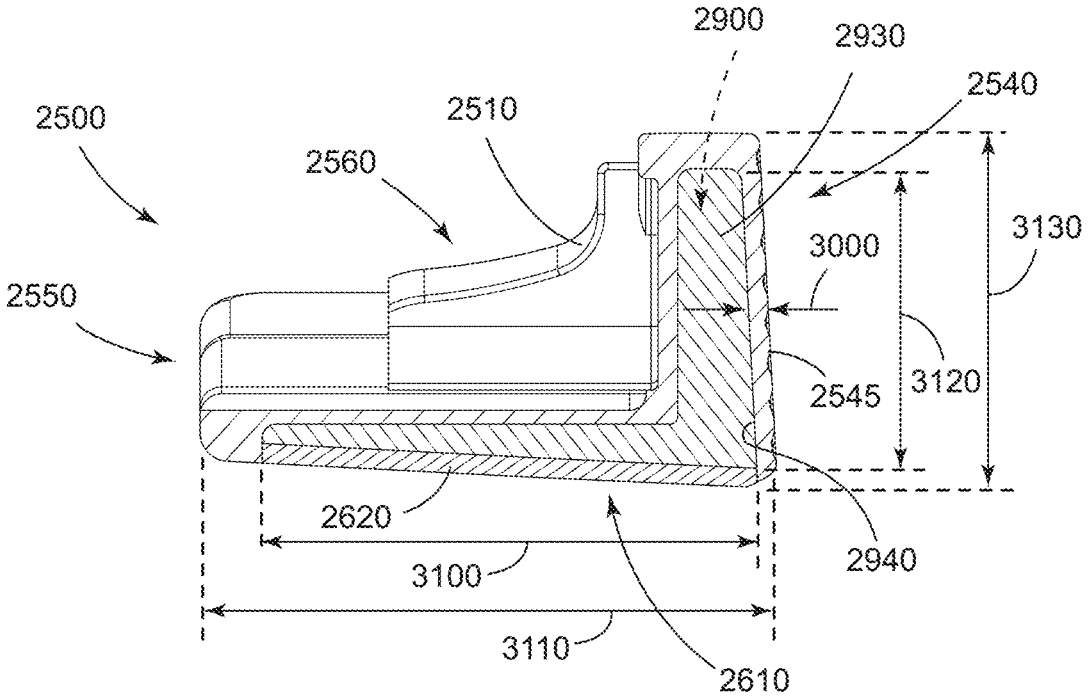
Figure 32:
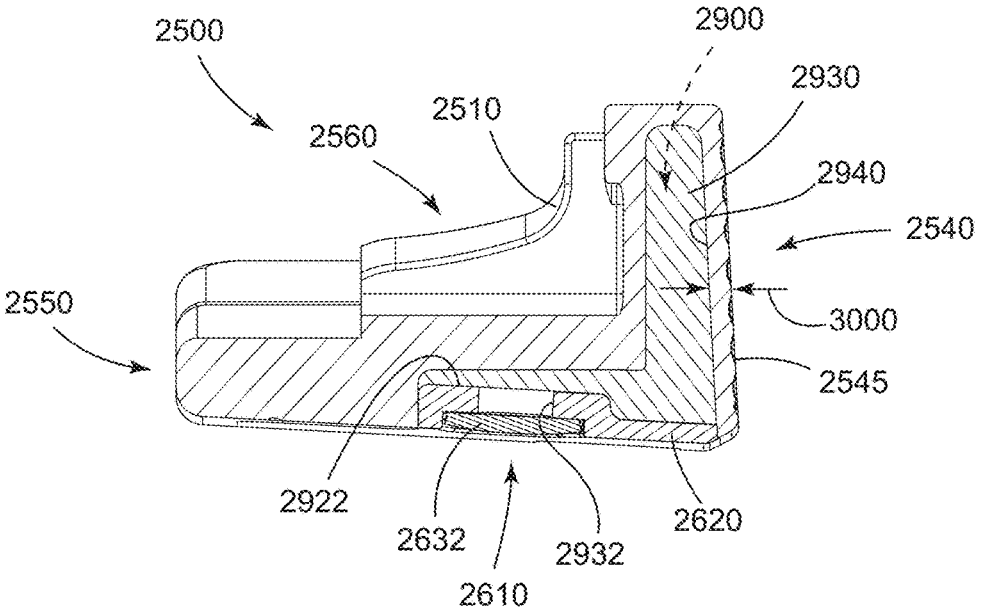
Figure 33:
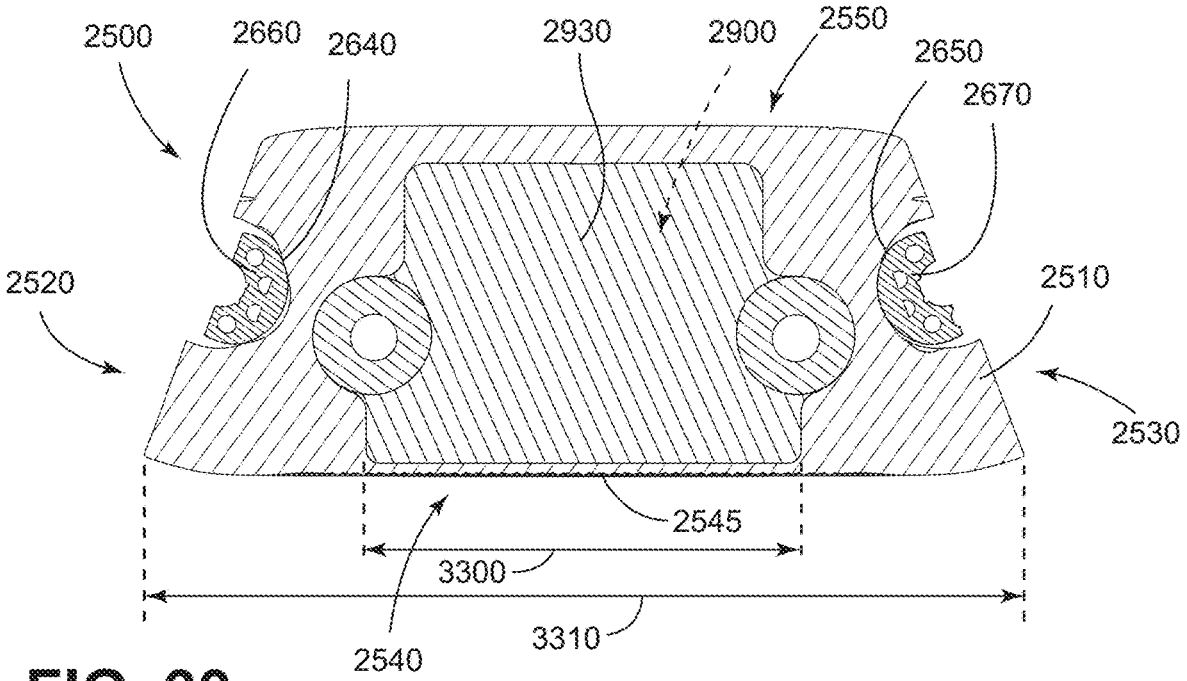
Figure 34:
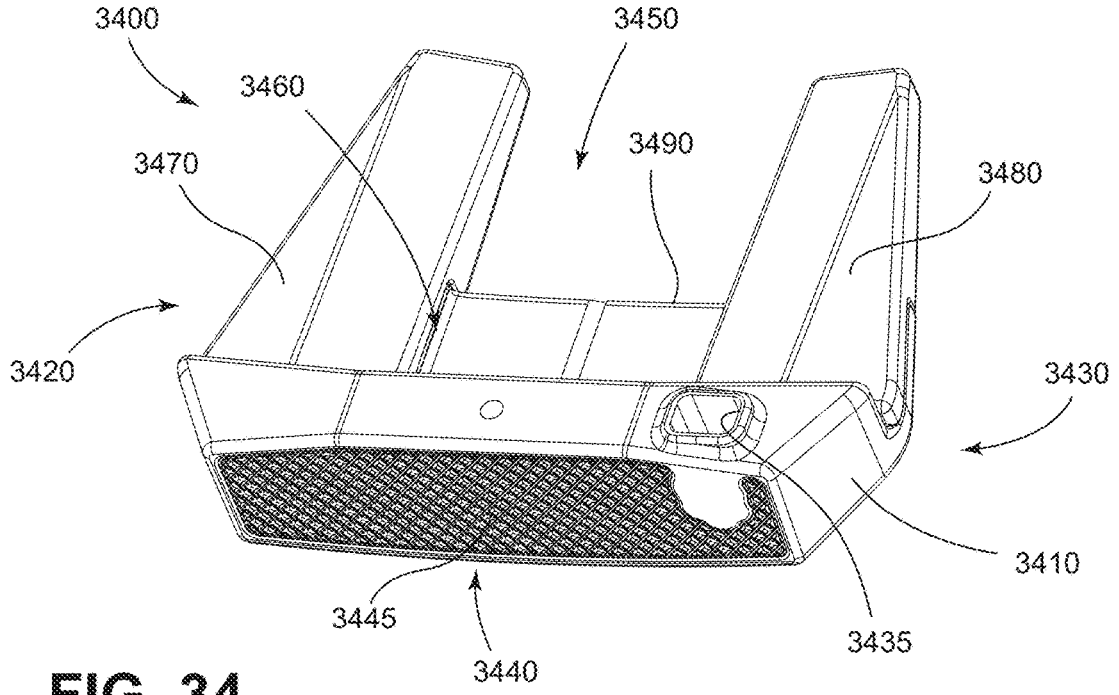
FIGS. 34, 35, 36, 37, 38, 39, 40, 41, and 42 depict a perspective front view, a perspective bottom view, a front elevational view, a rear elevational view, an exploded bottom perspective view, a perspective cross-sectional view (along line 39-39 of FIG. 37), a perspective cross-sectional view (along line 40-40 of FIG. 37), a perspective cross-sectional view (along line 41-41 of FIG. 37), and a perspective cross-sectional view (along line 42-42 of FIG. 37), respectively, of a golf club head according to an embodiment of the apparatus, methods, and articles of manufacture described herein.
Figure 35:
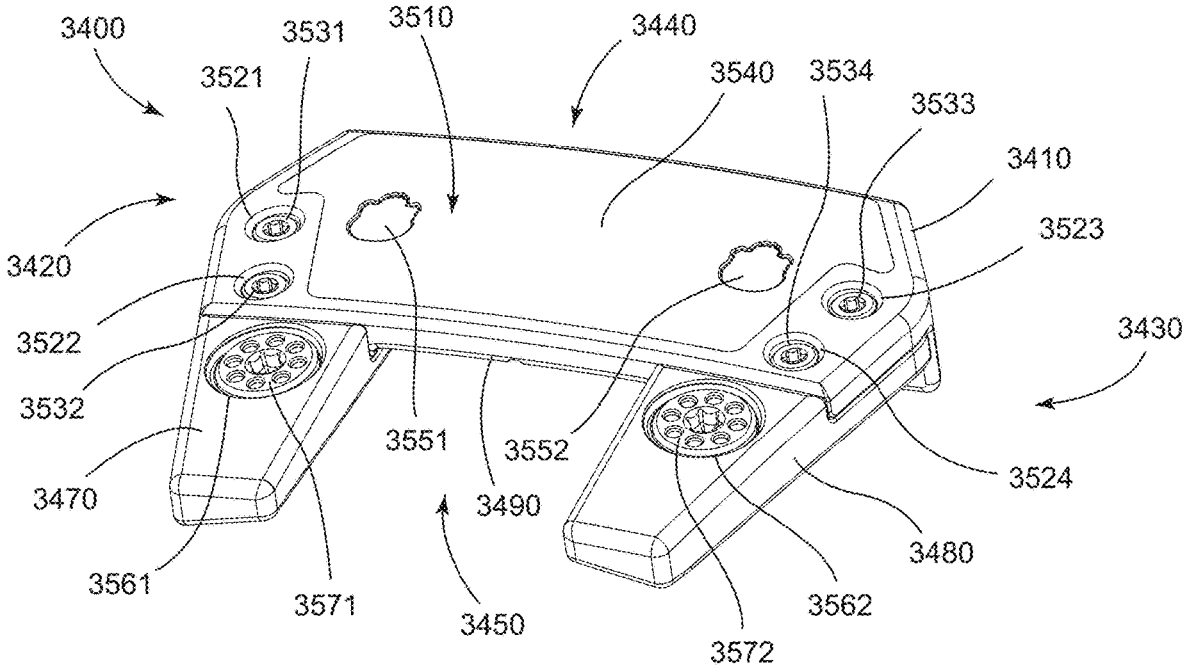
Figure 36:
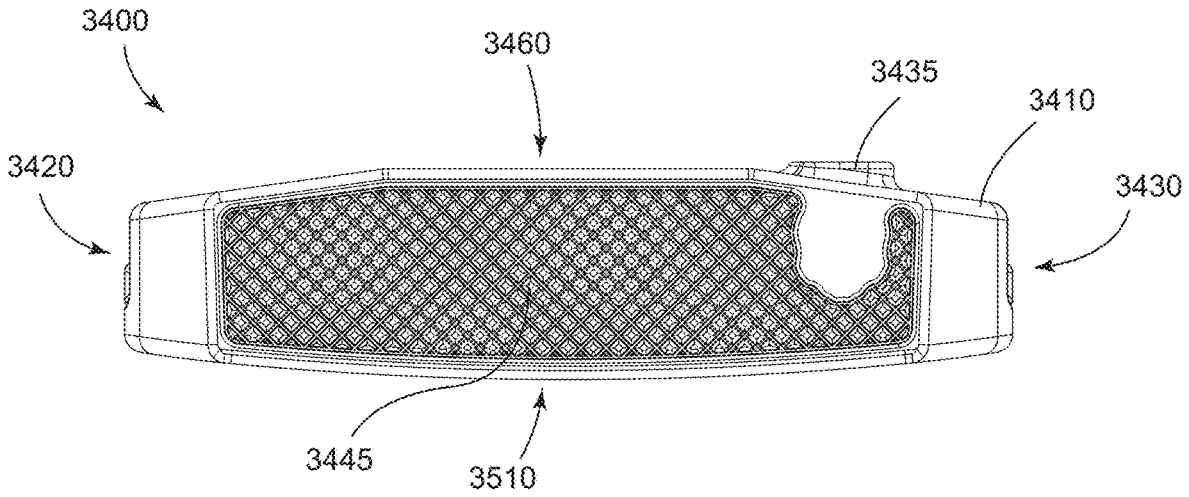
Figure 37:
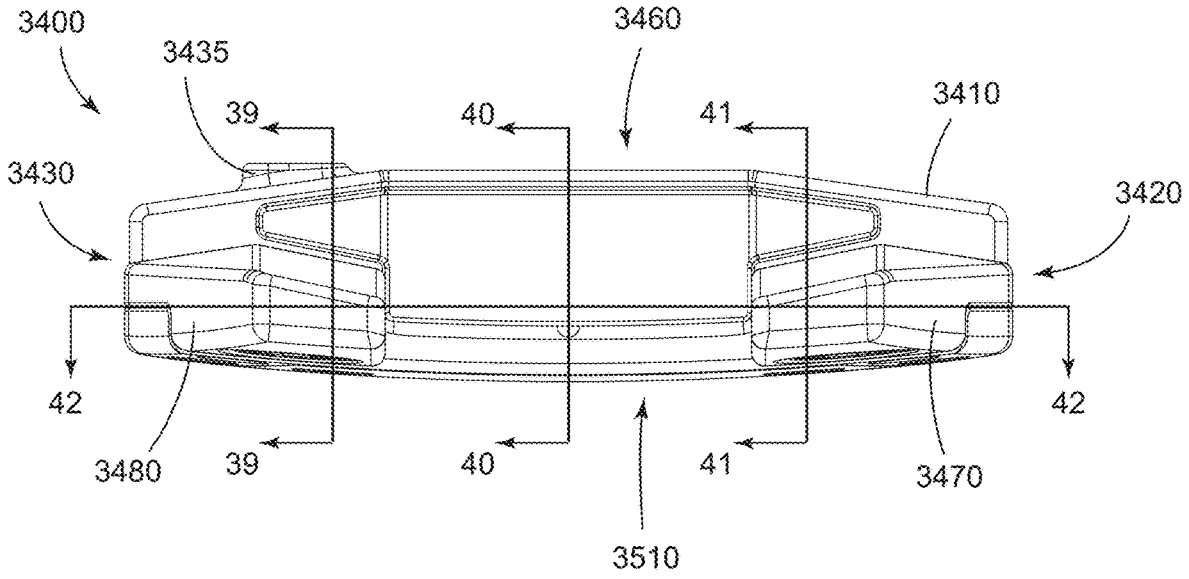
Figure 38:
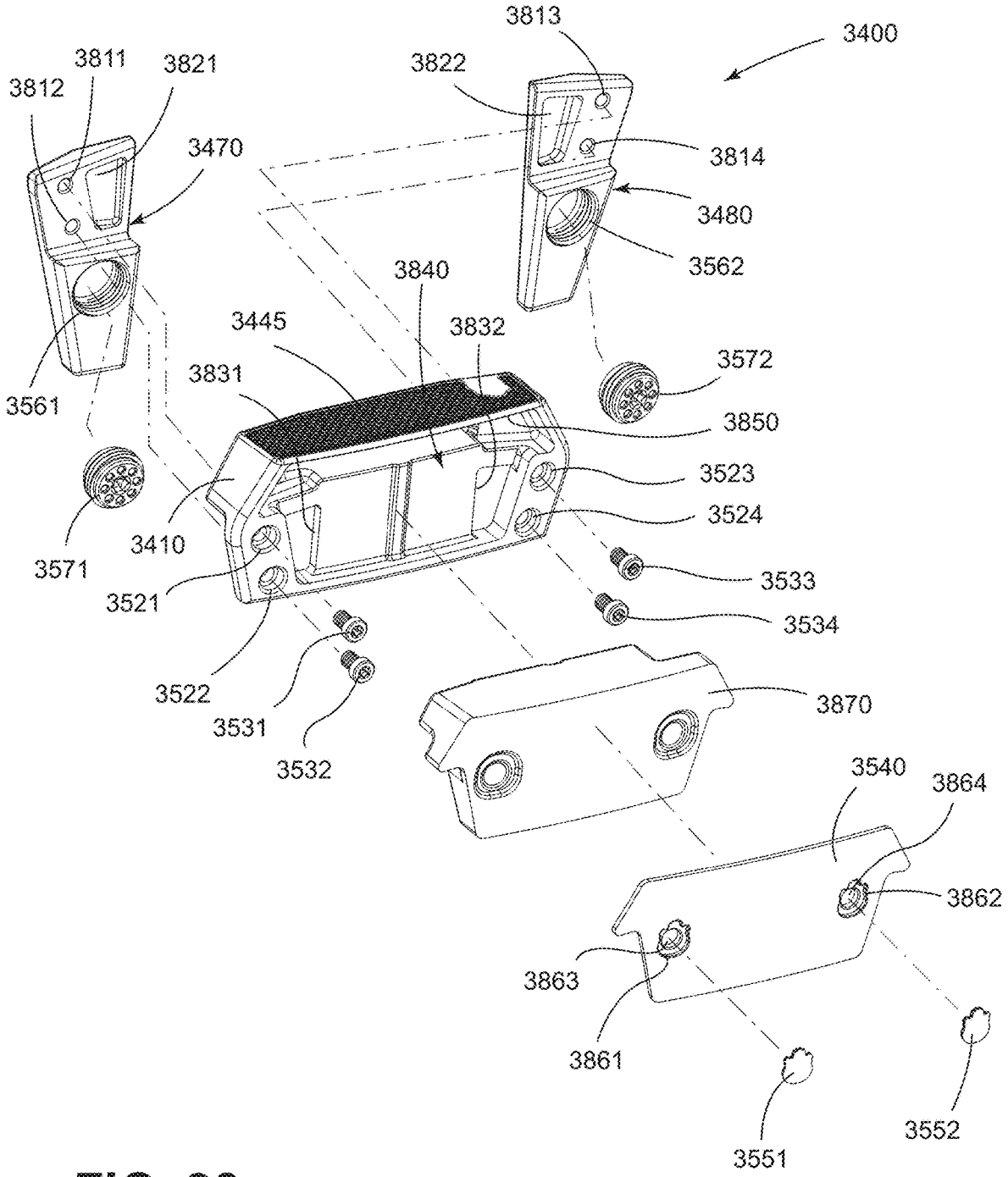
Figure 39:
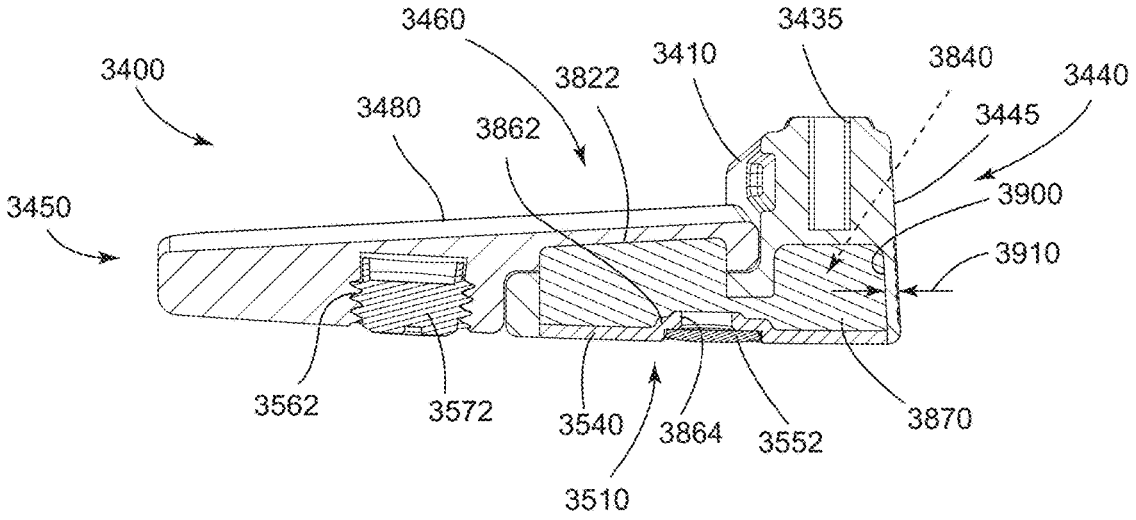

With reference to FIG. 31, the golf club head 2500 may have at least one cross-section where the filler material 2930 has a length 3100 in a front-to-rear direction greater than or equal to 80% of a length 3110 of the body portion 2510 in the front-to-rear direction. With continued reference to FIG. 31, the golf club head 2500 may have at least one cross-section where the filler material 2930 has a length 3120 in a top-to-sole direction greater than or equal to 80% of a length 3130 of the body portion 110 in the top-to-sole direction. With reference to FIG. 33, the golf club head 2500 may have at least one cross-section where the filler material 2930 has a length 3300 in a toe-to-heel direction greater than or equal to 50% of a length 3310 of the body portion 110 in the toe-to-heel direction. The apparatus, methods, and articles of manufacture described herein are not limited in this regard.

The filler material 2930 may have a density less than a density of the body portion 2510 to allow for more discretionary mass to be allocated to other areas of the golf club head 2500. With respect to the present example, the filler material 2930 may have a fill volume ($V_f$) greater than or equal to 18% of a total volume ($V_t$) of the golf club head 2500 and a fill mass ($M_f$) less than or equal 3% of a total mass ($M_t$) of the golf club head 2500. In one example, the total volume ($V_t$) of the golf club head 2500 may be greater than or equal to 2.70 inch$^3$ (44.245 cm$^3$) and less than or equal to 3.30 inch$^3$ (54.077 cm$^3$) and the total mass ($M_t$) of the golf club head 2500 may be greater than or equal to 315 grams and less than or equal to 345 grams. As described herein, selecting the filler material 2030 from a lightweight or low density material and increasing the fill volume ($V_f$) of the filler material 2030 relative to the total volume ($V_t$) of the golf club head 2500 may enable greater discretionary mass placement toward a periphery of the golf club head 2500 to optimize certain mass properties of the golf club head 2500 such as MOI, CG location, and mass balance while maintaining a suitable club head weight. In one example, a ratio between a percentage fill volume $$\left(\frac{Vf}{Vt} \times 100\right)$$

and a percentage fill mass $$\left(\frac{Mf}{Mt} \times 100\right)$$

of the filler material 2930 may be greater than or equal to 6 and the golf club head 2500 may have a MOI greater than or equal to 4500 g·cm$^2$. In another example, the golf club head 2500 may have a MOI greater than or equal to 4700 g·cm$^2$. In yet another example, the golf club head 2500 may have a MOI greater than or equal to 5000 g·cm$^2$. The apparatus, methods, and articles of manufacture described herein are not limited in this regard.

As described herein, the golf club head 2500 may include a weighting system that may utilize a plurality of weight ports (e.g., toe-side port 2640 and heel-side port 2650) and corresponding interchangeable weight portions (e.g., weight portions 2660 and 2670) to adjust certain mass properties of the golf club head 2500. Additionally, the hosel bore 2535 may be configured to receive any of the hosel types described herein to further adjust the mass properties of the golf club head 2500. The apparatus, methods, and articles of manufacture described herein are not limited in this regard.

In the example of FIGS. 34-42, a golf club head 3400 is generally shown as a first type of mallet putter. The golf club head 3400 may include a body portion 3410 having a toe portion 3420, a heel portion 3430, a hosel bore 3435 located at the heel portion 3430, a front portion 3440, a face portion 3445 located at the front portion 3440, a rear portion 3450, a top portion 3460, and a sole portion 3510. The body portion 3410 may be made from any of the materials described herein or described in any of the incorporated by reference patent documents. The golf club head 3400 may also include a pair of wing portions (e.g., shown as a toe-side wing portion 3470 and a heel-side wing portion 3480) cantilevered to a ledge portion 3490 at the rear portion 3450 and extending in a rearward direction. The toe-side wing portion 3470 and the heel-side wing portion 3480 may be made from a material similar to or different from a material of the body portion 3410 and may include any of the materials described herein or described in any of the incorporated by reference patent documents. In one example, the toe-side wing portion 3470 and the heel-side wing portion 3480 may be made of a material having a density greater than a density of a material of the body portion 3410 in order to shift a CG location rearward and increase a peripheral mass of the golf club head 3400. The toe-side wing portion 3470 and the heel-side wing portion 3480 may each include one or more fastener ports (e.g., shown as fastener ports 3811, 3812, 3813, and 3814) aligned with one or more complementary through-ports (e.g., shown as through-ports 3521, 3522, 3523, and 3524) extending through the body portion 3410. A mechanical fastener (e.g., shown as mechanical fasteners 3531, 3532, 3533, and 3534) may be received through each of the through-ports 3521, 3522, 3523, and 3524 and threadedly engaged to the corresponding fastener ports 3811, 3812, 3813, and 3814 to attach the toe-side wing portion 3470 and the heel-side wing portion 3480 to the body portion 3410. In another example, the toe-side wing portion 3470 and the heel-side wing portion 3480 may be attached to the body portion 3410 by welding. In yet another example, the toe-side wing portion 3470 and the heel-side wing portion 3480 may be co-manufactured with the body portion 3410 so as to be a continuous one-piece part with the body portion 3410. The toe-side wing portion 3470 and the heel-side wing portion 3480 may each include a weight port (e.g., shown as toe-side weight port 3561 and heel-side weight port 3562) configured to receive an interchangeable weight portion (e.g., shown as weight portions 3571 and 3572) similar to any of the weight ports and weight portions described herein or described in any of the incorporated by reference patent documents. Additionally, the toe-side wing portion 3470 and the heel-side wing portion 3480 may each include a downward facing pocket (e.g., shown as pockets 3821 and 3822) aligned with a complementary opening (e.g., shown as openings 3831 and 3832) at the top portion 3460 to interface with an interior cavity 3840 within the body portion 3410. The apparatus, methods, and articles of manufacture described herein are not limited in this regard.

The interior cavity 3840 may interface with an opening 3850 at the sole portion 3510. A sole plate 3540 may be coupled to the body portion 3410 to close the opening 3850. The sole plate 3540 may be made from a material similar to or different from a material of the body portion 3410 and may include any of the materials described herein or described in any of the incorporated by reference patent documents. In one example, the sole plate 3540 may be made from a material having a density less than a density of the body portion 3410 to enable greater discretionary mass toward a periphery of the golf club head 3400. The sole plate 3540 may be welded to the body portion 3410 or otherwise attached thereto using adhesive and/or mechanical fasteners. The outer surface of the sole plate 3540 may include a pair of depressions (e.g., shown as depressions 3861 and 3862) that on the inner surface of the sole plate 3540 may define a pair of corresponding raised portions that extend into the interior cavity 3840. Depressions 3861 and 3862 may each include an opening (e.g., shown as openings 3863 and 3864) that interfaces with the interior cavity 3840. The interior cavity 3840 may be partially or entirely filled with a filler material 3870 that may be injectable into the interior cavity 3840 via one of openings 3863 and 3864 while the other one of openings 3863 and 3864 may expel air and any excess filler material 3870. The filler material 3870 may harden without a curing process or later undergo a curing process to harden. the filler material 3870 may be a solid piece manufactured in the shape of the interior cavity 3840 so as to be insertable into the interior cavity 3840 prior to attachment of the sole plate 3540 to the body portion 3410. Openings 3863 and 3864 may each be closed by a complementary cover portion (e.g., shown as cover portions 3551 and 3552) received in the corresponding depressions 3861 and 3862 to enclose the interior cavity 3840. In one example, cover portions 3551 and 3552 may each be configured as a lightweight decorative badge and may and attached to the corresponding depressions 3861 and 3862 using adhesive. The apparatus, methods, and articles of manufacture described herein are not limited in this regard.

The filler material 3870 may include any of the filler material described herein or described in any of the incorporated by reference patent documents. The filler material 3870 may be disposed within the interior cavity 3840 to contact and reinforce a rear surface 3900 of the face portion 3445 to reduce face deformation and also dampen sound and vibration. Additionally, the filler material 3870 may extend within pockets 3821 and 3822 of the toe-side wing portion 3470 and the heel-side wing portion 3480, respectively. The filler material 3870 may structurally support the cavity walls and the face portion 3445 of the golf club head 3400. Accordingly, the cavity walls may be relatively thin to accommodate a greater amount of the filler material 3870 in the interior cavity 3840 and to provide increased discretionary mass, and the face portion 3445 may be relatively thin to provide a greater flexibility or rebounding effect. For example, one or more cavity walls may have a thickness (constant or average) less than or equal to 0.055 inch (1.397 mm). Particularly, the face portion 3445 may have a face thickness 3910 in one or more areas less than or equal to 0.055 inch (1.397 mm) (e.g., first face thickness 1240) and less than or equal to 0.045 inch (1.143 mm) (e.g., second face thickness 1260) as described herein with reference to FIG. 12. The face portion 3445 may be similar in many respects to any face portion (e.g., face portion 145) described herein or described in any of the incorporated by reference patent documents. The apparatus, methods, and articles of manufacture described herein are not limited in this regard.

Figure 40:
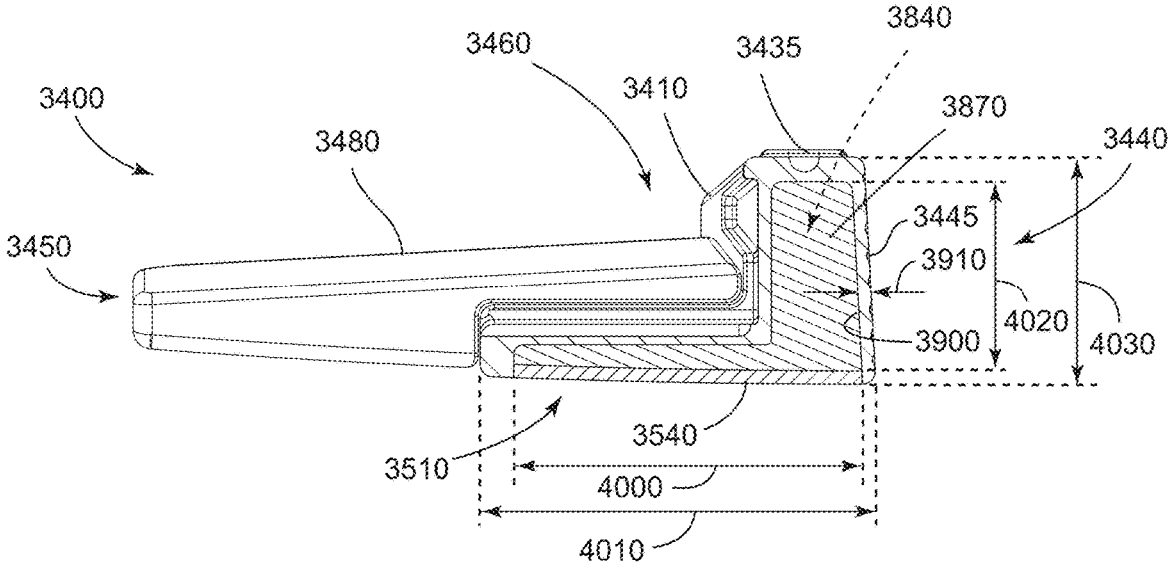
Figure 41:
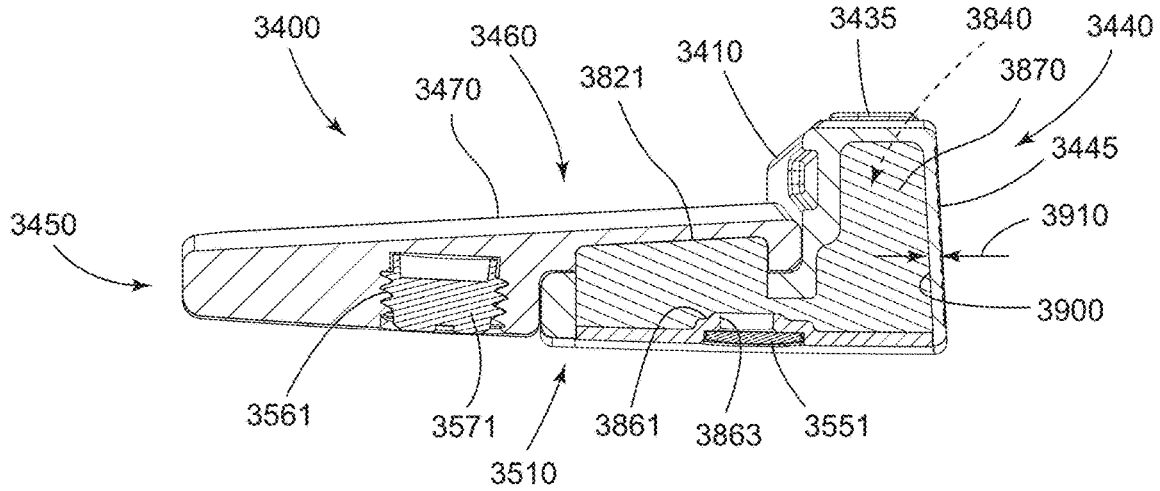
Figure 42:
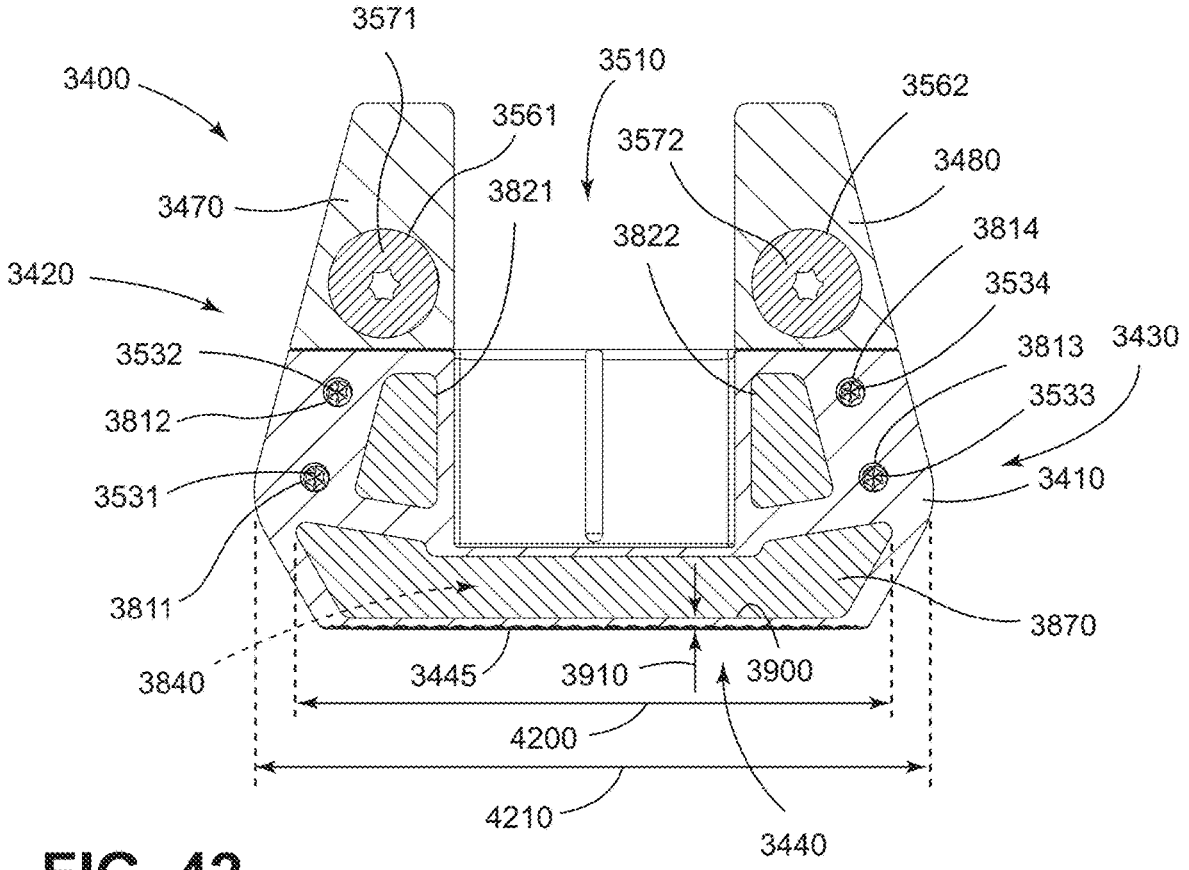
Figure 43:
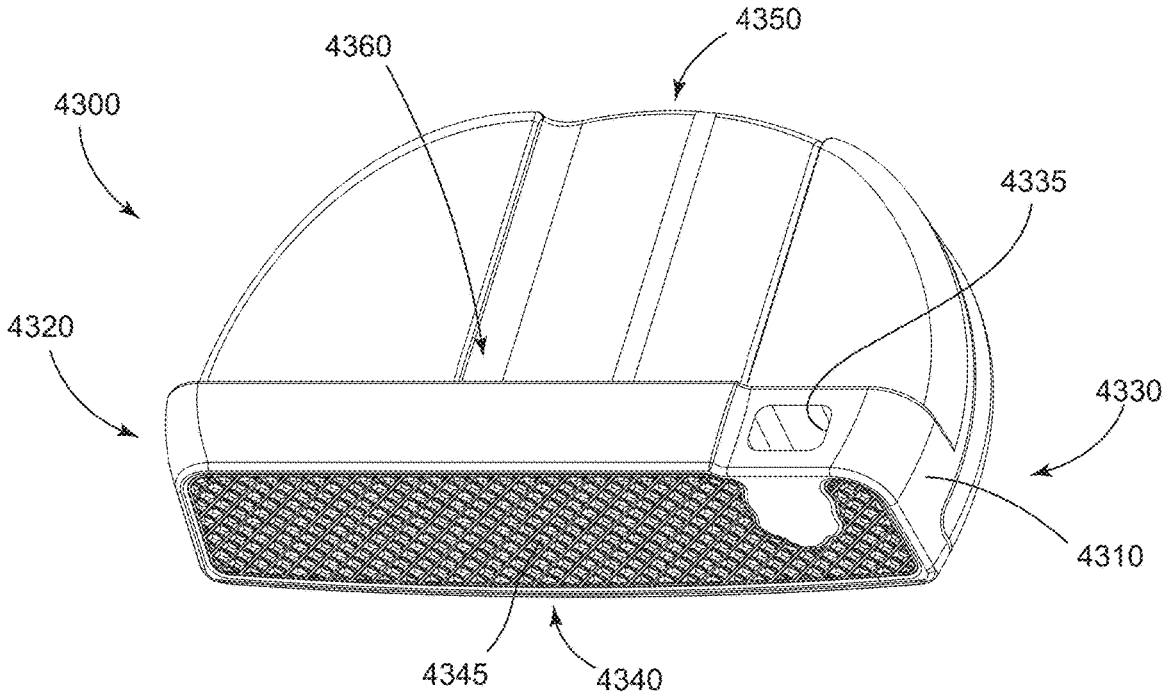
FIGS. 43, 44, 45, 46, 47, 48, 49, 50, and 51 depict a perspective front view, a perspective bottom view, a front elevational view, a rear elevational view, an exploded bottom perspective view, a perspective cross-sectional view (along line 48-48 of FIG. 46), a perspective cross-sectional view (along line 49-49 of FIG. 46), a perspective cross-sectional view (along line 50-50 of FIG. 46), and a perspective cross-sectional view (along line 51-51 of FIG. 46), respectively, of a golf club head according to an embodiment of the apparatus, methods, and articles of manufacture described herein.
Figure 44:
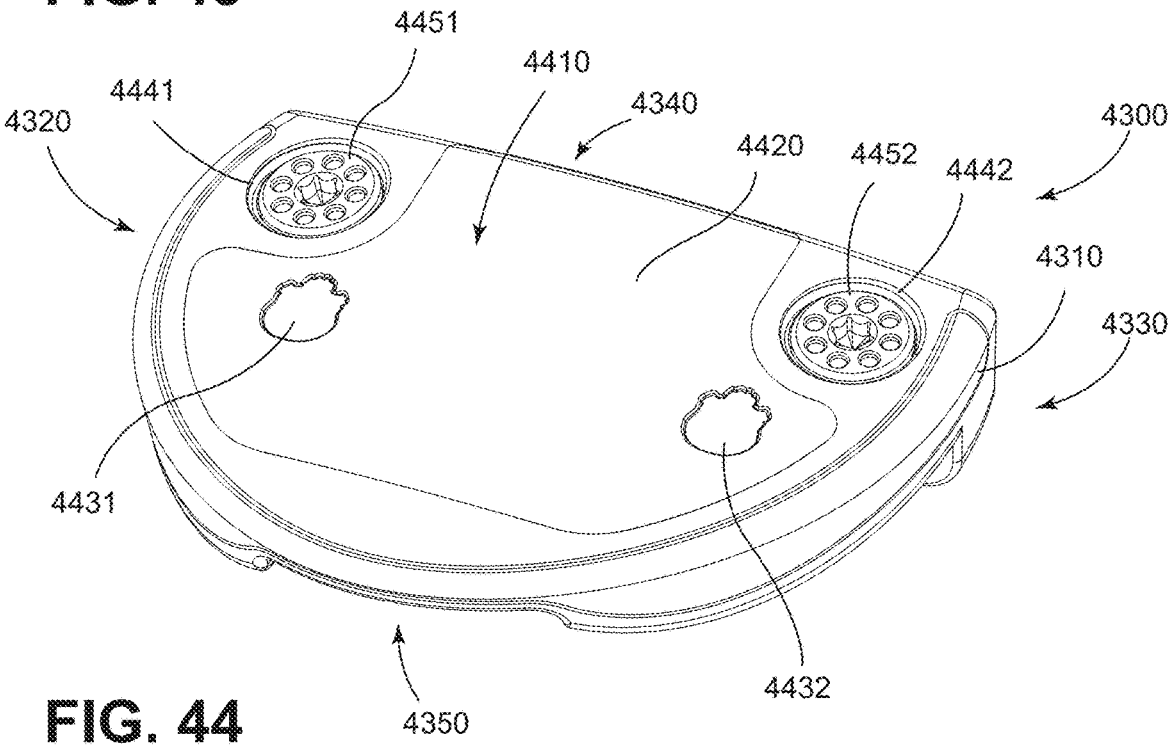
Figure 45:
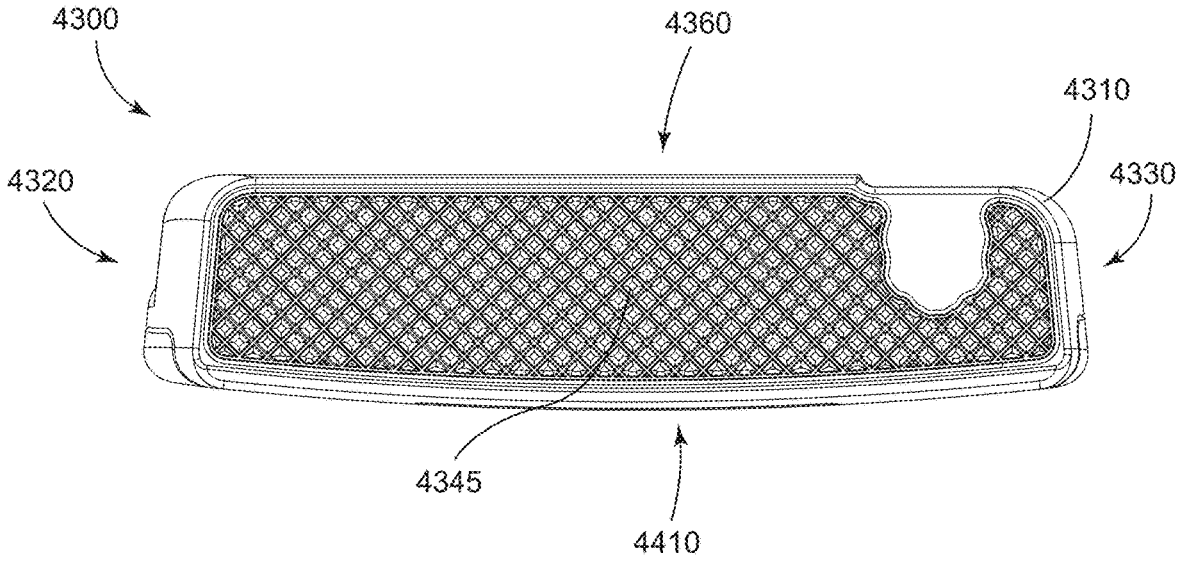
Figure 46:
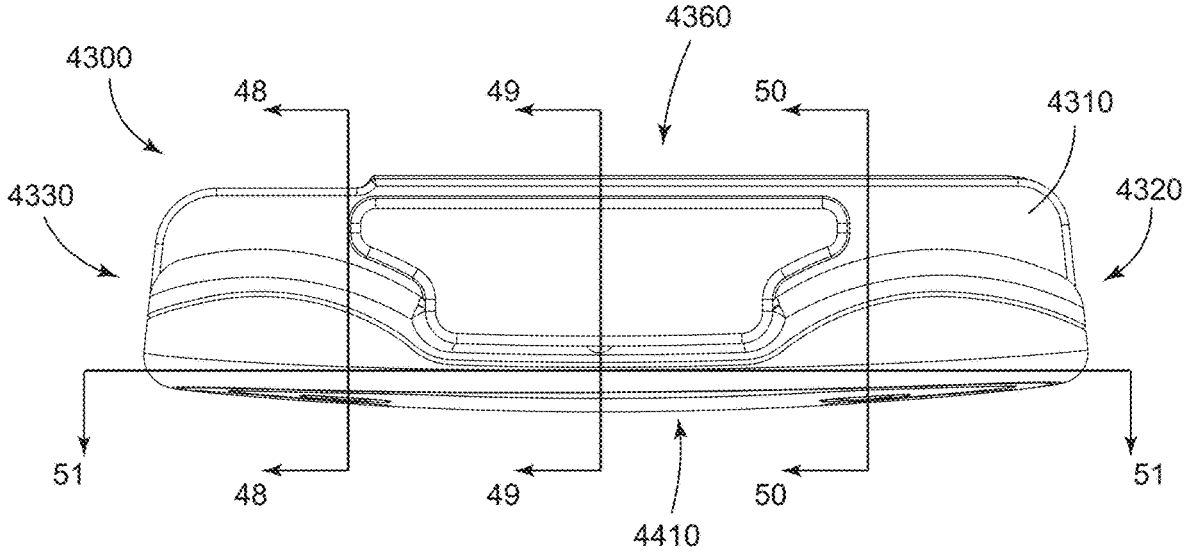
Figure 47:
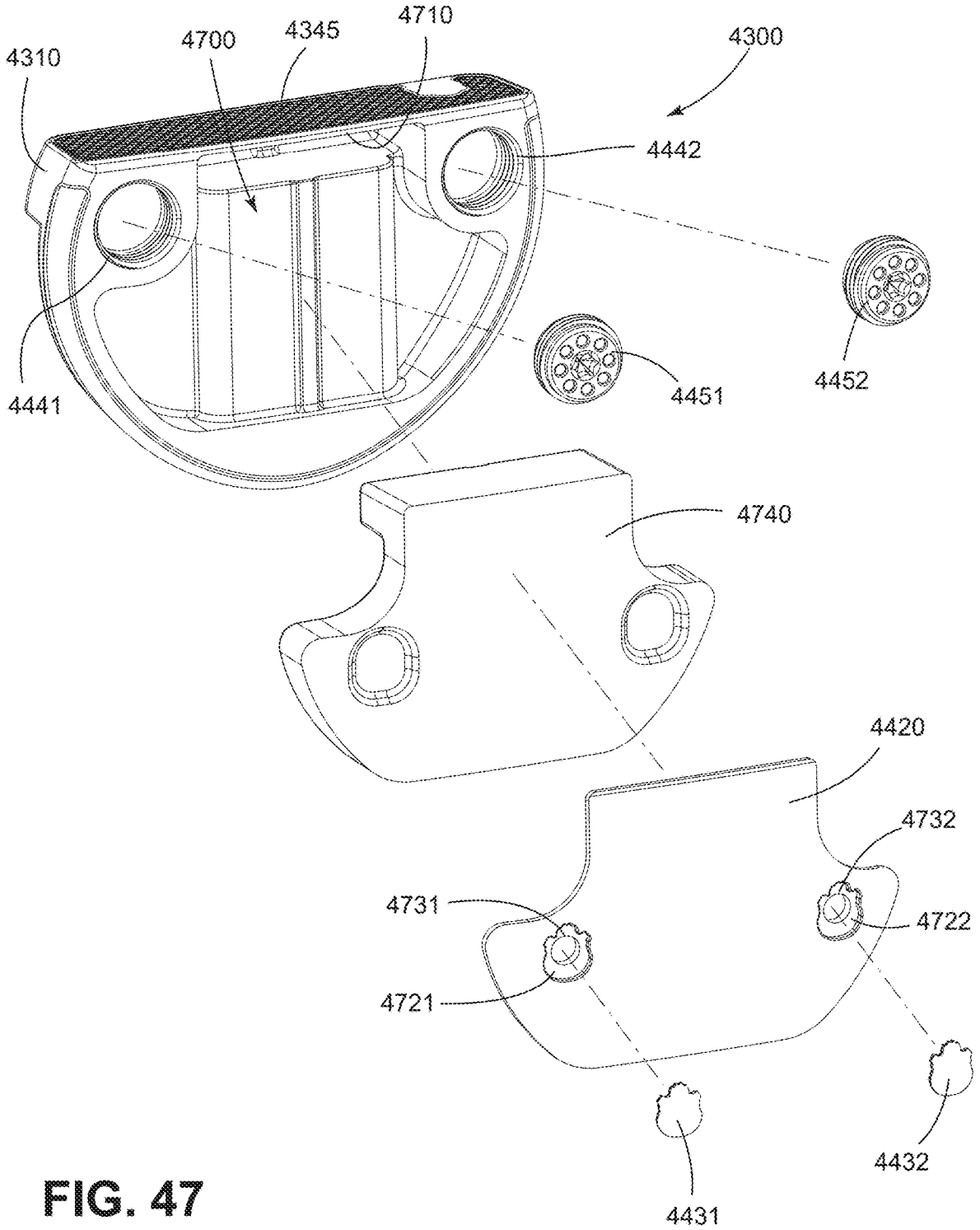
Figure 48:
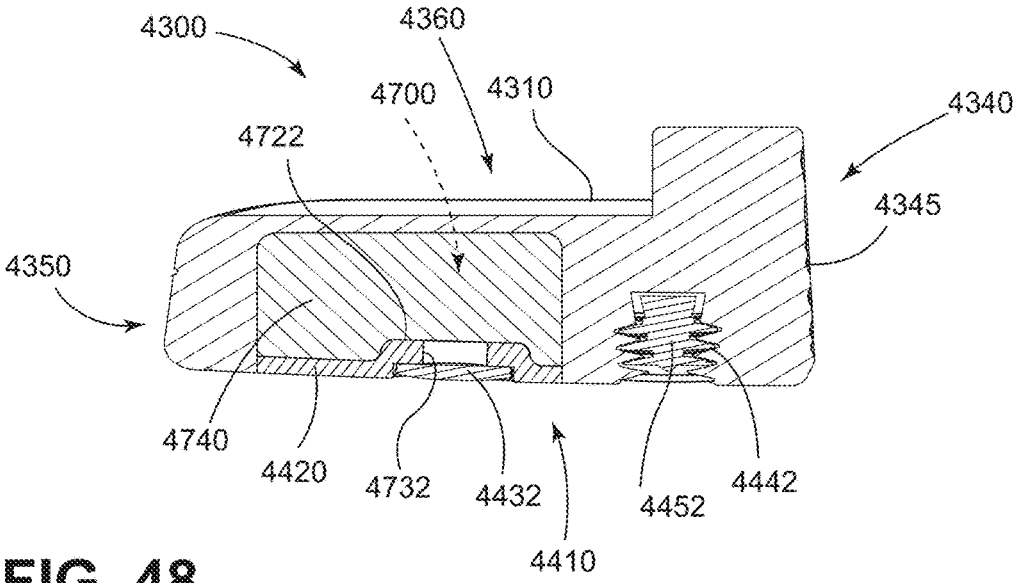

With reference to FIG. 40, the golf club head 3400 may have at least one cross-section where the filler material 3870 has a length 4000 in a front-to-rear direction (e.g., center longitudinal direction) greater than or equal to 80% of a length 4010 of the body portion 3410 in the front-to-rear direction (e.g., center longitudinal direction). With continued reference to FIG. 40, the golf club head 3400 may have at least one cross-section where the filler material 3870 has a length 4020 in a top-to-sole direction greater than or equal to 80% of a length 4030 of the body portion 3410 in the top-to-sole direction. With reference to FIG. 42, the golf club head 3400 may have at least one cross-section where the filler material 3870 has a length 4200 in a toe-to-heel direction greater than or equal to 80% of a length 4210 of the body portion 3410 in the toe-to-heel direction. The apparatus, methods, and articles of manufacture described herein are not limited in this regard.

The filler material 3870 may have a density less than a density of the body portion 3410 to allow for more discretionary mass to be allocated to other areas of the golf club head 3400. With respect to the present example, the filler material 3870 may have a fill volume ($V_f$) greater than or equal to 34% of a total volume ($V_t$) of the golf club head 3400 and a fill mass ($M_f$) less than or equal 7% of a total mass ($M_t$) of the golf club head 3400. In one example, the total volume ($V_t$) of the golf club head 3400 may be greater than or equal to 3.50 inch$^3$ (57.355 cm$^3$) and less than or equal to 4.00 inch$^3$ (65.548 cm$^3$) and the total mass ($M_t$) of the golf club head 3400 may be greater than or equal to 325 grams and less than or equal to 360 grams. As described herein, selecting the filler material 3870 from a lightweight or low density material and increasing the fill volume ($V_f$) of the filler material 2030 relative to the total volume ($V_t$) of the golf club head 3400 may enable greater discretionary mass placement toward a periphery of the golf club head 3400 to optimize certain mass properties of the golf club head 3400 such as MOI, CG location, and mass balance while maintaining a suitable club head weight. In one example, a ratio between a percentage fill volume $$\left(\frac{Vf}{Vt}\times 100\right)$$

and a percentage fill mass $$\left(\frac{Mf}{Mt}\times 100\right)$$

of the filler material 3870 may be greater than or equal to 4.857 and the golf club head 3400 may have a MOI greater than or equal to 5000 g·cm$^2$. In another example, the golf club head 3400 may have a MOI greater than or equal to 5250 g·cm$^2$. In yet another example, the golf club head 3400 may have a MOI greater than or equal to 5500 g·cm$^2$. The apparatus, methods, and articles of manufacture described herein are not limited in this regard.

As described herein, the golf club head 3400 may include a weight system that may utilize a plurality of weight ports (e.g., toe-side weight port 3561 and heel-side weight port 3562) and corresponding interchangeable weight portions (e.g., weight portions 3571 and 3572) to adjust the mass properties of the golf club head 3400. Additionally, the hosel bore 3435 may be configured to receive any of the hosel types described herein to further adjust the mass properties of the golf club head 3400. The apparatus, methods, and articles of manufacture described herein are not limited in this regard.

In the example of FIGS. 43-51, a golf club head 4300 is generally shown as a second type of mallet putter. The golf club head 4300 may include a body portion 4310 having a toe portion 4320, a heel portion 4330, a hosel bore 4335 at the heel portion 4330, a front portion 4340, a face portion 4345 at the front portion 4340, a rear portion 4350, a top portion 4360, and a sole portion 4410. The body portion 4310 may be made from any of the body materials described herein or described in any of the incorporated by reference patent documents. The body portion 4310 may be crescent or half-moon shaped and may define an interior cavity 4700 that interfaces with an opening 4710 at the sole portion 4410. A sole plate 4420 may be coupled to the body portion 4310 to close the opening 4710. The sole plate 4420 may be made from a material similar to or different from a material of the body portion 4310. In one example, the sole plate 4420 may be made from a material having a density less than a density of the body portion 4310 to enable greater discretionary mass placement toward a periphery of the golf club head 4300. The sole plate 4420 may be welded to the body portion 4310 or otherwise attached thereto using adhesive and/or mechanical fasteners. The outer surface of the sole plate 4420 may include a pair of depressions (e.g., shown as depressions 4721 and 4722) that on the outer surface of the sole plate 4420 may define a corresponding pair of raised portions extending into the interior cavity 4700. Depressions 4721 and 4722 may each include an opening (e.g., shown as openings 4731 and 4732) that interfaces with the interior cavity 4700. The interior cavity 4700 may be partially or entirely filled with a filler material 4740 that may be injectable into the interior cavity 4700 via one of openings 4731 and 4732 while the other one of openings 4731 and 4732 may expel air and any excess filler material 4740. The filler material 4740 may harden without a curing process or later undergo a curing process to harden. The filler material 4740 may be a solid piece manufactured in the shape of the interior cavity 4700 so as to be insertable into the interior cavity 4700 prior to attachment of the sole plate 4420 to the body portion 4310. Openings 4731 and 4732 may each be closed by a complementary cover portion (e.g., shown as cover portions 4431 and 4432) received in the corresponding depressions 4721 and 4722 to enclose the interior cavity 4700. In one example, cover portions 4431 and 4432 may each be configured as a lightweight decorative badge and may be attached to the corresponding depressions 4721 and 4722 using adhesive. The golf club head 4300 may additionally include a plurality of weight ports (e.g., shown as toe-side weight port 4441 and heel-side weight port 4442) each configured to receive an interchangeable weight portion (e.g., shown as weight portions 4451 and 4452) similar to any of the golf club heads described herein or described in any of the incorporated by reference patent documents. The apparatus, methods, and articles of manufacture described herein are not limited in this regard.

The filler material 4740 may include any of the filler materials described herein or described in any of the incorporated by reference patent documents. The filler material 4740 may be disposed within the interior cavity 4700 to contact and reinforce a rear surface 4900 of the face portion 4345 to reduce face deformation and also dampen sound and vibration. Additionally, the filler material 4740 may at least partially encase depressions 4721 and 4722 of the sole plate 4420. The filler material 4740 may structurally support the cavity walls and the face portion 4345 of the golf club head 4300. Accordingly, the cavity walls may be relatively thin to accommodate a greater amount of the filler material 4740 in the interior cavity 4700 and to provide increased discretionary mass, and the face portion 4345 may be relatively thin to provide a greater flexibility or rebounding effect. For example, one or more cavity walls may have a thickness (constant or average) less than or equal to 0.055 inch (1.397 mm). Particularly, the face portion 4345 may have a face thickness 4910 in one or more areas less than or equal to 0.055 inch (1.397 mm) (e.g., first face thickness 1240) and less than or equal to 0.045 inch (1.143 mm) (e.g., second face thickness 1260) as described herein with reference to FIG. 12. The face portion 4345 may be similar in many respects to any face portion (e.g., face portion 145) described herein. The apparatus, methods, and articles of manufacture described herein are not limited in this regard.

Figure 49:
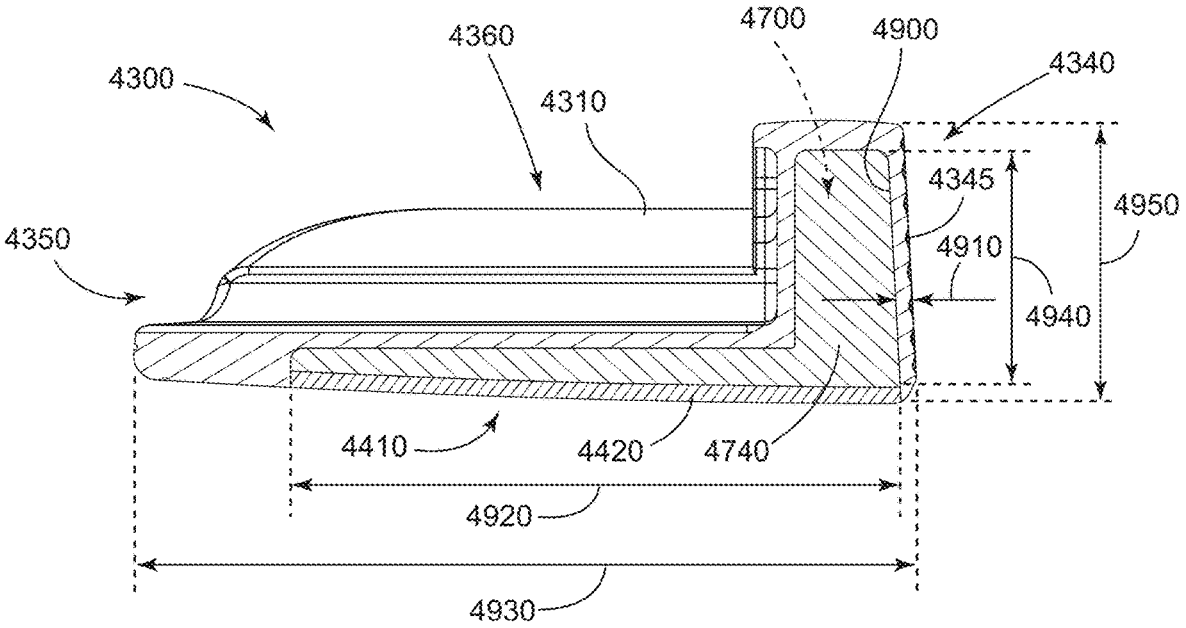
Figure 50:
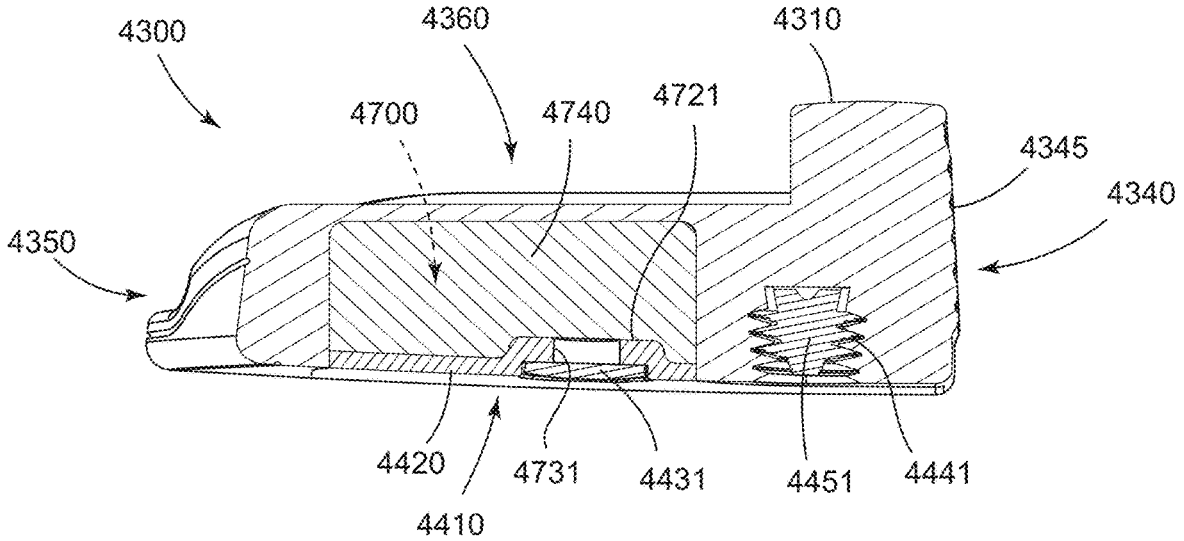
Figure 51:
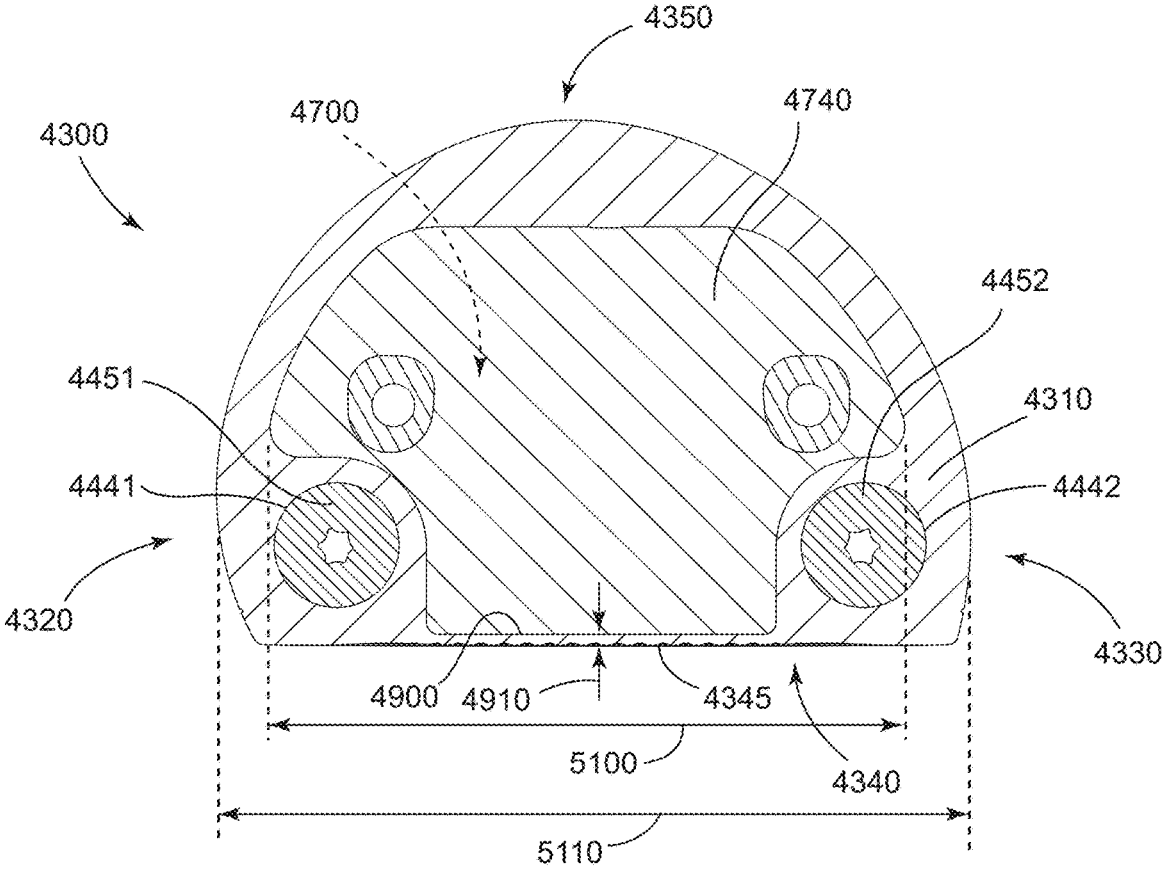
Figure 52:
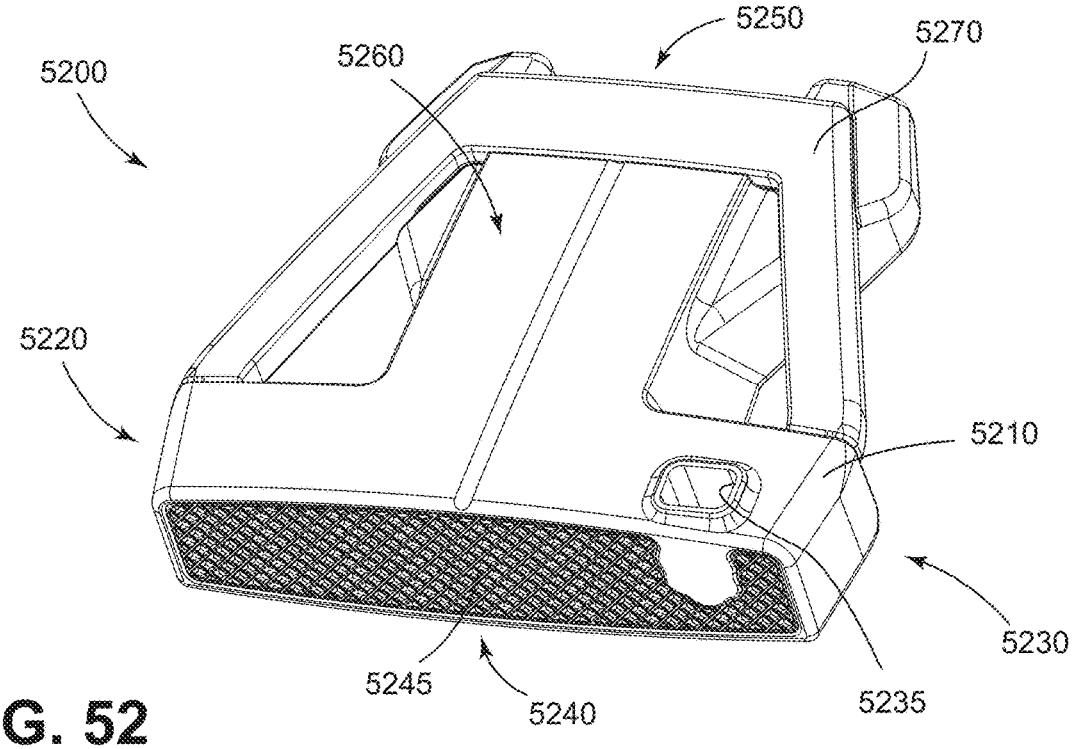
FIGS. 52, 53, 54, 55, 56, 57, 58, 59, 60, and 61 depict a perspective front view, a perspective bottom view, a front elevational view, a rear elevational view, an exploded top perspective view, an exploded bottom perspective view, a perspective cross-sectional view (along line 58-58 of FIG. 55), a perspective cross-sectional view (along line 59-59 of FIG. 55), a perspective cross-sectional view (along line 60-60 of FIG. 55), and a perspective cross-sectional view (along line 61-61 of FIG. 55), respectively, of a golf club head according to an embodiment of the apparatus, methods, and articles of manufacture described herein.
Figure 53:
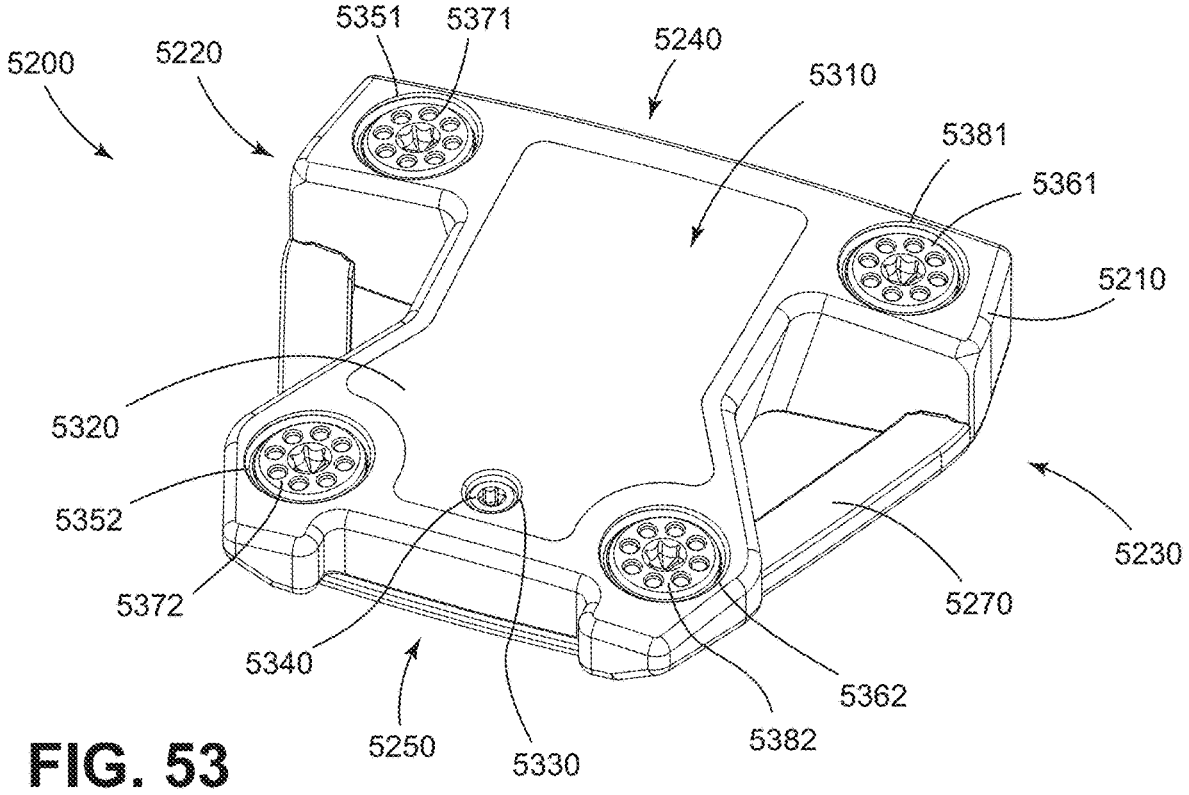
Figure 54:
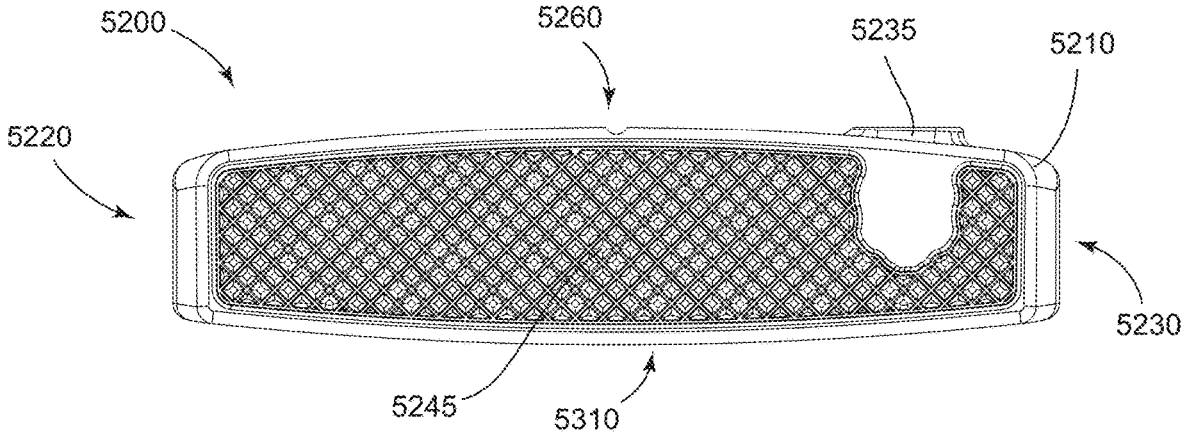
Figure 55:
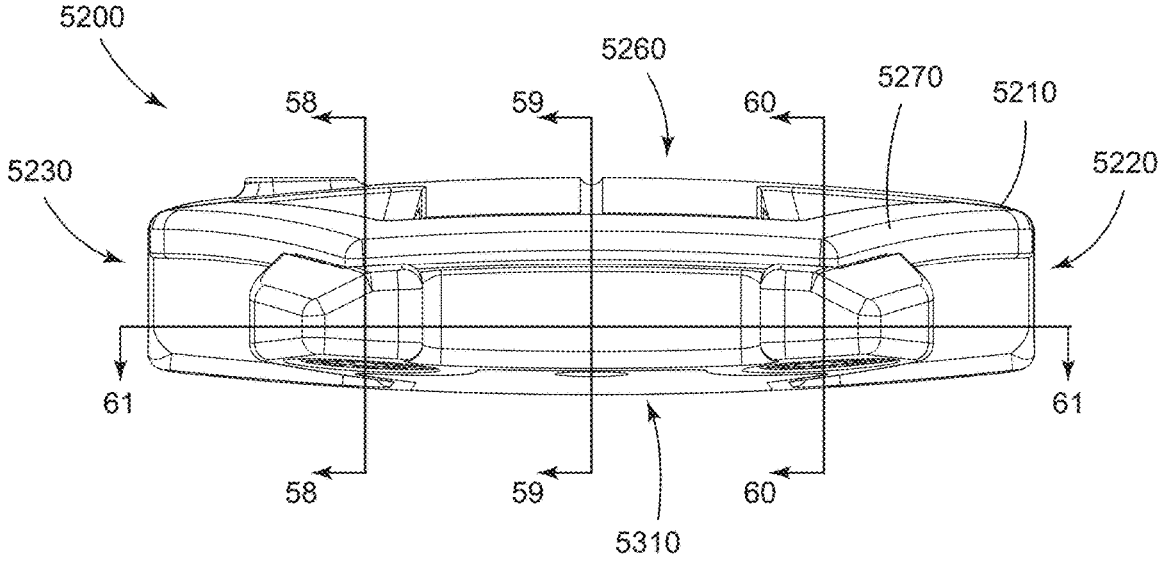
Figure 56:
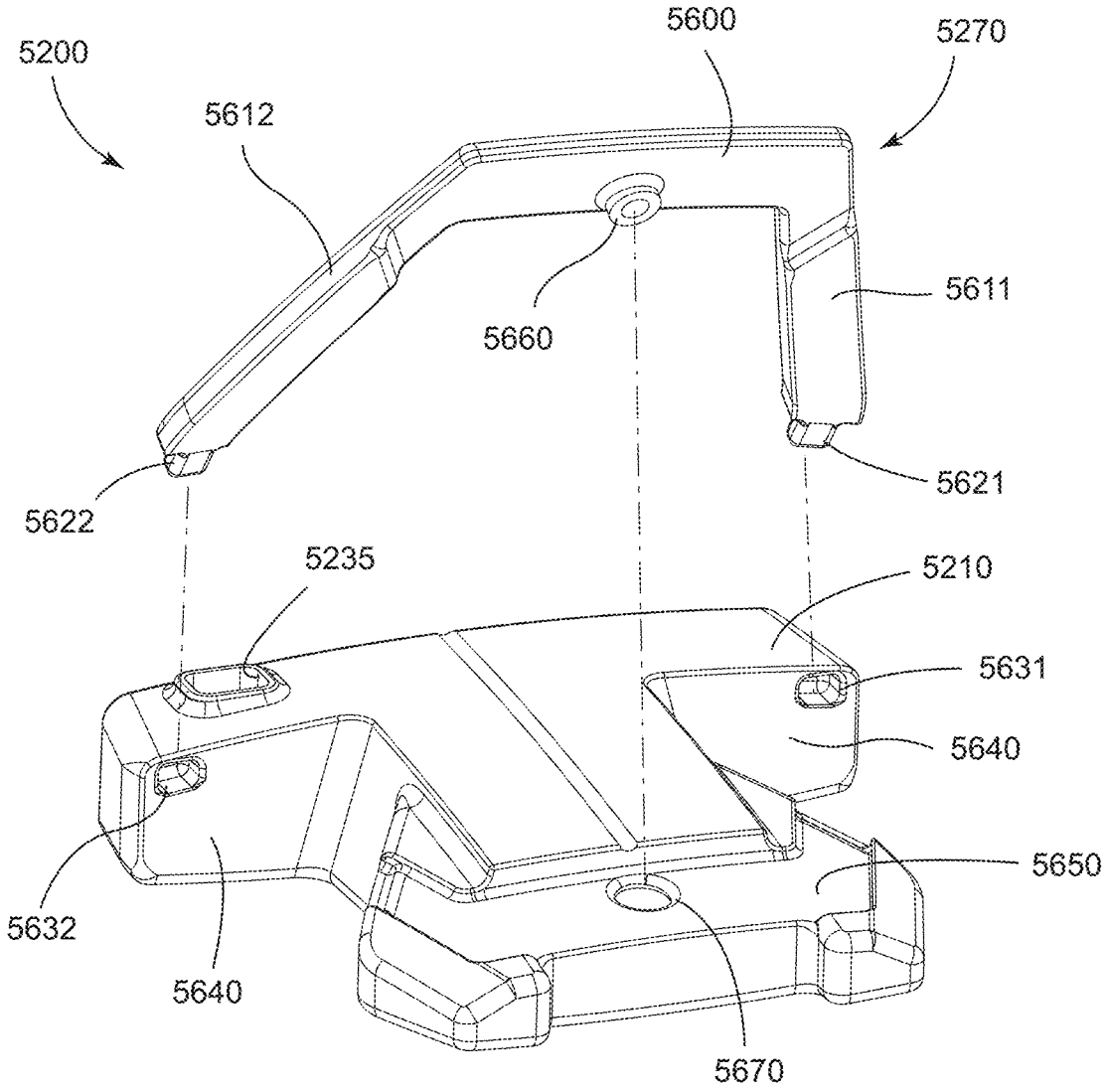
Figure 57:
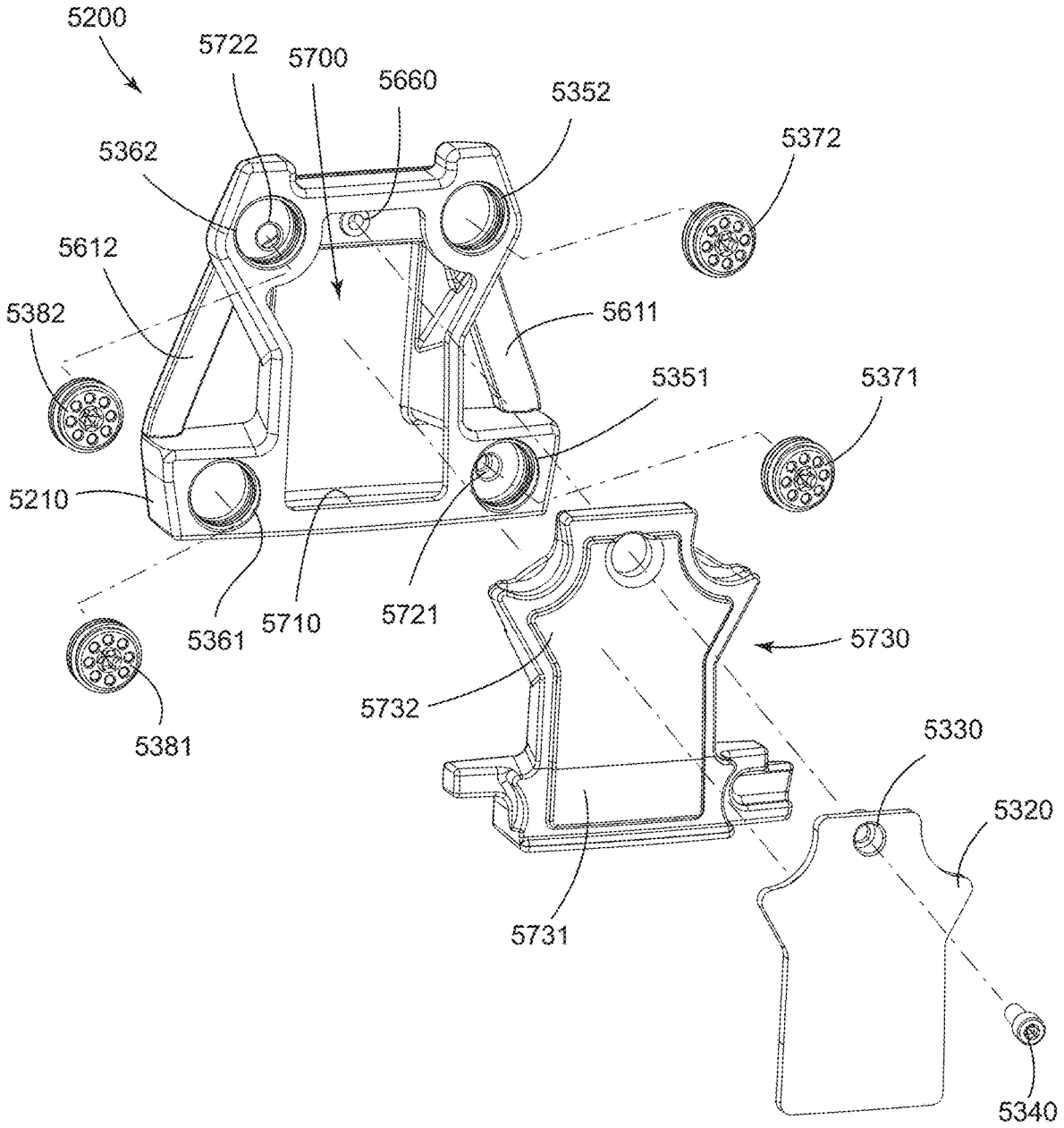
Figure 58:
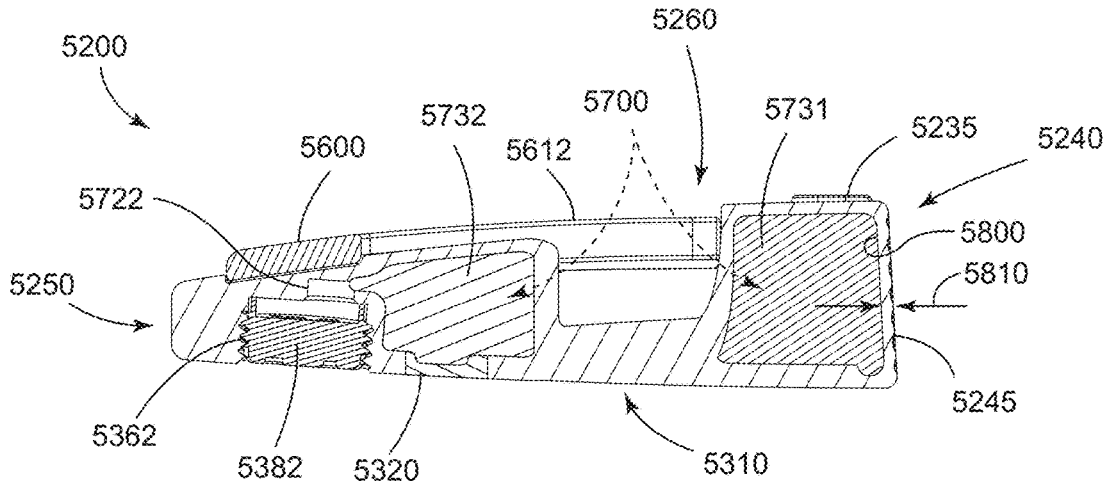

With reference to FIG. 49, the golf club head 4300 may have at least one cross-section where the filler material 4740 has a length 4920 in a front-to-rear direction greater than or equal to 70% of a length 4930 of the body portion 4310 in the front-to-rear direction. With continued reference to FIG. 49, the golf club head 4300 may have at least one cross-section where the filler material 4740 has a length 4940 in a top-to-sole direction greater than or equal to 80% of a length 4950 of the body portion 4310 in the top-to-sole direction. With reference to FIG. 51, the golf club head 4300 may have at least one cross-section where the filler material 4740 has a length 5100 in a toe-to-heel direction greater than or equal to 80% of a length 5110 of the body portion 110 in the toe-to-heel direction. The apparatus, methods, and articles of manufacture described herein are not limited in this regard.

The filler material 4740 may have a density less than a density of the body portion 4310 to allow for more discretionary mass to be allocated to other areas of the golf club head 4300. With respect to the present example, the filler material 4740 may have a fill volume ($V_f$) greater than or equal to 37% of a total volume ($V_t$) of the golf club head 4300 and a fill mass ($M_f$) less than or equal 8% of a total mass ($M_t$) of the golf club head 4300. In one example, the total volume ($V_t$) of the golf club head 4300 may be greater than or equal to 3.60 inch$^3$ (58.993 cm$^3$) and less than or equal to 4.00 inch$^3$ (65.548 cm$^3$) and the total mass ($M_t$) of the golf club head 4300 may be greater than or equal to 325 grams and less than or equal to 355 grams. As described herein, selecting the filler material 4740 from a lightweight or low density material and increasing the fill volume ($V_f$) of the filler material 4740 relative to the total volume ($V_t$) of the golf club head 4300 may enable greater discretionary mass placement toward a periphery of the golf club head 4300 to optimize certain mass properties of the golf club head 4300 such as MOI, CG location, and mass balance while maintaining a suitable club head weight. In one example, a ratio between a percentage fill volume $$\left(\frac{Vf}{Vt} \times 100\right)$$

and a percentage fill mass $$\left(\frac{Mf}{Mt} \times 100\right)$$

of the filler material 4740 may be greater than or equal to 4.625 and the golf club head 4300 may have a MOI greater than or equal to 4000 g·cm$^2$. In another example, the golf club head 4300 may have a MOI greater than or equal to 4250 g·cm$^2$. In yet another example, the golf club head 4300 may have a MOI greater than or equal to 4500 g·cm$^2$. The apparatus, methods, and articles of manufacture described herein are not limited in this regard.

As described herein, the golf club head 4300 may include a weighting system that may utilize a plurality of weight ports (e.g., toe-side weight port 4441 and heel-side weight port 4442) and corresponding interchangeable weight portions (e.g., weight portions 4451 and 4452) to adjust the mass properties of the golf club head 4300. Additionally, as described herein, the hosel bore 4335 may be configured to receive any of the hosel types described herein to further adjust the mass properties of the golf club head 4300. The apparatus, methods, and articles of manufacture described herein are not limited in this regard.

In the example of FIGS. 52-61, a golf club head 5200 is generally shown as a third type of mallet putter. The golf club head 5200 may include a body portion 5210 having a toe portion 5220, a heel portion 5230, a hosel bore 5235 located at the heel portion 5230, a front portion 5240, a face portion 5245 located at the front portion 5240, a rear portion 5250, a top portion 5260, and a sole portion 5310. The body portion 5210 may be made from any of the body materials described herein or described in any of the incorporated by reference patent documents. The golf club head 5200 may also include a crossbar portion 5270 coupled to the body portion 5210. The crossbar portion 5270 may include a central body portion 5600 and a pair of diverging arms 5611 and 5612 extending from the central body portion 5600. Diverging arms 5611 and 5612 may each include a projection (e.g., shown as projections 5621 and 5622) received in a complementary notch (e.g., shown as notches 5631 and 5632) in a back wall portion 5640 of the body portion 5210. The central body portion 5600 may be received in a complementary recess 5650 at the rear portion 5250 of the body portion 5210. The central body portion 5600 may include a central port 5660 received through a complementary opening 5670 in the recess 5650 leading into an interior cavity 5700 within the body portion 5210. The interior cavity 5700 may interface with an opening 5710 at the sole portion 5310. A sole plate 5320 may be coupled to the body portion 5210 to close the opening 5710. In one example, the sole plate 5320 may be welded to the sole portion 5310 or otherwise attached thereto using adhesive and/or mechanical fasteners. The sole plate 5320 may include a through-port 5330 concentrically aligned with the central port 5660 to enable the crossbar portion 5270 to be attached to the body portion 5210 via a mechanical faster 5340 received in the through-port 5330 and threadedly engaged to the central port 5660. The crossbar portion 5270 and the sole plate 5320 may be made from a material similar to or different from a material of the body portion 5210. In one example, the sole plate 5320 may be made from a material having a density less than a density of the body portion 5210 to enable greater discretionary mass placement toward a periphery of the golf club head 5200. In contrast, the crossbar portion 5270 may be made from a material having a density higher than a density of a material of the body portion 5210 to increase a peripheral mass of the golf club head 5200 and shift a CG location rearward. The apparatus, methods, and articles of manufacture described herein are not limited in this regard.

The body portion 5210 may include a plurality of weight ports (e.g., shown as toe-side weight ports 5351 and 5352 and heel-side weight ports 5361 and 5362) each configured to receive an interchangeable weight portion (e.g., shown as weight portions 5371, 5372, 5381, and 5382) similar to the weight ports and the weight portions of any of the golf club heads described herein or described in any of the incorporated by reference patent documents. In one example, toe-side weight port 5351 and heel-side weight port 5362 may each include an opening (e.g., shown as openings 5721 and 5722) that interfaces with the interior cavity 5700. In other examples, openings 5721 and 5722 may be located in any two weight ports of the plurality of weight ports. The interior cavity 5700 may be partially or entirely filled with a filler material 5730 that may be injectable into the interior cavity 5700 via one of openings 5721 and 5722 while the other one of openings 5721 and 5722 may expel air and any excess filler material 5730. In the present example, the filler material 5730 may include a plurality of filler materials (e.g., shown as first filler material 5731 and second filler material 5732). The first filler material 5731 may be disposed behind the face portion 5245 and the second filler material 5732 may be located aft of the first filler material 5731. The first filler material 5731 and the second filler material 5732 may have different mass, density, physical properties, and performance properties. In one example, the first filler material 5731 may include a solid polymer material to reinforce the face portion 5245 whereas the second filler material 5732 may include a lower density foam polymer material to impart greater discretionary mass to the golf club head 5200. The first filler material 5731 and the second filler material 5732 may have similar or different fill volumes. For instance, the second filler material 5732 may have a greater fill volume than the first filler material 5731 in an effort to optimize the discretionary mass of the golf club head 5200 without sacrificing structural support for the face portion 5245. Additionally, the first filler material 5731 and the second filler material 5732 may be separately provided to the interior cavity 5700 and may undergo separate curing processes to form the filler material 5730. Any one or both of the first filler material 5731 and the second filler material 5732 may be a solid piece manufactured in the shape of the interior cavity 5700 so as to be insertable into the interior cavity 5700. Openings 5721 and 5722 may be closed by attaching a weight portion (e.g., weight portions 5371 and 5382) to the corresponding weight ports (e.g., toe-side weight port 5351 and heel-side weight port 5362) to enclose the interior cavity 5700. The apparatus, methods, and articles of manufacture described herein are not limited in this regard.

The filler material 5730, including the first filler material 5731 and the second filler material 5732, may include any of the filler materials described herein or described in any of the incorporated by reference patent documents. The filler material 5730 may be disposed within the interior cavity 5700 to contact and reinforce a rear surface 5800 of the face portion 5245 to reduce face deformation and also dampen sound and vibration. Additionally, the filler material 5730 may partially encase the mechanical fastener 5340 to prevent it from becoming dislodged. The filler material 5730 may structurally support the cavity walls and the face portion 5245 of the golf club head 5200. Accordingly, the cavity walls may be relatively thin to accommodate a greater amount of the filler material 5730 and to provide increased discretionary mass, and the face portion 5245 may be relatively thin to provide a greater flexibility or rebounding effect. For example, one or more cavity walls may have a thickness (constant or average) less than or equal to 0.055 inch (1.397 mm). Particularly, the face portion 5245 may have a face thickness 5810 in one or more areas less than or equal to 0.055 inch (1.397 mm) (e.g., first face thickness 1240) and less than or equal to 0.045 inch (1.143 mm) (e.g., second face thickness 1260) as described herein with reference to FIG. 12. The face portion 5245 may be similar in many respects to any face portion (e.g., face portion 145) described herein or described in any of the incorporated by reference patent documents. The apparatus, methods, and articles of manufacture described herein are not limited in this regard.

Figure 59:
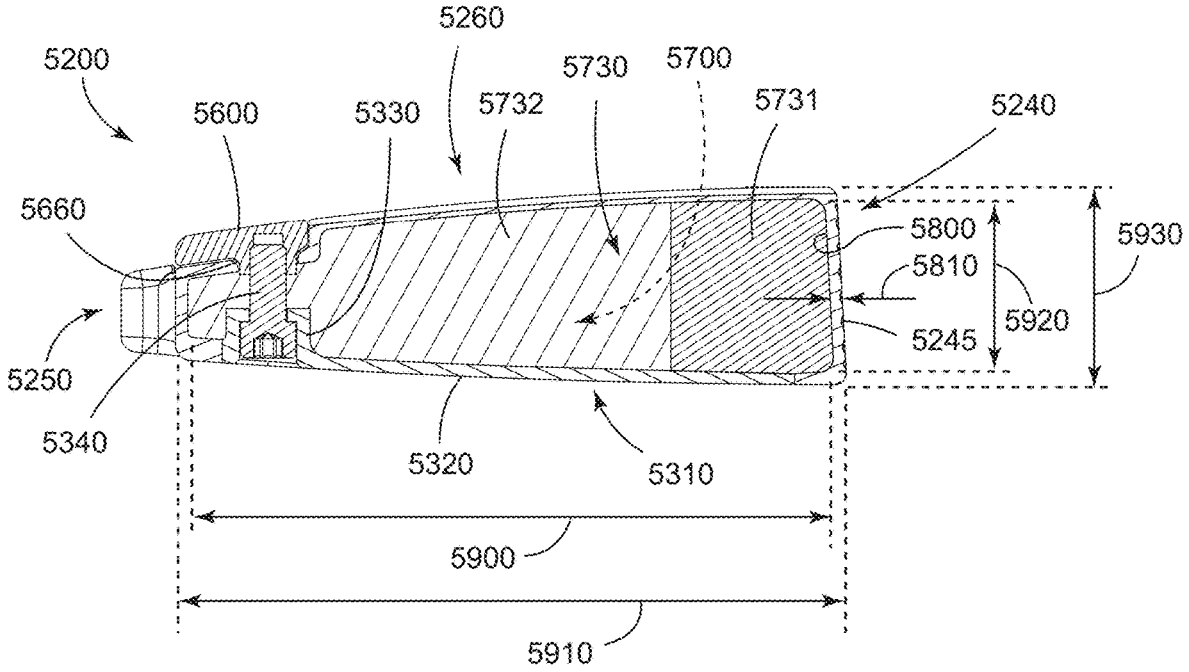
Figure 60:
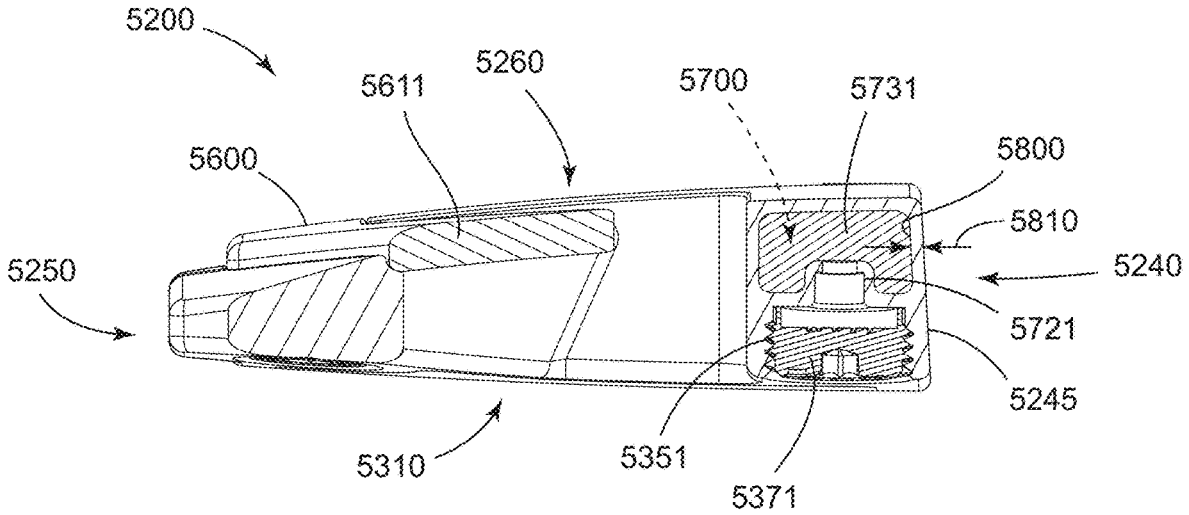
Figure 61:
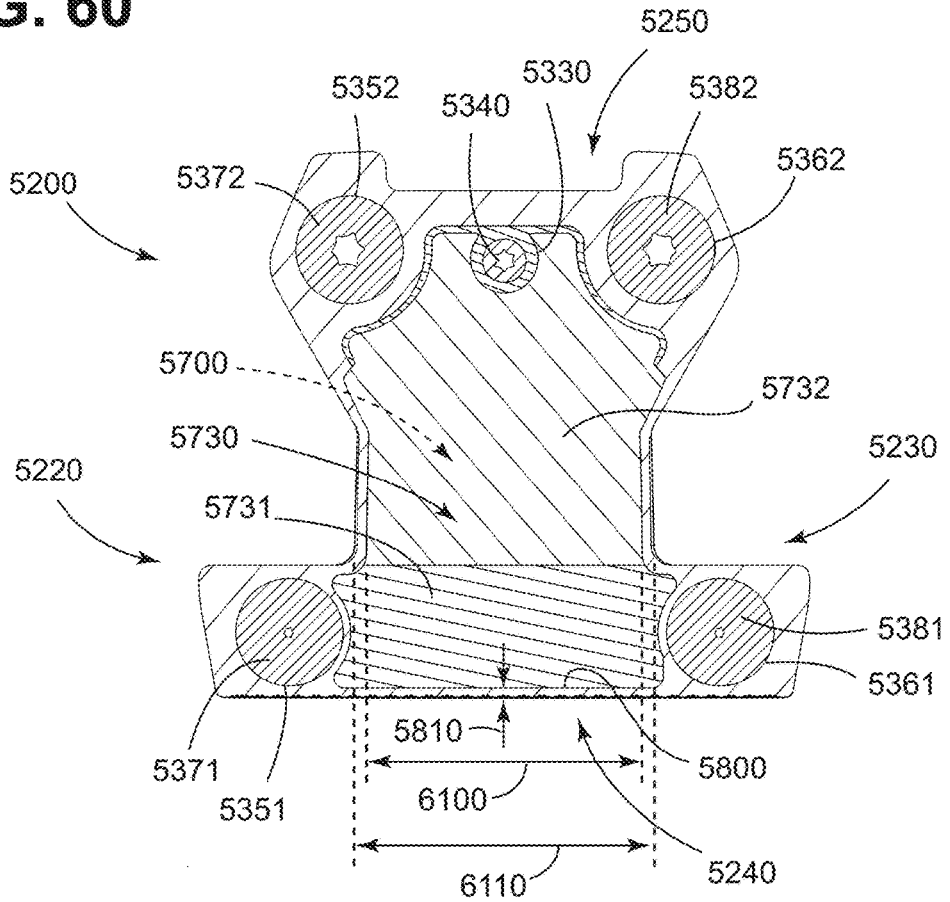
Figure 62:
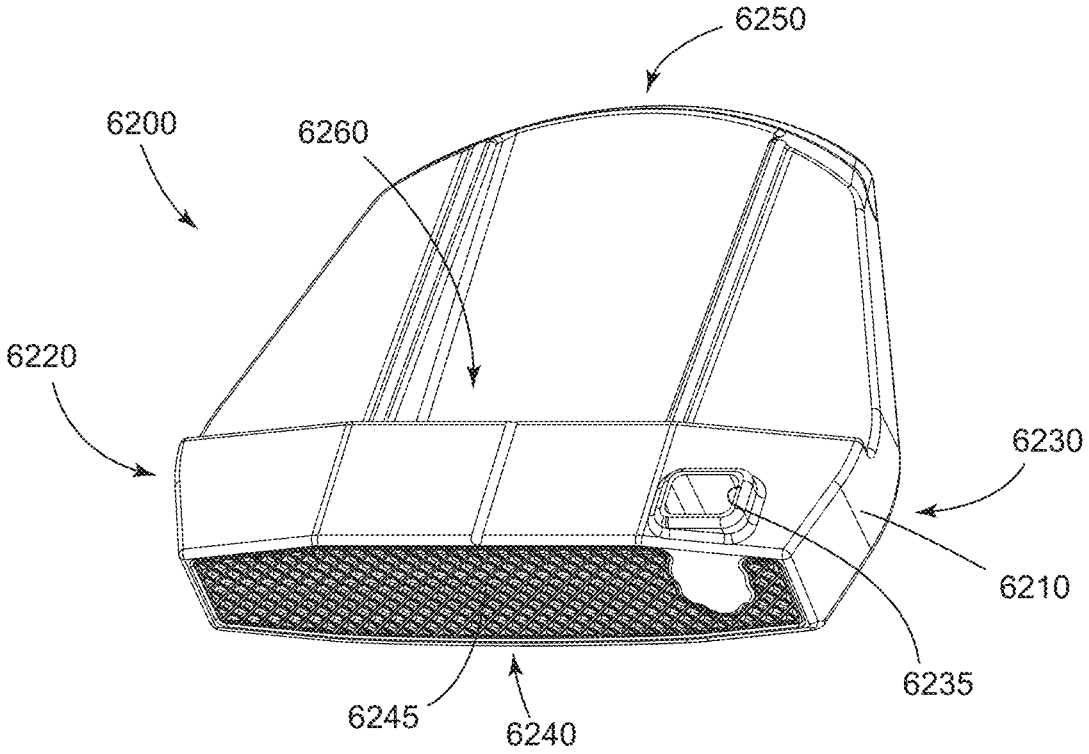
FIGS. 62, 63, 64, 65, 66, 67, 68, 69, and 70 depict a perspective front view, a perspective bottom view, a front elevational view, a rear elevational view, an exploded bottom perspective view, a perspective cross-sectional view (along line 67-67 of FIG. 65), a perspective cross-sectional view (along line 68-68 of FIG. 65), a perspective cross-sectional view (along line 69-59 of FIG. 65), and a perspective cross-sectional view (along line 70-70 of FIG. 65), respectively, of a golf club head according to an embodiment of the apparatus, methods, and articles of manufacture described herein.
Figure 63:
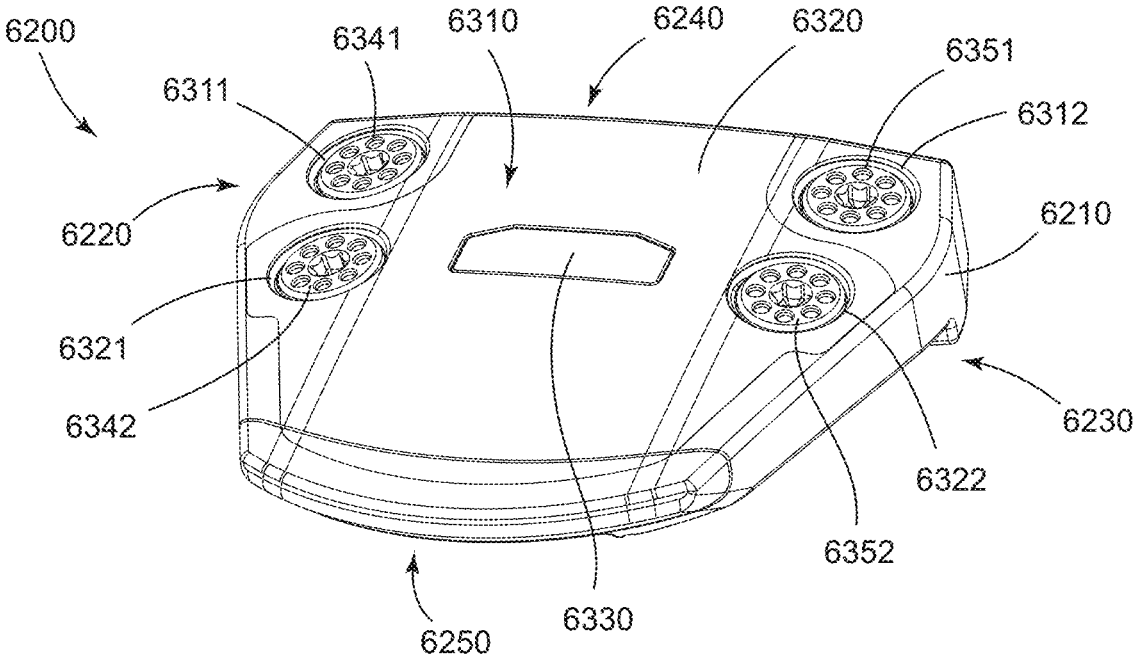
Figure 64:
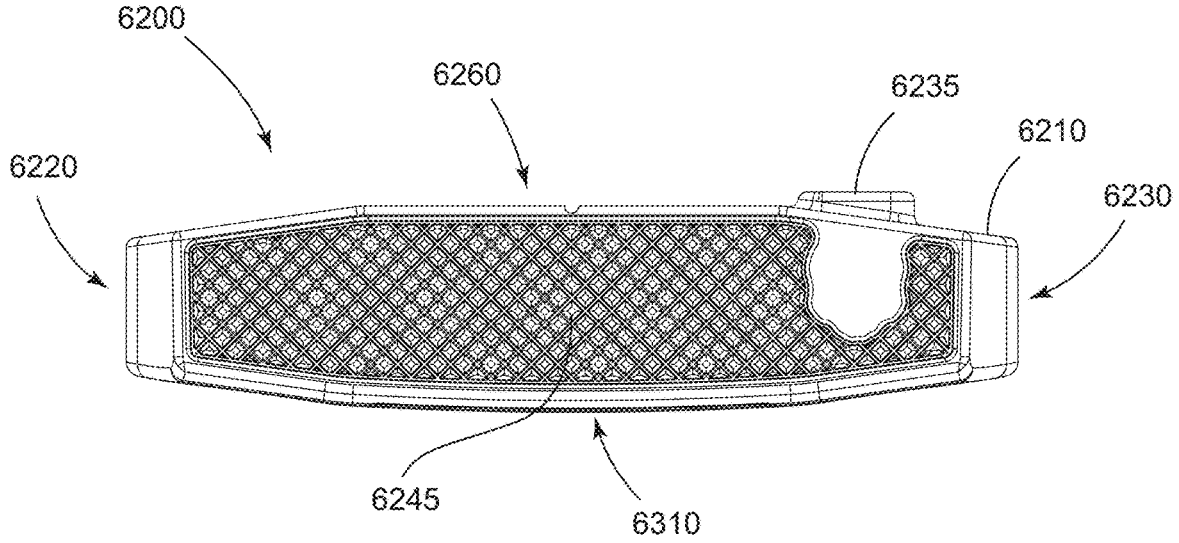
Figure 65:
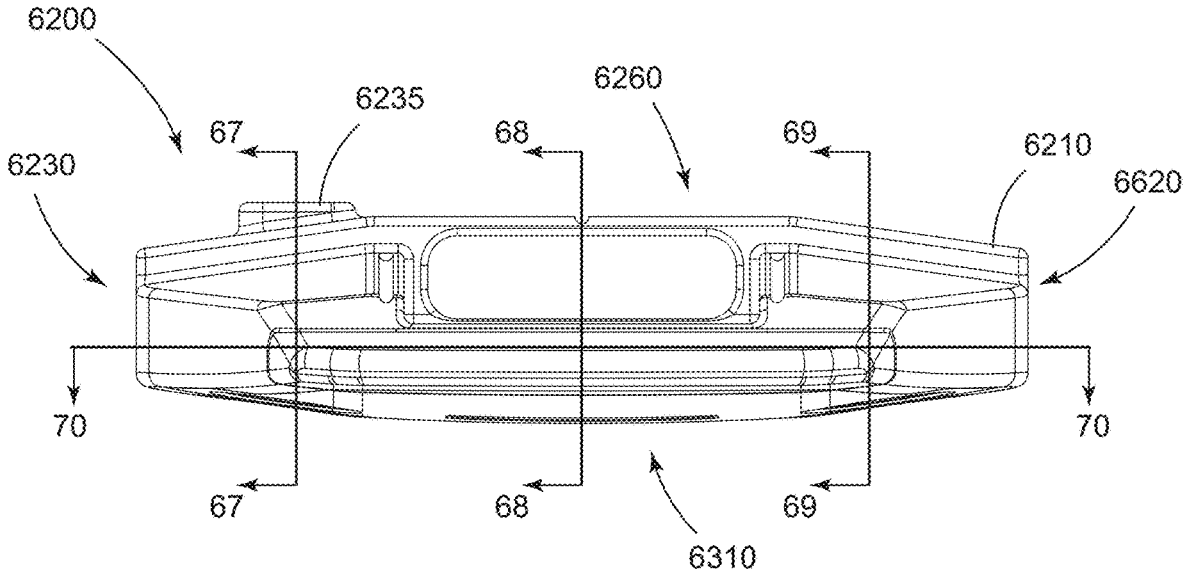
Figure 66:
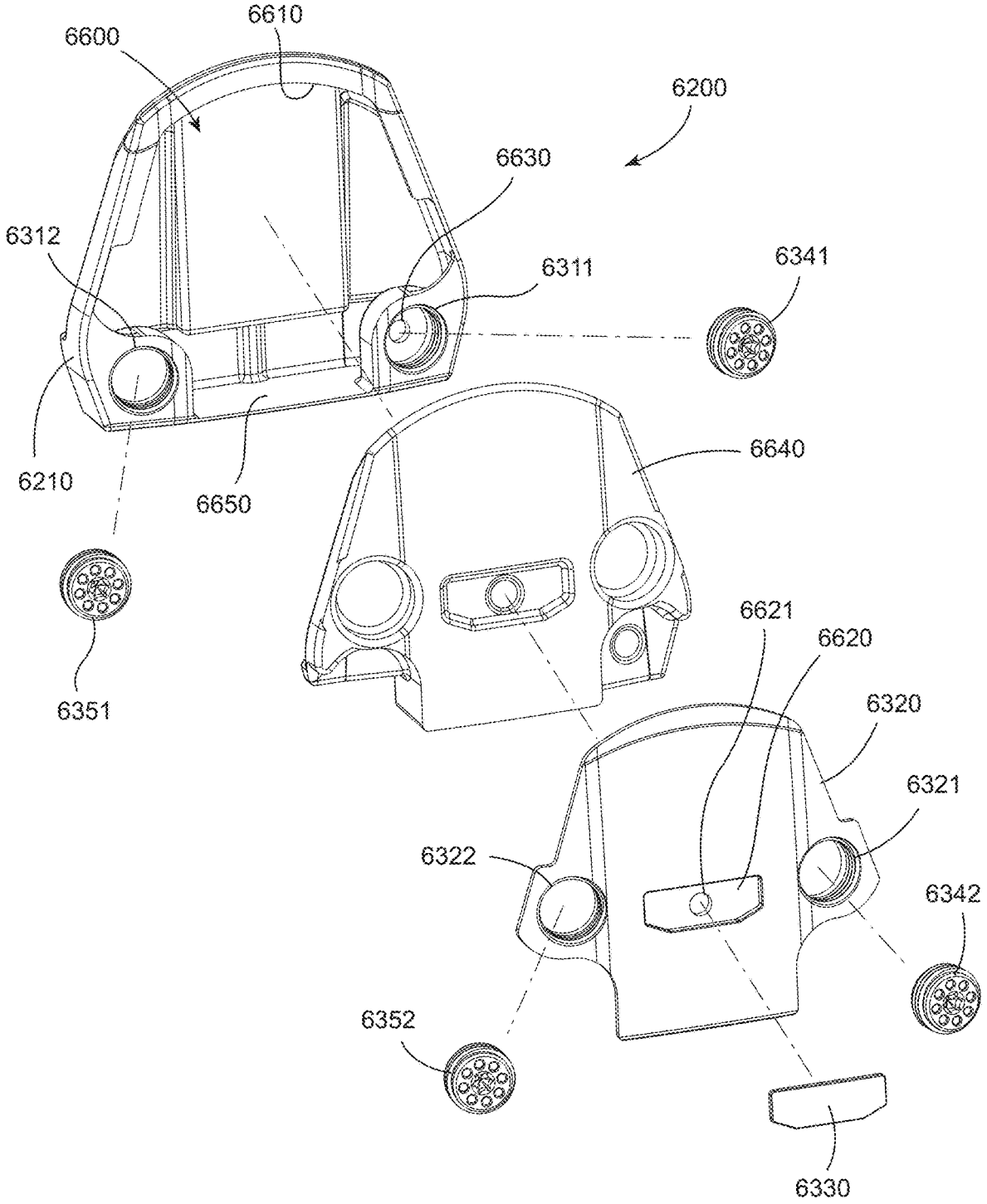
Figure 67:
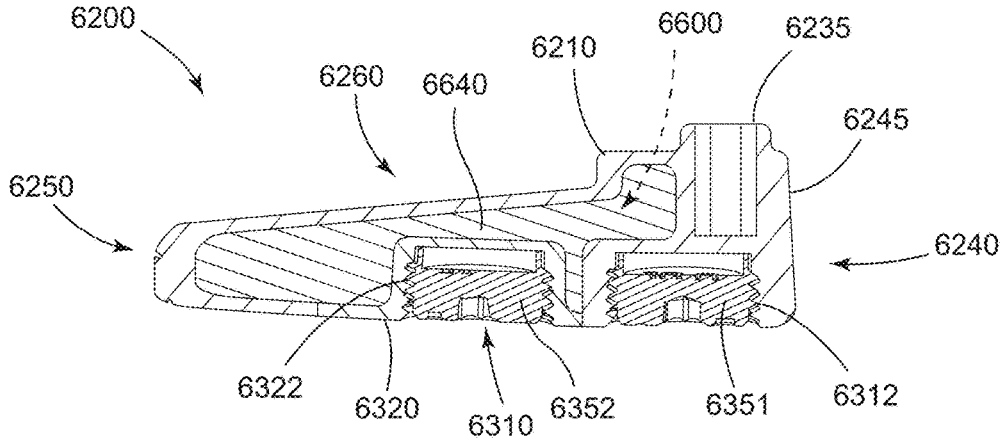

With reference to FIG. 59, the golf club head 5200 may have at least one cross-section where the filler material 5730 has a length 5900 in a front-to-rear direction greater than or equal to 90% of a length 5910 of the body portion 5210 in the front-to-rear direction. With continued reference to FIG. 59, the golf club head 5200 may have at least one cross-section where the filler material 5730 has a length 5920 in a top-to-sole direction greater than or equal to 80% of a length 5930 of the body portion 5210 in the top-to-sole direction. With reference to FIG. 61, the golf club head 5200 may have at least one cross-section wherein the filler material 5730 has a length 6100 in a toe-to-heel direction greater than or equal to 90% of a length 6110 of the body portion 5210 in the toe-to-heel direction. The apparatus, methods, and articles of manufacture described herein are not limited in this regard.

The filler material 5730 may have a density less than a density of the body portion 5210 to allow for more discretionary mass to be allocated to other areas of the golf club head 5200. With respect to the present example, the filler material 5730 may have a fill volume ($V_f$) greater than or equal to 56% of a total volume ($V_t$) of the golf club head 5200 and a fill mass ($M_f$) less than or equal 7% of a total mass ($M_t$) of the golf club head 5200. In one example, the total volume ($V_t$) of the golf club head 5200 may be greater than or equal to 5.00 inch$^3$ (81.935 cm$^3$) and less than or equal to 6.00 inch$^3$ (98.322 cm$^3$) and the total mass ($M_t$) of the golf club head 5200 may be greater than or equal to 325 grams and less than or equal to 375 grams. As described herein, selecting the filler material 5730 from a lightweight or low density material and increasing the fill volume ($V_f$) of the filler material 5730 relative to the total volume ($V_t$) of the golf club head 5200 may enable greater discretionary mass placement toward a periphery of the golf club head 5200 to optimize certain mass properties of the golf club head 5200 such as MOI, CG location, and mass balance while maintaining a suitable club head weight. In one example, a ratio between a percentage fill volume $$\left(\frac{Vf}{Vt} \times 100\right)$$

and a percentage fill mass $$\left(\frac{Mf}{Mt} \times 100\right)$$

of the filler material 5730 may be greater than or equal to 8 and the golf club head 5200 may have a MOI greater than or equal to 5000 g·cm$^2$. In another example, the golf club head 5200 may have a MOI greater than or equal to 5250 g·cm$^2$. In yet another example, the golf club head 5200 may have a MOI greater than or equal to 5500 g·cm$^2$. The apparatus, methods, and articles of manufacture described herein are not limited in this regard.

As described previously herein, the golf club head 5200 may include a weighting system that utilizes a plurality of weight ports (e.g., toe-side weight ports 5351 and 5352 and heel-side weight ports 5361 and 5362) and corresponding interchangeable weight portions (e.g., weight portions 5371, 5372, 5381, and 5382) to adjust the mass properties of the golf club head 5200. Additionally, as described herein, the hosel bore 5235 may be configured to receive any of the hosel types described herein to further adjust the mass properties of the golf club head 5200. The apparatus, methods, and articles of manufacture described herein are not limited in this regard.

In the example of FIGS. 62-70, a golf club head 6200 is generally shown as a fourth type of mallet putter. The golf club head 6200 may include a body portion 6210 having a toe portion 6220, a heel portion 6230, a hosel bore 6235 located at the heel portion 6230, a front portion 6240, a face portion 6245 located at the front portion 6240, a rear portion 6250, a top portion 6260, and a sole portion 6310. The body portion 6210 may be made from any of the body materials described herein or described in any of the incorporated by reference patent documents. The body portion 6210 may define an interior cavity 6600 that interfaces with an opening 6610 at the sole portion 6310. A sole plate 6320 may be coupled to the body portion 6210 to close the opening 6610. The sole plate 6320 may be made from a material similar to or different from a material of the body portion 6210. In one example, the sole plate 6320 may be made from a material having a density less than a density of the body portion 6210 to enable greater discretionary mass placement toward a periphery of the golf club head 6200. The sole plate 6320 may be welded to the body portion 6210 or otherwise attached thereto using adhesive and/or mechanical fasteners. The outer surface of the sole plate 6320 may include a central depression 6620 that on the inner surface of the sole plate 6320 may define a raised central portion that may extend into the interior cavity 6600. The sole plate 6320 may also include a pair of weight ports (e.g., shown as toe-side weight port 6321 and heel-side weight port 6322) extending into the interior cavity 6600. The central depression 6620 may include an opening 6621 that interfaces with the interior cavity 6600. The body portion 6210 may also include a pair of weight ports (e.g., shown as toe-side weight port 6311 and heel-side weight port 6312) at the sole portion 6310, one of which (e.g., toe-side weight port 6311) having an opening 6630 that interfaces with the interior cavity 6600. The interior cavity 6600 may be partially or entirely filled with a filler material 6640 that may be injectable into the interior cavity 6600 via one of openings 6621 and 6630 while the other one of openings 6621 and 6630 may serve to expel air and any excess filler material 6640. The filler material 6640 may harden without a curing process or later undergo a curing process to harden. The filler material 6640 may be a solid piece manufactured in the shape of the interior cavity 6600 so as to be insertable into the interior cavity 6600. Opening 6621 may be closed by a complementary cover portion 6330 received in the central depression 6620 while opening 6630 may be closed by an interchangeable weight portion (e.g., shown as weight portion 6341) received in toe-side weight port 6311, thereby closing the interior cavity 6600. Additionally, an interchangeable weight portion (e.g., shown as weight portions 6342, 6351, and 6352) may be received in toe-side weight port 6321, heel-side weight port 6312, and heel-side weight port 6322. In one example, cover portion 6330 may be configured as a lightweight decorative badge attached to the central depression 6620 using adhesive. The apparatus, methods, and articles of manufacture described herein are not limited in this regard.

The filler material 6640 may include any of the filler materials described herein or described in any of the incorporated by reference patent documents. The filler material 6640 may be disposed within the interior cavity 6600 to contact and reinforce a rear surface 6650 of the face portion 6245 to reduce face deformation and may also dampen sound and vibration. Additionally, the filler material 6640 may at least partially encase the central depression 6620. The filler material 6640 may structurally support the cavity walls and the face portion 6245 of the golf club head 6200. Accordingly, the cavity walls may be relatively thinner to accommodate a greater amount of the filler material 6640 in the interior cavity 6600 and to provide increased discretionary mass, and the face portion 6245 may be relatively thin to provide a greater flexibility or rebounding effect. For example, one or more cavity walls may have a thickness (constant or average) less than or equal to 0.055 inch (1.397 mm). Particularly, the face portion 6245 may have a face thickness 6800 in one or more areas less than or equal to 0.055 inch (1.397 mm) (e.g., first face thickness 1240) and less than or equal to 0.045 inch (1.143 mm) (e.g., second face thickness 1260) as described herein with reference to FIG. 12. The face portion 6245 may be similar in many respects to any face portion (e.g., face portion 145) described herein or described in any of the incorporated by reference patent documents. The apparatus, methods, and articles of manufacture described herein are not limited in this regard.

Figure 68:
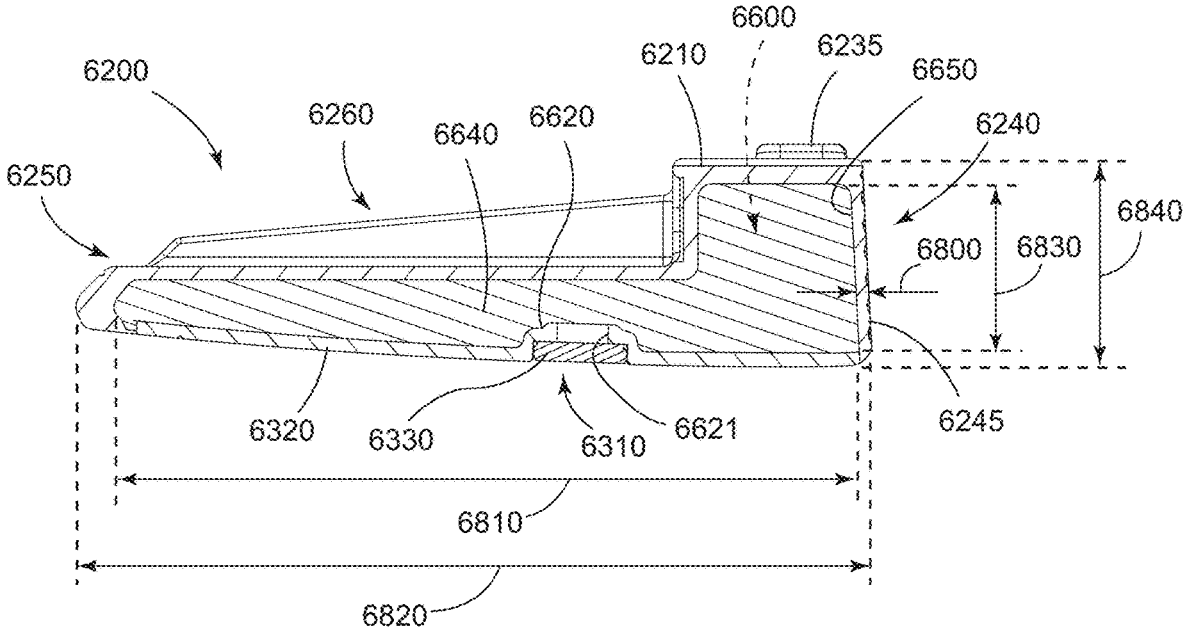
Figure 69:
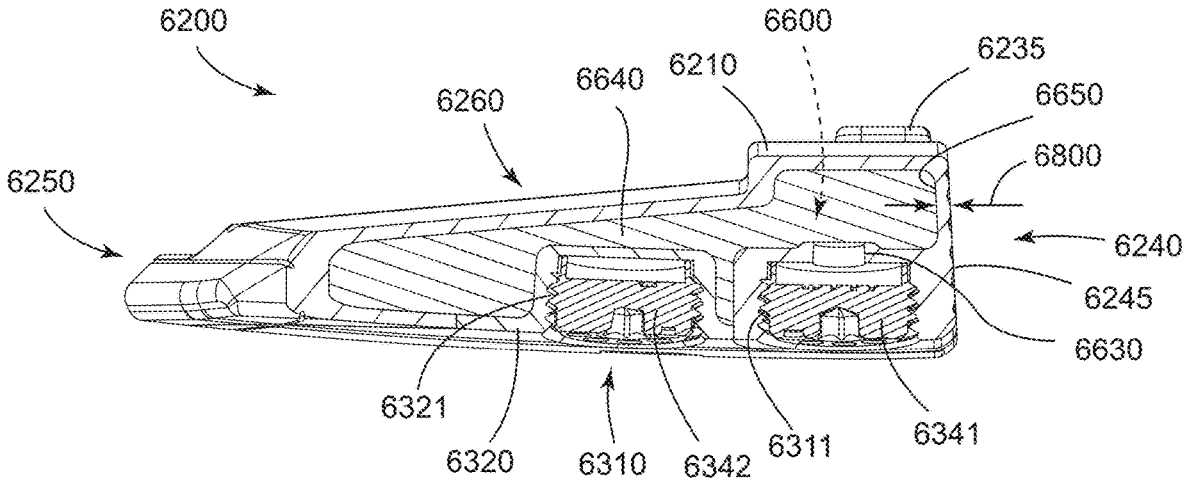
Figure 70:
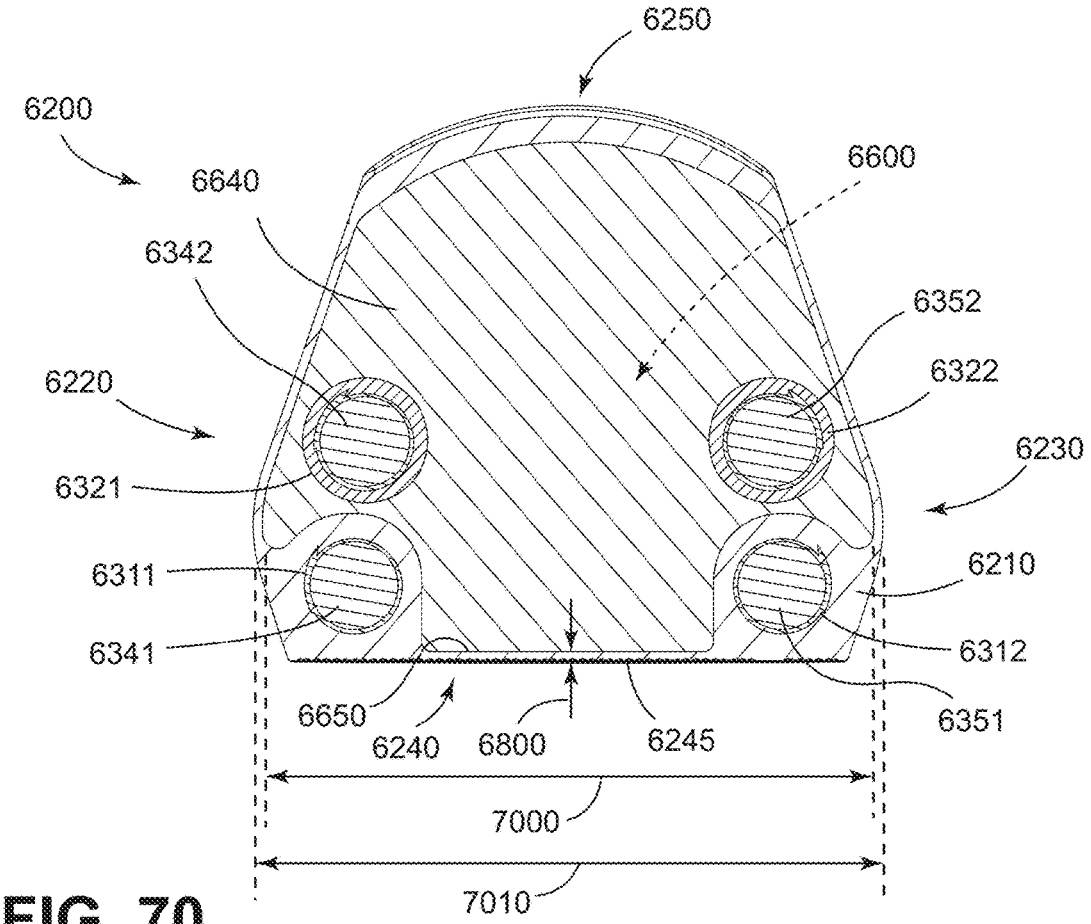
Figure 71:
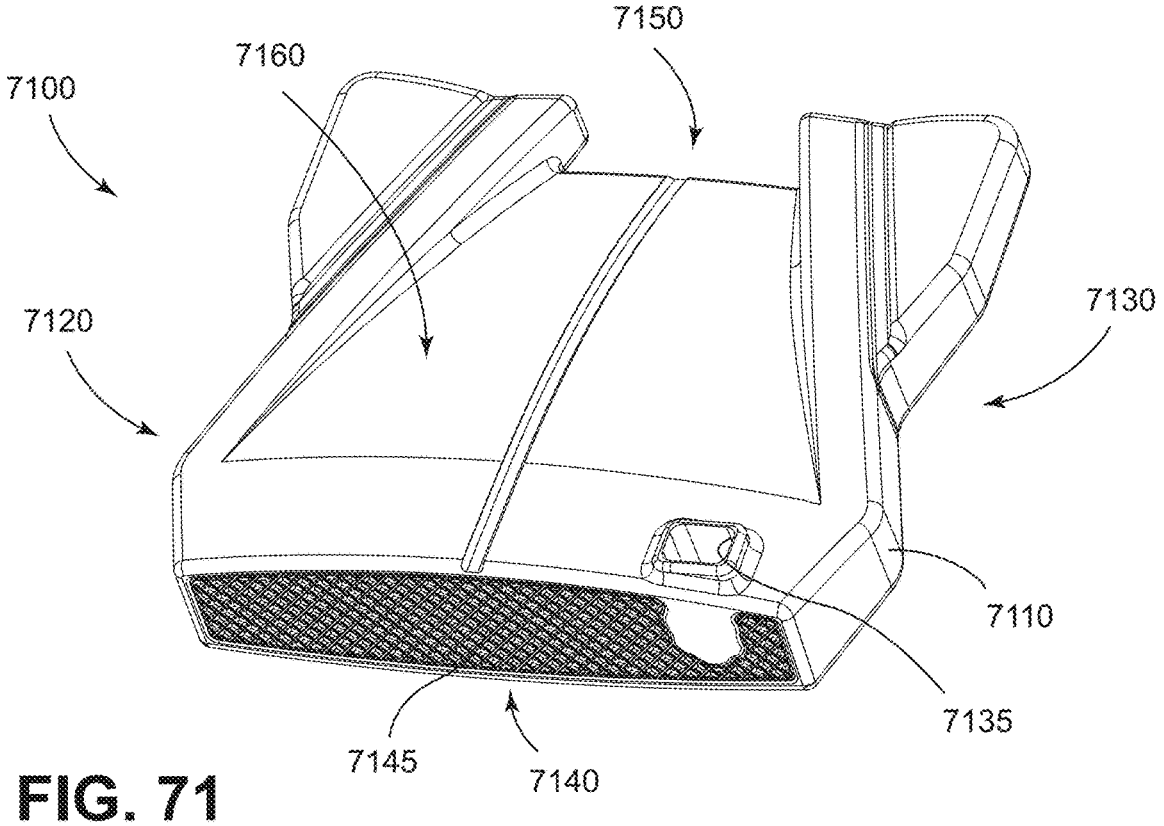
FIGS. 71, 72, 73, 74, 75, 76, 77, 78, and 79 depict a perspective front view, a perspective bottom view, a front elevational view, a rear elevational view, an exploded bottom perspective view, a perspective cross-sectional view (along line 76-76 of FIG. 74), a perspective cross-sectional view (along line 77-77 of FIG. 74), a perspective cross-sectional view (along line 78-78 of FIG. 74), and a perspective cross-sectional view (along line 79-79 of FIG. 74), respectively, of a golf club head according to an embodiment of the apparatus, methods, and articles of manufacture described herein.
Figure 72:
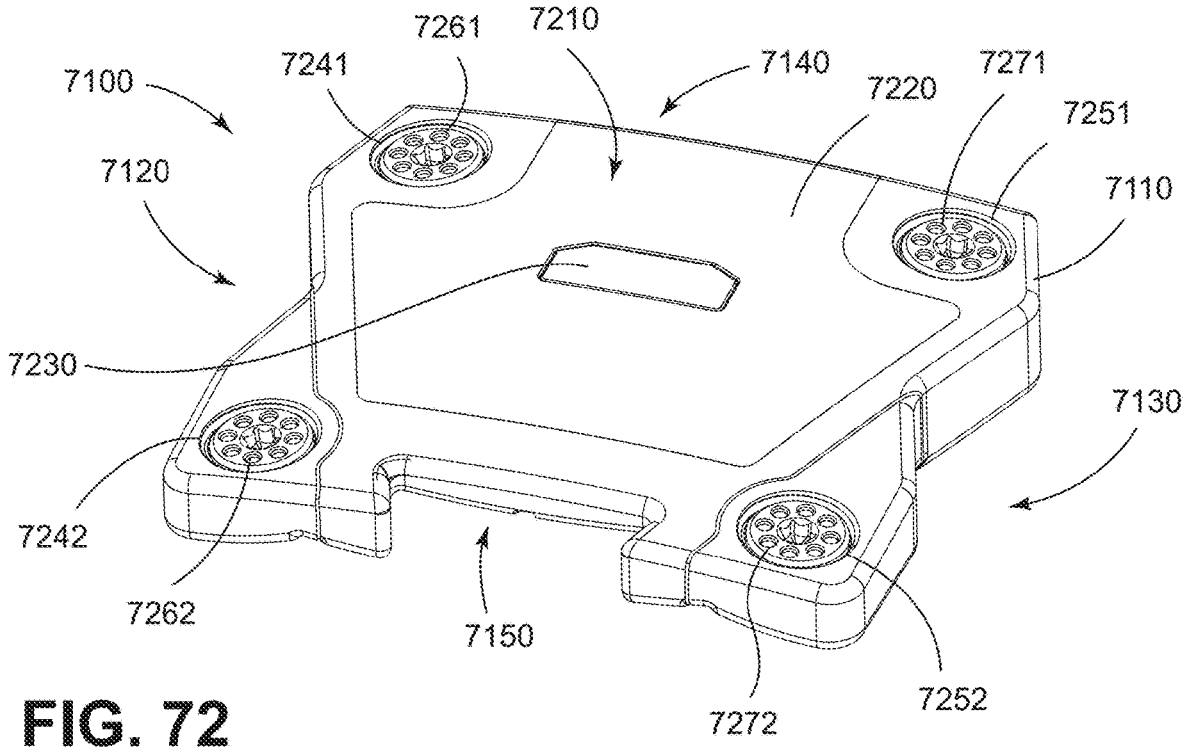
Figure 73:
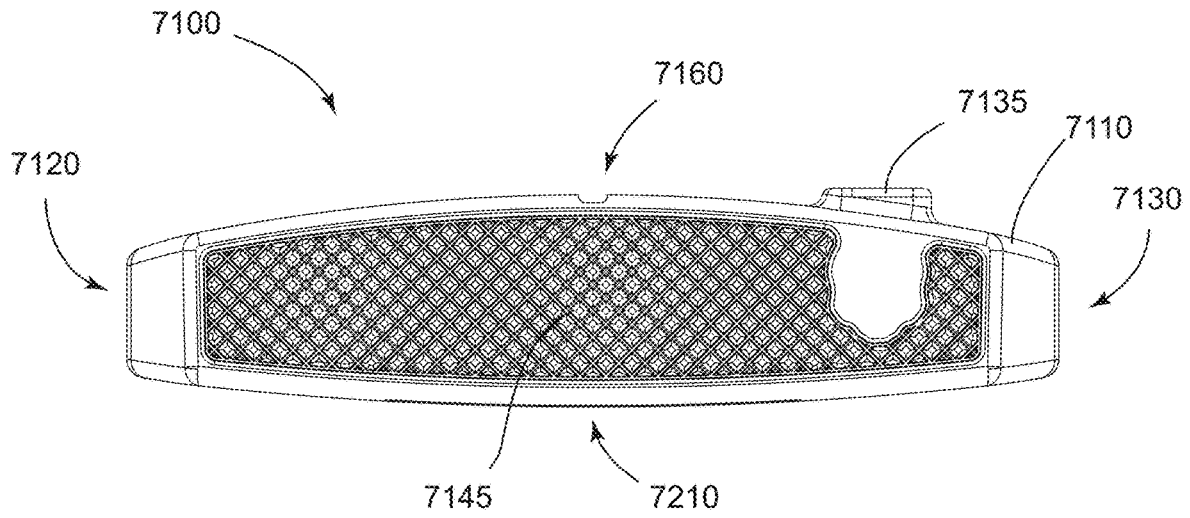
Figure 74:
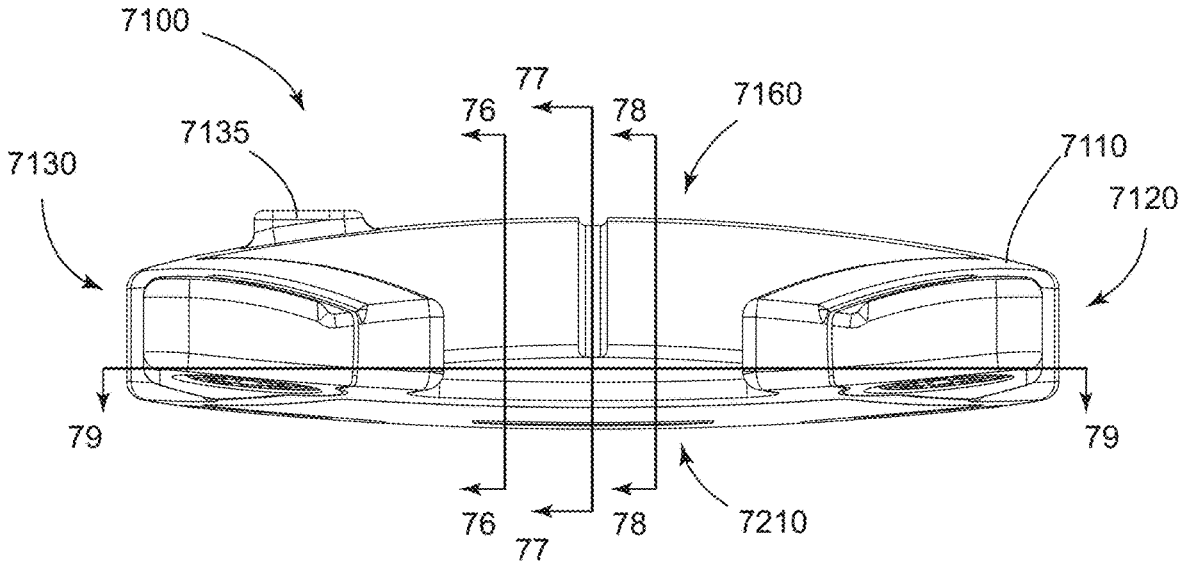
Figure 75:
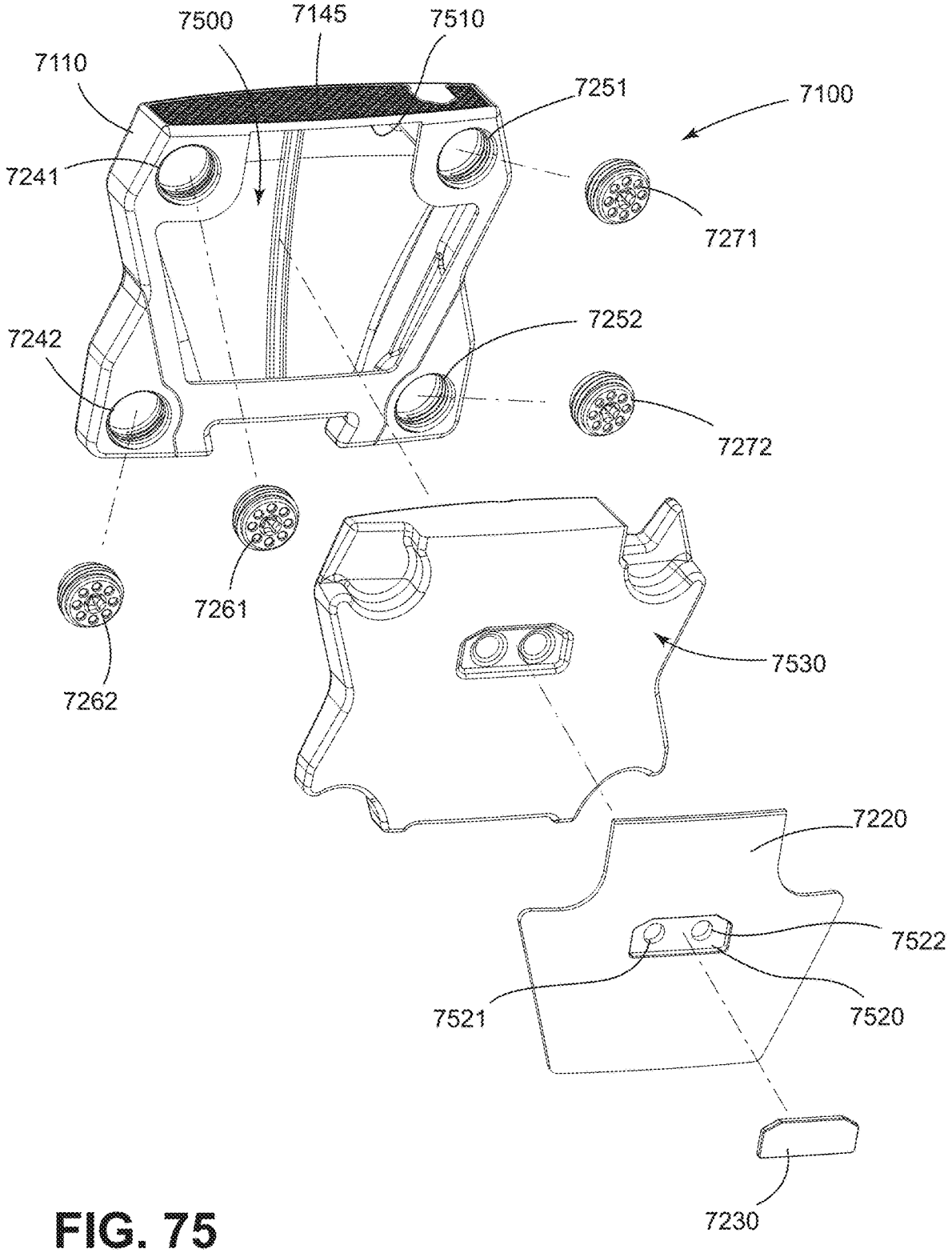
Figure 76:
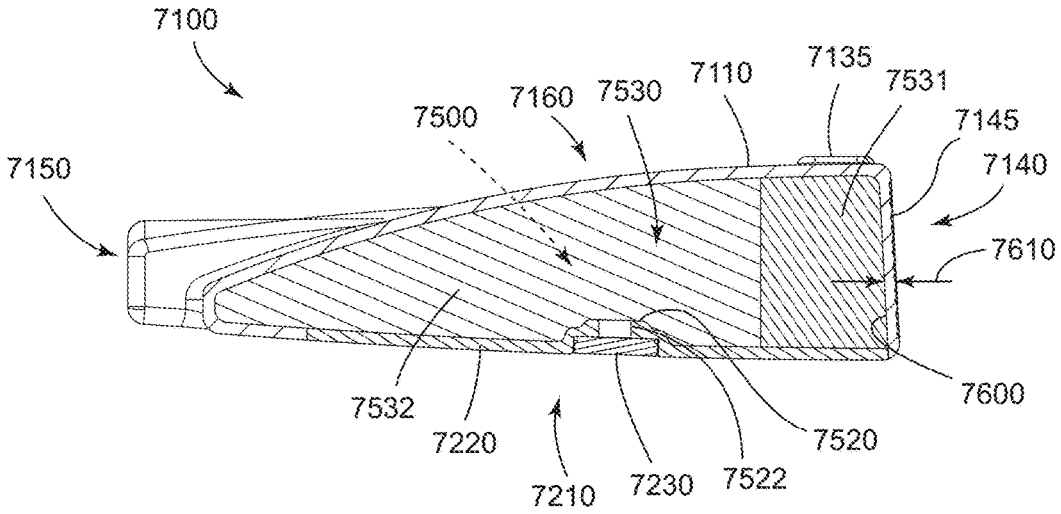

With reference to FIG. 68, the golf club head 6200 may have at least one cross-section where the filler material 6640 has a length 6810 in a front-to-rear direction greater than or equal to 90% of a length 6820 of the body portion 6210 in the front-to-rear direction. With continued reference to FIG. 68, the golf club head 6200 may have at least one cross-section where the filler material 6640 has a length 6830 in a top-to-sole direction greater than or equal to 80% of a length 6840 of the body portion 6210 in the top-to-sole direction. With reference to FIG. 70, the golf club head 6200 may have at least one cross-section where the filler material 6640 has a length 7000 in a toe-to-heel direction greater than or equal to 90% of a length 7010 of the body portion 6210 in the toe-to-heel direction. The apparatus, methods, and articles of manufacture described herein are not limited in this regard.

The filler material 6640 may have a density less than a density of the body portion 6210 to allow for more discretionary mass to be allocated to other areas of the golf club head 6200. With respect to the present example, the filler material 6640 may have a fill volume ($V_f$) greater than or equal to 57% of a total volume ($V_t$) of the golf club head 6200 and a fill mass ($M_f$) less than or equal 16% of a total mass ($M_t$) of the golf club head 6200. In one example, the total volume ($V_t$) of the golf club head 6200 may be greater than or equal to 4.50 inch$^3$ (73.742 cm$^3$) and less than or equal to 5.50 inch$^3$ (90.129 cm$^3$) and the total mass ($M_t$) of the golf club head 6200 may be greater than or equal to 330 grams and less than or equal to 360 grams. As described herein, selecting the filler material 6640 from a lightweight or low density material and increasing the fill volume ($V_f$) of the filler material 6640 relative to the total volume ($V_t$) of the golf club head 6200 may enable greater discretionary mass placement toward a periphery of the golf club head 6200 to optimize certain mass properties of the golf club head 6200 such as MOI, CG location, and mass balance while maintaining a suitable club head weight. In one example, a ratio between a percentage fill volume $$\left(\frac{Vf}{Vt}\times 100\right)$$

and a percentage fill mass $$\left(\frac{Mf}{Mt}\times 100\right)$$

of the filler material 6640 may be greater than or equal to 3.562 and the golf club head 6200 may have a MOI greater than or equal to 4200 g·cm$^2$. In another example, the golf club head 6200 may have a MOI greater than or equal to 4450 g·cm$^2$. In yet another example, the golf club head 6200 may have a MOI greater than or equal to 4700 g·cm$^2$. The apparatus, methods, and articles of manufacture described herein are not limited in this regard.

As described previously herein, the golf club head 6200 may include a weighting system that utilizes a plurality of weight ports (e.g., toe-side weight ports 6311 and 6321 and heel-side weight ports 6312 and 6322) and corresponding interchangeable weight portions (e.g., weight portions 6341, 6342, 6351, and 6352) to adjust the mass properties of the golf club head 6200. Additionally, as described herein, the hosel bore 6235 may be configured to receive any of the hosel types described herein to further adjust the mass properties of the golf club head 6200. The apparatus, methods, and articles of manufacture described herein are not limited in this regard.

In the example of FIGS. 71-79, a golf club head 7100 is generally shown as a fifth type of mallet putter. The golf club head 7100 may include a body portion 7110 having a toe portion 7120, a heel portion 7130, a hosel bore 7135 located at the heel portion 7130, a front portion 7140, a face portion 7145 located at the front portion 7140, a rear portion 7150, a top portion 7160, and a sole portion 7210. The body portion 7110 may be made from any of the body materials described herein or described in any of the incorporated by reference patent documents. The body portion 7110 may define an interior cavity 7500 that interfaces with an opening 7510 at the sole portion 7210. A sole plate 7220 may be coupled to the body portion 7110 to close the opening 7510. The sole plate 7220 may be made from a material similar to or different from a material of the body portion 7110. In one example, the sole plate 7220 may be made from a material having a density less than a density of a material of the body portion 7110 to enable greater discretionary mass placement toward a periphery of the golf club head 7100. The sole plate 7220 may be welded to the body portion 7110 or otherwise attached thereto using adhesive and/or mechanical fasteners. The outer surface of the sole plate 7220 may include a central depression 7520 that on the inner surface of the sole plate 7220 may define a central raised portion that may extend into the interior cavity 7500. The central depression 7520 may include a pair of openings (e.g., shown as openings 7521 and 7522) that each interface with the interior cavity 7500. The interior cavity 7500 may be partially or entirely filled with a filler material 7530 that may be injectable into the interior cavity 7500 via one of openings 7521 and 7522 while the other one of openings 7521 and 7522 may expel air and any excess filler material 7530. In one example, the filler material 7530 may include a first filler material 7531 and a second filler material 7532 similar in many respects to the first filler material 5731 and the second filler material 5732 of the golf club head 5200 of FIGS. 52-61. The first filler material 7531 and the second filler material 7532 may be separately provided to the interior cavity 7500 and may undergo separate curing processes to form the filler material 7530. Any of the first filler material 7531 and the second filler material 7532 may be a solid piece manufactured in the shape of the interior cavity so as to be insertable into the interior cavity. Openings 7521 and 7522 may be closed by a complementary cover portion 7230 received in the central depression 7520 to enclose the interior cavity 7500. In one example, the cover portion 7230 may be configured as a lightweight decorative badge and may be attached to the central depression 7520 using adhesive. The golf club head 7100 may further include a plurality of weight ports (e.g., shown as toe-side weight ports 7241 and 7242 and heel-side weight ports 7251 and 7252) located at the sole portion 7210 and each configured to receive a weight portion (e.g., shown as weight portions 7261, 7262, 7271, and 7272) similar to any of the weight ports and weight portions described herein or described in any of the incorporated by reference patent documents. The apparatus, methods, and articles of manufacture described herein are not limited in this regard.

The filler material 7530, including the first filler material 7531 and the second filler material 7532, may include any of the filler materials described herein or described in any of the incorporated by reference patent documents. The filler material 7530 may be disposed within the interior cavity 7500 to contact and reinforce a rear surface 7600 of the face portion 7145 to reduce face deformation and also dampen sound and vibration. Additionally, the filler material 7530 may at least partially encase the central depression 7520. The filler material 7530 may structurally support the cavity walls and the face portion 7145 of the golf club head 7100. Accordingly, the cavity walls may be relatively thin to accommodate a greater amount of the filler material 7530 in the interior cavity 7500 and to provide increased discretionary mass, and the face portion 7145 may be relatively thin to provide a greater flexibility or rebounding effect. For example, one or more cavity walls may have a thickness (constant or average) less than or equal to 0.055 inch (1.397 mm). Particularly, the face portion 7145 may have a face thickness 7610 in one or more areas less than or equal to 0.055 inch (1.397 mm) (e.g., first face thickness 1240) and less than or equal to 0.045 inch (1.143 mm) (e.g., second face thickness 1260) as described herein with reference to FIG. 12. The apparatus, methods, and articles of manufacture described herein are not limited in this regard.

Figure 77:
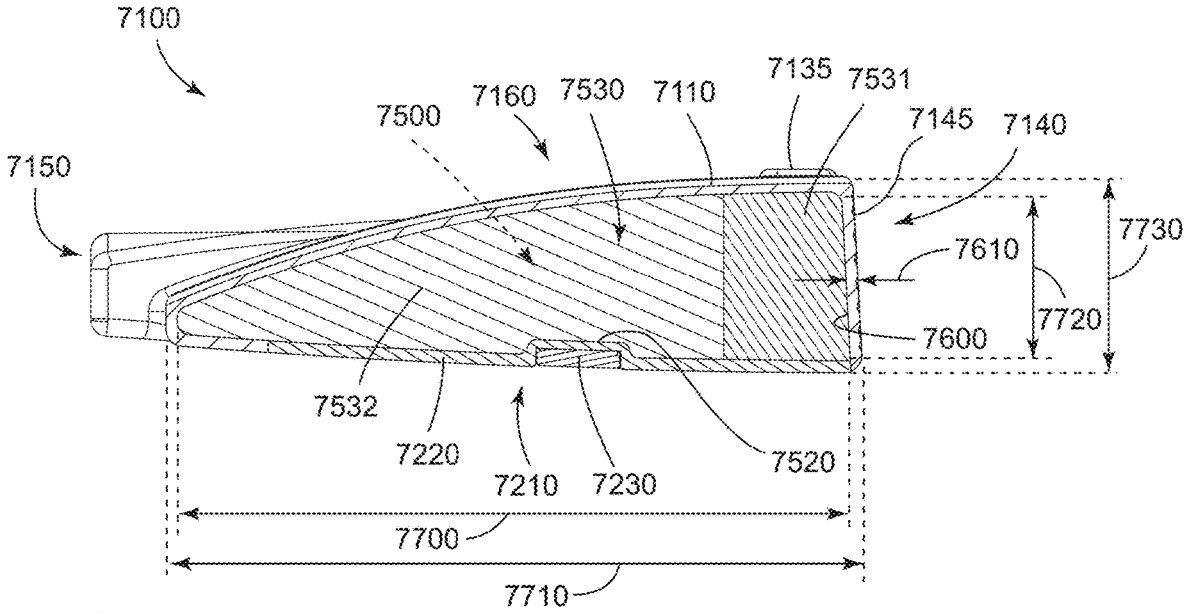
Figure 78:
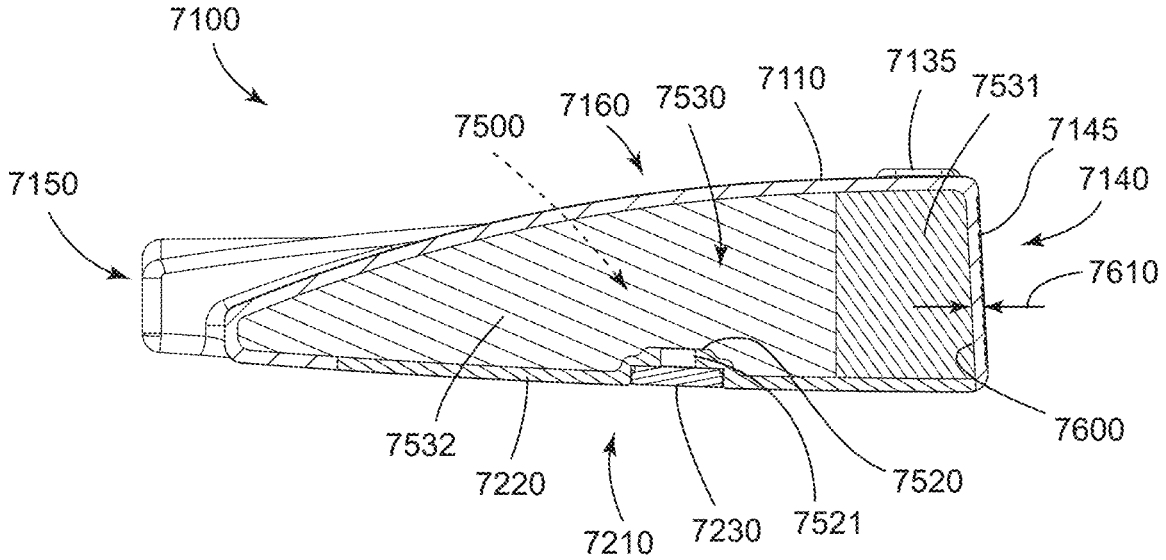
Figure 79:
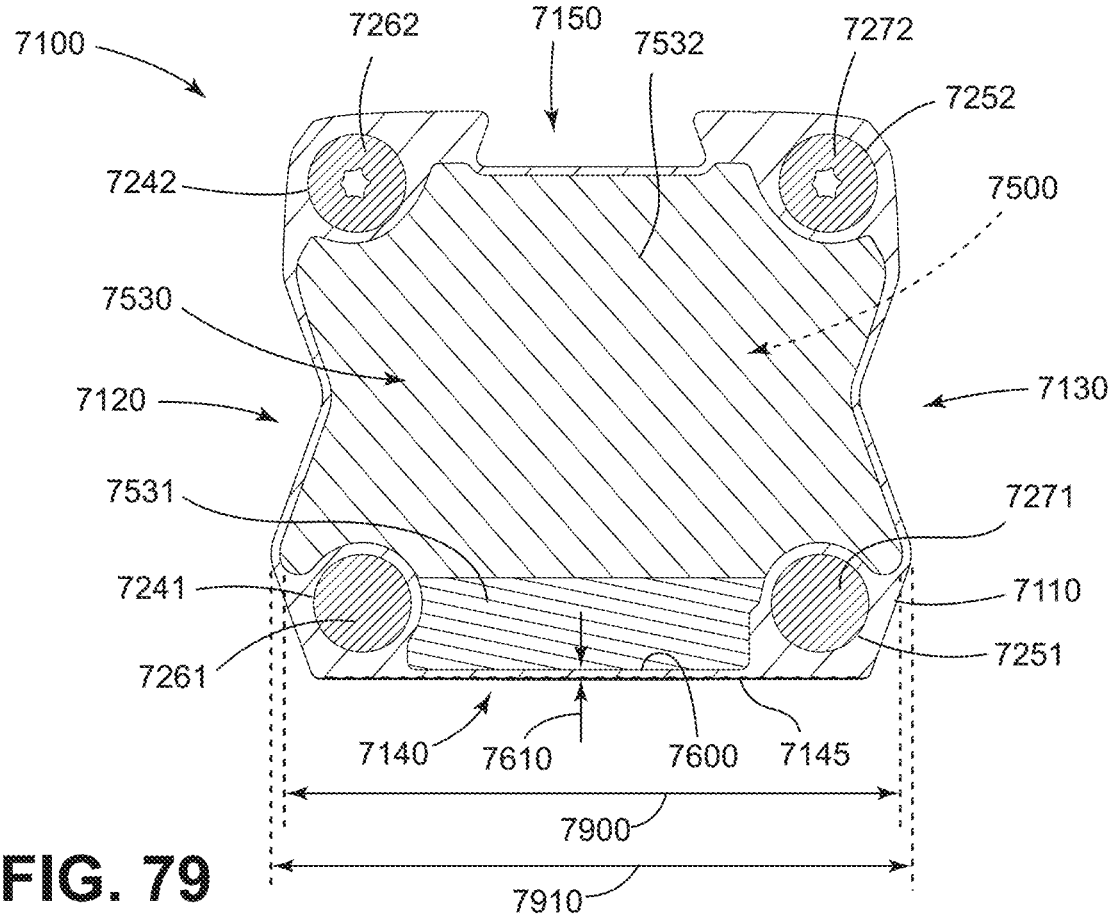

With reference to FIG. 77, the golf club head 7100 may have at least one cross-section where the filler material 7530 has a length 7700 in a front-to-rear direction greater than or equal to 90% of a length 7710 of the body portion 7110 in the front-to-rear direction. With continued reference to FIG. 77, the golf club head 7100 may have at least one cross-section where the filler material 7530 may have a length 7720 in a top-to-sole direction greater than or equal to 80% of a length 7730 of the body portion 7110 in the top-to-sole direction. With reference to FIG. 79, the golf club head 7100 may have at least one cross-section where the filler material 7530 has a length 7900 in a toe-to-heel direction greater than or equal to 90% of a length 7910 of the body portion 7110 in the toe-to-heel direction. The apparatus, methods, and articles of manufacture described herein are not limited in this regard.

The filler material 7530 may have a density less than a density of the body portion 7110 to allow for more discretionary mass to be allocated to other areas of the golf club head 7100. With respect to the present example, the filler material 7530 may have a fill volume ($V_f$) greater than or equal to 68% of a total volume ($V_t$) of the golf club head 7100 and a fill mass ($M_f$) less than or equal 8% of a total mass ($M_t$) of the golf club head 7100. In one example, the total volume ($V_t$) of the golf club head 7100 may be greater than or equal to 7.00 $inch^3$ (114.709 $cm^3$) and less than or equal to 9.00 $inch^3$ (147.484 $cm^3$) and the total mass ($M_t$) of the golf club head 7100 may be greater than or equal to 345 grams and less than or equal to 400 grams. As described herein, selecting the filler material 7530 from a lightweight or low density material and increasing the fill volume ($V_f$) of the filler material 2030 relative to the total volume ($V_t$) of the golf club head 7100 may enable greater discretionary mass placement toward a periphery of the golf club head 7100 to optimize certain mass properties of the golf club head 7100 such as MOI, CG location, and mass balance while maintaining a suitable club head weight. In one example, a ratio between a percentage fill volume $$\left(\frac{Vf}{Vt}\times 100\right)$$

and a percentage fill mass $$\left(\frac{Mf}{Mt}\times 100\right)$$

of the filler material 7530 may be greater than or equal to 8.5 and the golf club head 7100 may have a MOI greater than or equal to 7000 $g\cdot cm^2$. In another example, the golf club head 7100 may have a MOI greater than or equal to 7500 $g\cdot cm^2$. In yet another example, the golf club head 7100 may have a MOI greater than or equal to 7700 $g\cdot cm^2$. The apparatus, methods, and articles of manufacture described herein are not limited in this regard.

As described previously herein, the golf club head 7100 may include a weighting system that utilizes a plurality of weight ports (e.g., toe-side weight ports 7241 and 7242 and heel-side weight ports 7251 and 7252) and corresponding interchangeable weight portions (e.g., weight portions 7261, 7262, 7271, and 7272) to adjust the mass properties of the golf club head 7100. Additionally, as described herein, the hosel bore 7135 may be configured to receive any of the hosel types described herein to further adjust the mass properties of the golf club head 7100. The apparatus, methods, and articles of manufacture described herein are not limited in this regard.

The filler materials described herein may include, but are not limited to, one or more polymer materials. In one example, the filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, the filler material may be one or more thermoset polymers having bonding properties (e.g., one or more adhesive or epoxy materials). The filler material may also absorb shock, isolate vibration, and/or dampen noise when the golf club head 100 strikes a golf ball. Further, the filler material may be an epoxy material that may be flexible or slightly flexible when cured. In another example, the filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minnesota. In another example, the filler material may include 3M™ Scotch-Weld™ Epoxy Adhesive DP100 Plus Clear. In another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In another example, the filler material may be LOCTITE® materials manufactured by Henkel Corporation, Rocky Hill, Connecticut. In another example, the filler material may be a polymer material such as an ethylene copolymer material that may absorb shock, isolate vibration, and/or dampen noise when a golf club head strikes a golf ball via the face portion. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience, i.e., relatively high coefficient of restitution (COR). In another example, the filler material may be formed from one or more metals or metal alloys, such as aluminum, copper, zinc, and/or titanium. A filler material not specifically described in detail herein may include one or more similar or different types of materials described herein. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all of the heating and cooling processes may be performed by using heating or cooling systems that employ conveyor belts that move a golf club head described herein through a heating or cooling environment for a period of time as described herein. The apparatus, methods, and articles of manufacture described herein are not limited in this regard.

Figure 80:
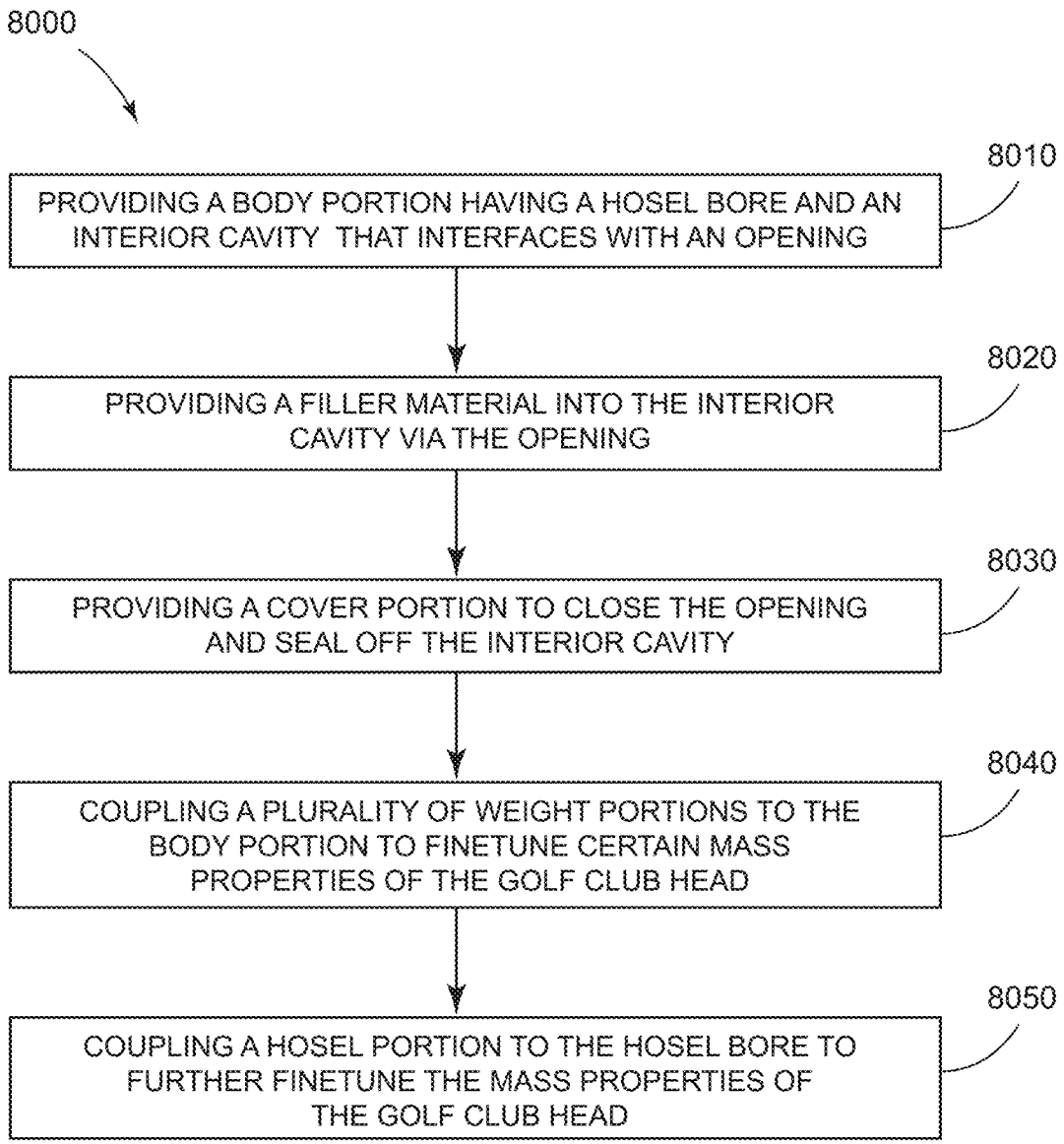
FIG. 80 depicts a manner in which any of the example golf club heads herein may be manufactured according to an embodiment of the apparatus, methods, and articles of manufacture described herein.

FIG. 80 depicts one manner by which any of the golf club heads described herein may be manufactured. In the example of FIG. 80, a process 8000 may begin with providing a body portion having a hosel bore and an interior cavity that interfaces with an opening (block 8010). A filler material may be provided into the interior cavity via the opening (block 8020). In one example, the filler material may be adapted as an injectable liquid polymer material and later hardened using a curing process. In another example, the filler material may be adapted as an insertable solid polymer material. As described herein, the filler material may reinforce a face portion of the golf club head and may enable greater discretionary mass placement in other areas of the golf club head to optimize certain mass properties such as MOI, CG location, and mass balance. A cover portion may be provided to close the opening and enclose the interior cavity (block 8030). A plurality of weight portions may be coupled to the body portion to adjust certain mass properties of the golf club head (block 8040). A hosel portion may be coupled to the hosel bore to further adjust the mass properties of the golf club head (8050). As described herein, the hosel portion may be selected from a variety of different hosel types based on a golfer's swing type and swing tendencies. The apparatus, methods, and articles of manufacture described herein are not limited in this regard.

Figure 81:
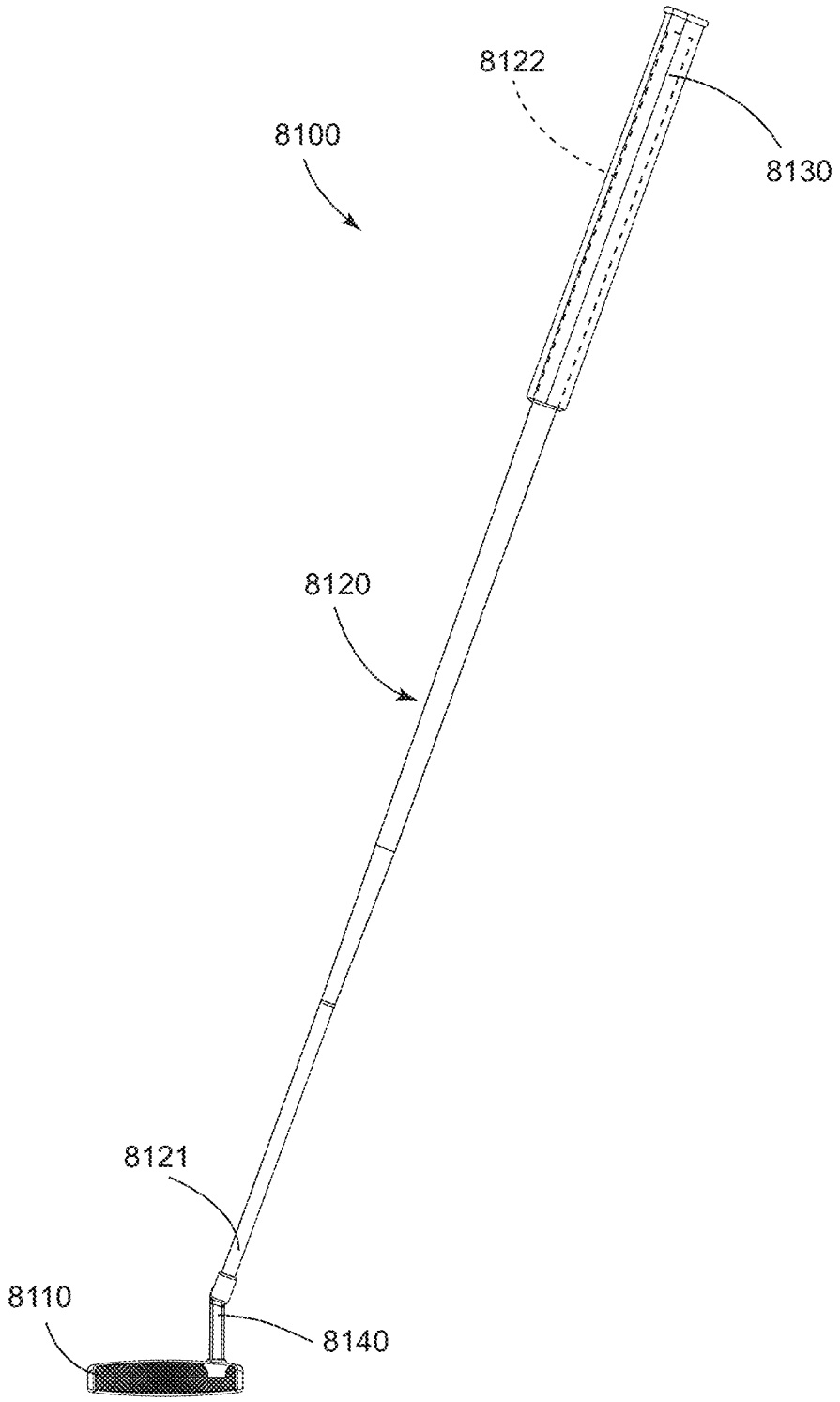
FIG. 81 depicts a golf club having a golf club head according to any embodiment of the apparatus, methods, and articles of manufacture described herein.

In the example of FIG. 81, a golf club 8100 may include a golf club head 8110, a shaft 8120, a grip 8130, and a hosel portion 8140. The shaft 8120 may have a tip end portion 8121 and a butt end portion 8122. The butt end portion 8122 of the shaft 8120 may be coupled to the grip 8130 and the tip end portion 8121 of the shaft 8120 may be coupled to the hosel portion 8140. The hosel portion 8140 may be coupled to the golf club head 8110 via a hosel bore as described herein. The golf club head 8110 and the hosel portion 8140 may include any of the golf club heads and hosel types described herein. The shaft 8120 may be formed from a metal material, a composite material, or any other suitable material or combination of materials. The grip 8130 may be formed from a rubber material, a polymer material, or any other suitable material or combination of materials. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods, and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion including a toe portion, a heel portion, a front portion, a rear portion, a top portion, a sole portion, an interior cavity, a first opening at the sole portion, a face portion located at the front portion and including a front surface and a rear surface opposite the front surface, and a back wall portion located opposite the face portion;

a crossbar portion coupled to the body portion, the crossbar portion comprising:

a central body portion received in a recess at the rear portion of the body portion;

two arms extending from the central body portion, each of the two arms including a projection configured to be received in a corresponding notch in the back wall portion; and a central port extending from the central body portion and received in a second opening in the recess;

a filler material partially or entirely filling the interior cavity and contacting the rear surface of the face portion;

a sole plate coupled to the sole portion to close the first opening, the sole plate comprising a through-port concentrically aligned with the central port to enable the crossbar portion to be attached to the body portion via a mechanical fastener received in the through-port and threadedly engaged to the central port;

a first weight port located at the sole portion and disposed at or proximate the front portion, the first weight port having a third opening that interfaces with the interior cavity;

a second weight port located at the sole portion and disposed at or proximate the rear portion, the second weight port having a fourth opening that interfaces with the interior cavity;

a first weight portion configured to be received in the first weight port; and a second weight portion configured to be received in the second weight port, wherein the filler material partially encases the mechanical fastener, and wherein the filler material is provided to the interior cavity via any one of the first opening, the third opening, or the fourth opening.

2. A golf club head as defined in claim 1, wherein the filler material includes a polymer material.

3. A golf club head as defined in claim 1, wherein the filler material is configured as an injectable material.

4. A golf club head as defined in claim 1, wherein the filler material is configured as an insert.

5. A golf club head as defined in claim 1, wherein the filler material has a fill volume greater than or equal to 56% of a total volume of the golf club head.

6. A golf club head as defined in claim 1, wherein the filler material has a fill mass less than or equal to 7% of a total mass of the golf club head.

7. A golf club head as defined in claim 1, further comprising a moment of inertia greater than or equal to 5000 $g \cdot cm^2$.

8. A golf club head comprising:

a body portion including a toe portion, a heel portion, a front portion, a rear portion, a top portion, a sole portion, an interior cavity, a first opening at the sole portion, a face portion located at the front portion and including a front surface and a rear surface opposite the front surface, and a back wall portion located opposite the face portion;

a crossbar portion coupled to the body portion, the crossbar portion comprising:

a central body portion received in a recess at the rear portion of the body portion;

two arms extending from the central body portion, each of the two arms including a projection configured to be received in a corresponding notch in the back wall portion; and a central port extending from the central body portion and received in a second opening in the recess;

a filler material partially or entirely filling the interior cavity, the filler material comprising:

a first filler material contacting the rear surface of the face portion; and a second filler material located aft of the first filler material, the second filler material having a density that is different from a density of the first filler material;

a sole plate coupled to the sole portion to close the first opening, the sole plate comprising a through-port concentrically aligned with the central port to enable the crossbar portion to be attached to the body portion via a mechanical fastener received in the through-port and threadedly engaged to the central port;

a first weight port located at the sole portion and disposed at or proximate the front portion, the first weight port having a third opening that interfaces with the interior cavity;

a second weight port located at the sole portion and disposed at or proximate the rear portion, the second weight port having a fourth opening that interfaces with the interior cavity;

a first weight portion configured to be received in the first weight port; and a second weight portion configured to be received in the second weight port, wherein the second filler material partially encases the mechanical fastener, and wherein the first filler material and the second filler material are configured to be provided to the interior cavity via any one of the first opening, the third opening, or the fourth opening.

9. A golf club head as defined in claim 8, wherein the second filler material has a fill volume that is greater than a fill volume of the first filler material.

10. A golf club head as defined in claim 8, wherein the first filler material includes a solid polymer material and the second filler material includes a foam polymer material.

11. A golf club head as defined in claim 8, wherein the first filler material has a density that is greater than a density of the second filler material.

12. A golf club head as defined in claim 8, wherein the golf club head has a total volume greater than or equal to 5.00 $inch^3$ (81.935 $cm^3$) and less than or equal to 6.00 $inch^3$ (98.322 $cm^3$), wherein the golf club head has a total mass greater than or equal to 325 grams and less than or equal to 375 grams, wherein the filler material has a fill volume greater than or equal to 56% of the total volume of the golf club head, and wherein the filler material has a fill mass less than or equal to 7% of the total mass of the golf club head.

13. A golf club head as defined in claim 8, further comprising a moment of inertia greater than or equal to 5250 $g \cdot cm^2$.

14. A golf club head comprising:

a body portion including a toe portion, a heel portion, a front portion, a rear portion, a top portion, a sole portion, an interior cavity, a first opening at the sole portion, a face portion located at the front portion and including a front surface and a rear surface opposite the front surface, and a back wall portion located opposite the face portion;

a crossbar portion coupled to the body portion, the crossbar portion comprising:

a central body portion received in a recess at the rear portion of the body portion;

two arms extending from the central body portion, each of the two arms including a projection configured to be received in a corresponding notch in the back wall portion; and a central port extending from the central body portion and received in a second opening in the recess;

a filler material partially or entirely filling the interior cavity, the filler material comprising:

a solid polymer filler material contacting the rear surface of the face portion; and a foam polymer filler material located aft of the solid polymer filler material;

a sole plate coupled to the sole portion to close the first opening, the sole plate comprising a through-port concentrically aligned with the central port to enable the crossbar portion to be attached to the body portion via a mechanical fastener received in the through-port and threadedly engaged to the central port;

a first weight port located at the sole portion and disposed at or proximate the front portion, the first weight port having a third opening that interfaces with the interior cavity;

a second weight port located at the sole portion and disposed at or proximate the rear portion, the second weight port having a fourth opening that interfaces with the interior cavity;

a first weight portion configured to be received in the first weight port; and a second weight portion configured to be received in the second weight port, wherein the foam polymer filler material partially encases the mechanical fastener, and wherein the solid polymer filler material and the foam polymer filler material are configured to be provided to the interior cavity via any one of the first opening, the third opening, or the fourth opening.

15. A golf club head as defined in claim 14, wherein the filler material has length in a front-to-rear direction greater than or equal to 90% of a length of the body portion in the front-to-rear direction.

16. A golf club head as defined in claim 14, wherein the filler material has a length in a top-to-sole direction greater than or equal to 80% of a length of the body portion in the top-to-sole direction.

17. A golf club head as defined in claim 14, wherein the filler material has a length in a toe-to-heel direction greater than or equal to 90% of a length of the body portion in the toe-to-heel direction.

18. A golf club head as defined in claim 14, wherein the filler material has a fill volume greater than or equal to 56% of a total volume of the golf club head.

19. A golf club head as defined in claim 14, wherein the filler material has a fill mass less than or equal to 7% of a total mass of the golf club head.

20. A golf club head as defined in claim 14, further comprising a moment of inertia greater than or equal to 5500 $g \cdot cm^2$.

* * * * *